US009353498B2

(12) United States Patent
Goldberg et al.

(10) Patent No.: US 9,353,498 B2
(45) Date of Patent: May 31, 2016

(54) BUILDING ENVELOPE ASSEMBLY INCLUDING MOISTURE TRANSPORTATION FEATURE

(71) Applicant: Moisture Management, LLC, Chaska, MN (US)

(72) Inventors: Louise Franklin Goldberg, Minneapolis, MN (US); Mark Larry Stender, Chaska, MN (US)

(73) Assignee: Moisture Management, LLC, Chaska, MN (US)

( * ) Notice: Subject to any disclaimer, the term of this patent is extended or adjusted under 35 U.S.C. 154(b) by 0 days.

(21) Appl. No.: 14/469,183

(22) Filed: Aug. 26, 2014

(65) Prior Publication Data

US 2014/0360109 A1 Dec. 11, 2014

Related U.S. Application Data

(63) Continuation of application No. 13/544,792, filed on Jul. 9, 2012, now Pat. No. 8,813,443, which is a continuation-in-part of application No. 12/612,380, filed on Nov. 4, 2009, now abandoned, which is a continuation-in-part of application No. 12/467,902, filed on May 18, 2009, now Pat. No. 8,001,736.

(51) Int. Cl.
*E04B 1/70* (2006.01)
*E02D 19/00* (2006.01)
(Continued)

(52) U.S. Cl.
CPC ..... *E02D 19/00* (2013.01); *E04B 1/625* (2013.01); *E04B 1/66* (2013.01); *E04B 1/665* (2013.01); *E04B 1/70* (2013.01); *E04B 2/707* (2013.01)

(58) Field of Classification Search
CPC ..... E04B 1/70; E04B 1/765; E04B 1/7061; E04B 1/625; E04B 1/644; E04B 1/7076; E04B 1/7046; E04B 1/66; E04B 1/665; E04B 2/707; E04F 2013/065; E02D 19/00
USPC ..... 52/209, 204.52, 302.1, 302.3, 302.6, 52/302.7, 169.5, 408
See application file for complete search history.

(56) References Cited

U.S. PATENT DOCUMENTS 1,976,166 A * 10/1934 Friedberg ..... 52/302.6
2,264,961 A 12/1941 Ward
(Continued)

FOREIGN PATENT DOCUMENTS

GB 2169071 A 7/1986

OTHER PUBLICATIONS

Office Action for U.S. Appl. No. 11/251,661 mailed Sep. 4, 2008 (12 pages).
(Continued)

*Primary Examiner* — Robert Canfield
*Assistant Examiner* — Babajide Demuren
(74) *Attorney, Agent, or Firm* — Dicke, Billig & Czaja, PLLC

(57) ABSTRACT

A building envelope assembly including a first structural wall frame, a flexible sheet, a drain assembly, and a seal. The flexible sheet is disposed along a surface of the first structural wall frame. The flexible sheet configured to transport moisture along two opposing surfaces. The flexible sheet includes an upper portion and a bottom portion having a moisture wicking sheet. The drain assembly is configured to receive moisture from the flexible sheet. The seal is attached to the bottom portion of the flexible sheet and is configured to prevent ingress of water, water vapor, and air toward the upper portion of the flexible sheet.

20 Claims, 52 Drawing Sheets

(51) Int. Cl.

| | |
|---|---|
| ***E04B 2/70*** | (2006.01) |
| ***E04B 1/62*** | (2006.01) |
| ***E04B 1/66*** | (2006.01) |

(56) References Cited

U.S. PATENT DOCUMENTS

| | | | | |
|---|---|---|---|---|
| 2,324,971 | A | 7/1943 | Woodward | |
| 3,124,847 | A | 3/1964 | Charniga, Jr. | |
| 3,561,177 | A | 2/1971 | Agro et al. | |
| 3,568,391 | A * | 3/1971 | Conway | 52/586.2 |
| 3,638,372 | A | 2/1972 | Rosenthal | |
| 3,772,840 | A * | 11/1973 | Hala | 52/302.3 |
| 3,895,773 | A | 7/1975 | Solo | |
| 3,990,202 | A | 11/1976 | Becker | |
| RE29,804 | E | 10/1978 | Becker | |
| 4,472,916 | A | 9/1984 | Krebs | |
| 4,506,595 | A | 3/1985 | Roberts et al. | |
| 4,580,487 | A | 4/1986 | Sosnowski | |
| 4,642,012 | A | 2/1987 | Blucher et al. | |
| 4,733,989 | A | 3/1988 | Harriett | |
| 4,745,716 | A | 5/1988 | Kuypers | |
| 4,749,306 | A | 6/1988 | Demeny et al. | |
| 4,841,687 | A * | 6/1989 | Navetta | 52/58 |
| 4,843,786 | A | 7/1989 | Walkinshaw et al. | |
| 5,003,743 | A * | 4/1991 | Bifano et al. | 52/288.1 |
| 5,027,572 | A * | 7/1991 | Purcell et al. | 52/309.9 |
| 5,218,798 | A * | 6/1993 | Bentivegna et al. | 52/206 |
| 5,343,661 | A | 9/1994 | Sourlis | |
| 5,410,852 | A * | 5/1995 | Edgar et al. | 52/408 |
| 5,598,673 | A * | 2/1997 | Atkins | 52/302.1 |
| 5,692,348 | A | 12/1997 | Ambrosino | |
| 5,706,804 | A | 1/1998 | Baumann et al. | |
| 5,761,864 | A | 6/1998 | Nonoshita | |
| 5,771,643 | A | 6/1998 | Parker | |
| 5,799,454 | A | 9/1998 | Andersson et al. | |
| 5,826,391 | A | 10/1998 | Underwood | |
| 5,836,135 | A * | 11/1998 | Hagan et al. | 52/836 |
| 5,860,259 | A | 1/1999 | Laska | |
| 5,870,864 | A | 2/1999 | Snyder et al. | |
| 5,937,600 | A | 8/1999 | Larson | |
| 5,946,870 | A * | 9/1999 | Bifano et al. | 52/254 |
| 5,953,883 | A | 9/1999 | Ojala | |
| 5,988,264 | A | 11/1999 | Goldsmith | |
| 6,023,892 | A | 2/2000 | Sourlis | |
| 6,101,775 | A * | 8/2000 | Larimore | 52/302.1 |
| 6,108,991 | A | 8/2000 | Hagan et al. | |
| 6,131,353 | A | 10/2000 | Egan | |
| 6,134,847 | A | 10/2000 | Bifano et al. | |
| 6,148,570 | A | 11/2000 | Dinwoodie et al. | |
| 6,233,890 | B1 | 5/2001 | Tonyan | |
| 6,293,064 | B1 * | 9/2001 | Larson | 52/302.1 |
| 6,298,620 | B1 | 10/2001 | Hatzinikolas | |
| 6,385,925 | B1 | 5/2002 | Wark | |
| 6,385,932 | B1 | 5/2002 | Melchiori | |
| 6,410,118 | B1 | 6/2002 | Reicherts et al. | |
| 6,550,212 | B2 | 4/2003 | Lubker, II | |
| 6,578,331 | B1 | 6/2003 | Leslie et al. | |
| 6,594,965 | B2 | 7/2003 | Coulton | |
| 6,662,504 | B2 | 12/2003 | Krogstad | |
| 6,745,531 | B1 * | 6/2004 | Egan | 52/302.1 |
| 6,786,013 | B2 | 9/2004 | Coulton | |
| 6,964,136 | B2 | 11/2005 | Collins et al. | |
| 7,247,090 | B2 | 7/2007 | Vacek | |
| 7,309,665 | B2 | 12/2007 | Qureshi et al. | |
| 8,001,736 | B2 | 8/2011 | Goldberg et al. | |
| 8,074,409 | B2 | 12/2011 | Goldberg et al. | |
| 8,316,597 | B2 | 11/2012 | Goldberg et al. | |
| 8,813,443 | B2 | 8/2014 | Goldberg et al. | |
| 2002/0073628 | A1 | 6/2002 | Dextras | |
| 2002/0088189 | A1 * | 7/2002 | Honda | 52/287.1 |
| 2002/0108333 | A1 | 8/2002 | Clayton | |
| 2002/0115367 | A1 | 8/2002 | Lolley et al. | |
| 2002/0152693 | A1 * | 10/2002 | Krogstad | 52/58 |
| 2003/0126810 | A1 | 7/2003 | Brunson et al. | |
| 2003/0230035 | A1 * | 12/2003 | Collins et al. | 52/209 |
| 2004/0003558 | A1 | 1/2004 | Collins et al. | |
| 2004/0226238 | A1 | 11/2004 | Haapiainen | |
| 2004/0255533 | A1 | 12/2004 | Koester | |
| 2005/0210787 | A1 | 9/2005 | Koester | |
| 2005/0246987 | A1 * | 11/2005 | Hatzinikolas | 52/302.1 |
| 2006/0117687 | A1 | 6/2006 | Ehrman et al. | |
| 2006/0123723 | A1 * | 6/2006 | Weir et al. | 52/302.1 |
| 2006/0283102 | A1 | 12/2006 | Sourlis | |
| 2007/0084139 | A1 | 4/2007 | Stender | |
| 2007/0094957 | A1 | 5/2007 | Burton et al. | |
| 2007/0094964 | A1 | 5/2007 | Stender | |
| 2007/0193151 | A1 * | 8/2007 | Anderson | 52/302.3 |
| 2007/0199265 | A1 | 8/2007 | Iske et al. | |
| 2007/0204541 | A1 | 9/2007 | Sade | |
| 2009/0183445 | A1 | 7/2009 | McPherson | |
| 2010/0287861 | A1 | 11/2010 | Goldberg et al. | |
| 2010/0287862 | A1 | 11/2010 | Goldberg et al. | |
| 2011/0250035 | A1 | 10/2011 | Goldberg et al. | |

OTHER PUBLICATIONS

Office Action for U.S. Appl. No. 11/252,350 mailed Feb. 17, 2009 (15 pages).
Office Action for U.S. Appl. No. 11/252,350 mailed Feb. 1, 2010 (12 pages).
Office Action for U.S. Appl. No. 12/467,902 mailed Aug. 16, 2010 (18 pages).
Office Action for U.S. Appl. No. 12/467,912 mailed Dec. 8, 2010 (15 pages).
Office Action for U.S. Appl. No. 13/324,635 mailed Mar. 21, 2012 (15 pages).
Final Office Action for U.S. Appl. No. 11/251,661 mailed Feb. 18, 2009 (13 pages).
Final Office Action for U.S. Appl. No. 11/252,350 mailed Oct. 2, 2009 (10 pages).
Final Office Action for U.S. Appl. No. 12/467,902 mailed Jan. 19, 2011 (14 pages).
Final Office Action for U.S. Appl. No. 12/467,912 mailed Jun. 14, 2011 (9 pages).
Notice of Allowance for U.S. Appl. No. 12/467,902 mailed Apr. 14, 2011 (7 pages).
Notice of Allowance for U.S. Appl. No. 12/467,912 mailed Aug. 12, 2011 (7 pages).
Notice of Allowance for U.S. Appl. No. 13/324,635 mailed Jul. 19, 2012 (5 pages).
Examiner's Answer for U.S. Appl. No. 11/251,661 mailed Nov. 24, 2009 (14 pages).
Advisory Action for U.S. Appl. No. 11/251,661 mailed May 14, 2009 (3 pages).
Advisory Action for U.S. Appl. No. 11/252,350 mailed Dec. 24, 2009 (2 pages).
Restriction Requirement for U.S. Appl. No. 11/251,661 mailed on Jul. 23, 2008 (5 pages).
Restriction Requirement for U.S. Appl. No. 11/252,350 mailed on Oct. 2, 2008 (8 pages).
Restriction Requirement for U.S. Appl. No. 12/467,912 mailed on Aug. 23, 2010 (8 pages).
Restriction Requirement for U.S. Appl. No. 12/612,380 mailed on Mar. 7, 2012 (12 pages).
Restriction Requirement for U.S. Appl. No. 12/612,380 mailed on Nov. 30, 2011 (9 pages).
Examiner Interview Summary for U.S. Appl. No. 12/467,912 mailed Jul. 25, 2011 (3 pages).
Examiner Interview Summary for U.S. Appl. No. 12/612,380 mailed Mar. 26, 2012 (4 pages).
Office Action for U.S. Appl. No. 13/544,792 mailed Jul. 17, 2013 (8 pages).
Notice of Allowance for U.S. Appl. No. 13/544,792 mailed Jan. 3, 2014 (6 pages).
Notice of Allowance for U.S. Appl. No. 13/544,792 mailed Apr. 14, 2014 (14 pages).

* cited by examiner

BUILDING ENVELOPE ASSEMBLY INCLUDING MOISTURE TRANSPORTATION FEATURE

CROSS-REFERENCE TO RELATED APPLICATIONS

This application is a continuation of U.S. application Ser. No. 13/544,792, filed on Jul. 9, 2012, entitled BUILDING ENVELOPE ASSEMBLY INCLUDING MOISTURE TRANSPORTATION FEATURE, which is a continuation-in-part to U.S. patent application Ser. No. 12/612,380, entitled BUILDING ENVELOPE ASSEMBLY INCLUDING MOISTURE TRANSPORTATION FEATURE, which is a continuation-in-part to U.S. patent application Ser. No. 12/467,902, now U.S. Pat. No. 8,001,736, entitled EXTERIOR WALL ASSEMBLY INCLUDING MOISTURE TRANSPORTATION, which are all herein incorporated by reference.

Additionally, this Utility Patent Application is related to commonly assigned Utility patent application Ser. No. 12/467,912, now U.S. Pat. No. 8,074,409, entitled EXTERIOR WALL ASSEMBLY INCLUDING DYNAMIC MOISTURE REMOVAL FEATURE.

BACKGROUND

Improvements in construction materials, construction methods, and more stringent local and state building codes have contributed to improved energy efficiency of new and remodeled insulated wall structures for homes and buildings.

The conventional approach to fabricating a highly energy-efficient wall is to erect a wall frame supporting multiple layers of insulation placed between interior and exterior layers of the wall. One or more breathable "house-wrap" styled layers is secured (e.g., stapled) to an exterior sheathing surface to prevent bulk water from wetting the insulation and thus reducing its insulative value (R-value), as well as wetting the sheathing and framing causing mold and rot. Typically, a low permeance (<0.1 perm polyethylene membrane) is attached to the warm-in-winter side of the framing members. Continuing experience shows that the combined effect of dry sheathing and a warm-side vapor retarder results in walls that have a tendency to retain moisture, which can undesirably lead to mold growth within the wall, degradation of the wall, insects, and/or other moisture-related problems. These conventional insulated wall structures also reduce heat loss through the wall by reducing drafts (infiltration) that remove heat from the home/building. However, since these conventional insulated wall structures are so tightly constructed/sealed, any water that is trapped in the wall (e.g., due to a breach or damage to the structure or to condensation build-up) tends to remain inside the wall. Moisture that is trapped inside a wall reduces the performance of the insulation and has the potential to feed the growth of mold and/or bacteria.

Moisture trapped inside of the walls includes moisture vapor and bulk water, such as condensation. Condensation can form inside a wall due to temperature differences across the insulated walls. For example, during typical northern cold winter months, the air outside of an insulated wall is cold and dry, and the air inside of the wall is relatively warm and humid. Thus, a natural humidity gradient is formed that drives moisture vapor in the air inside the wall toward the exterior of the wall. Large gradients between outside and inside air temperature and humidity can lead to a significant accumulation of moisture condensation within the insulated wall.

The opposite conditions occur during the summer months, when the air outside the structure is warm and humid, and the air inside the structure is conditioned to be cooler and dryer. Thus, during summer months a natural humidity gradient exists to drive warm humid air toward an interior of the insulated wall, which can analogously lead to a significant accumulation of moisture condensation within the insulated wall.

In some cases moisture accumulation in the insulated wall arises from wind driven water that enters the wall along a window or door seam. This form of moisture ingress can, for example, be the result of poor workmanship or from a deterioration of flashing or sealants around the window/door. In any regard, once the wall accumulates moisture it is difficult to dry the wall to a level that will not support the growth of mold and/or bacteria.

Owners, manufacturers, and remodelers of wall structures desire walls that are energy efficient, durable, and compatible with accepted construction practices.

SUMMARY

One embodiment provides a building envelope assembly including a first structural wall frame, a flexible sheet, a drain assembly, and a seal. The flexible sheet is disposed along a surface of the first structural wall frame. The flexible sheet configured to transport moisture along two opposing surfaces. The flexible sheet includes an upper portion and a bottom portion having a moisture wicking sheet. The drain assembly is configured to receive moisture from the flexible sheet. The seal is attached to the bottom portion of the flexible sheet and is configured to prevent ingress of water, water vapor, and air toward the upper portion of the flexible sheet.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

Figure 1:
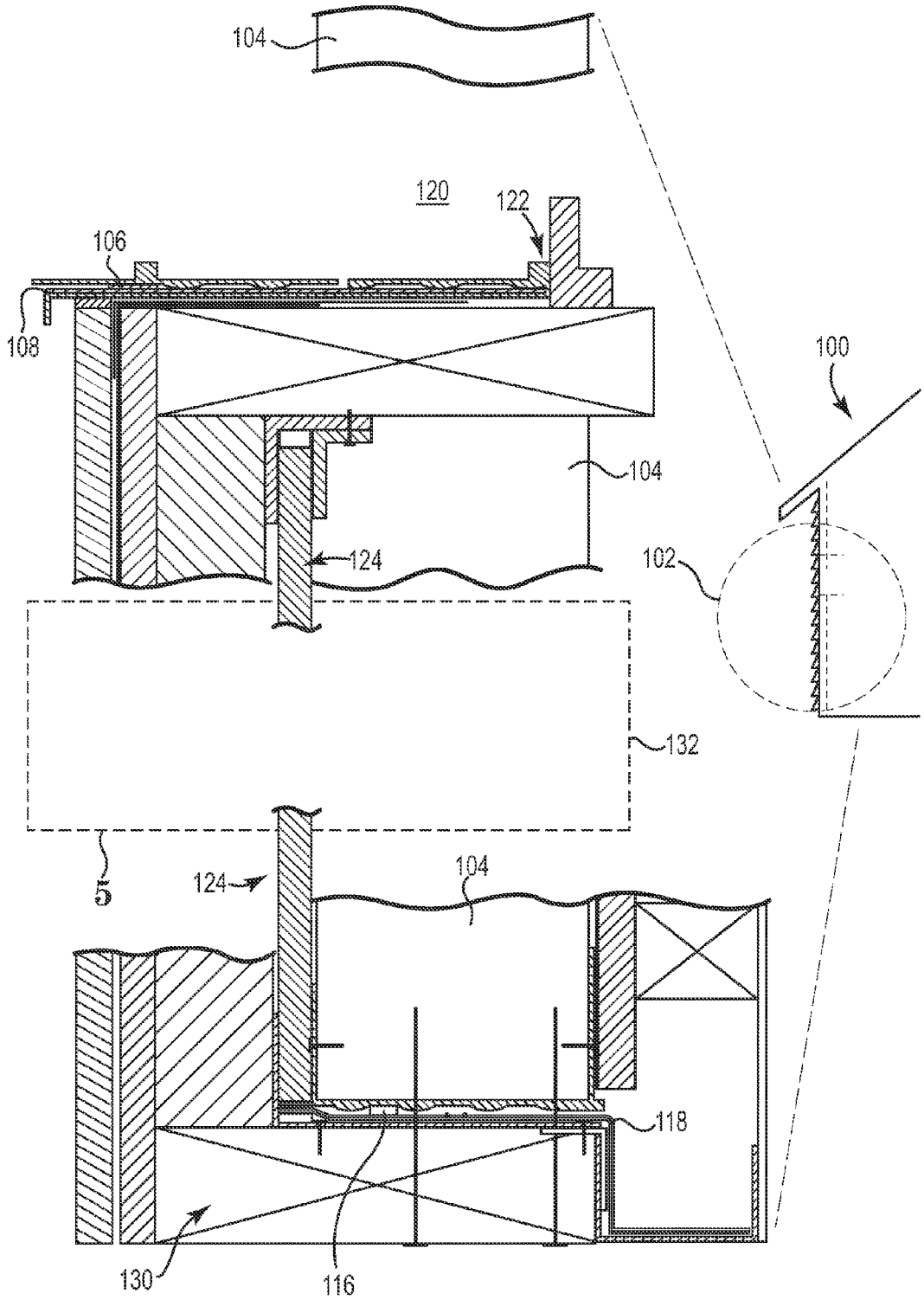
FIG. 1 is a schematic representation of a building wall assembly including a flexible sheet configured to direct moisture out of the wall assembly according to one embodiment.

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

As used herein, moisture includes bulk liquid water, such as rain or rain droplets, and moisture vapor, such as humidity contained in the air.

As used herein, fluid is a broad term that includes both gases and liquids.

As used herein, barrier means to substantially prevent or deny the through-passage of air and to substantially prevent or deny the passage of moisture vapor. Thus, barrier as used herein means to substantially prevent the through-passage of moisture through the barrier, whether the moisture is in the form of moisture vapor or bulk liquid. As an example, conventional house wrap materials (e.g., nonwoven sheets of polyethylene or Tyvek™ sheets and the like) are not barriers since they do permit the passage of air (which can contain moisture vapor) through the sheet. A solid polyethylene film several milli-inches thick, in contrast, is a barrier to the through-passage of air, moisture vapor, and bulk liquid.

As defined herein, building envelope assembly is a broad term which includes any assemblies which separate interior and exterior environments of a building. A building envelope assembly serves to protect the indoor environment from the elements of nature (e.g., rain, snow, etc.) and facilitate its climate control. A building envelope assembly as defined herein includes vertical assemblies, such as walls, and non-vertical assemblies, such as roofs, for example.

Embodiments provide a sheet configured to remove moisture from a wall assembly, and particularly for sealed and insulated wall assemblies.

Embodiments provide a sheet that forms a barrier or a water separation plane configured for bulk transportation of moisture, which cooperates with permeable membranes in the sealed wall assembly to allow exterior sourced moisture to dry to the exterior by vapor diffusion and interior sourced moisture to dry to the interior by vapor diffusion. The bulk water that is collected by the barrier is delivered to and removed from a lower portion of the draining assembly. In this way, the water separation plane and the permeable membranes dry the sealed wall assembly by both bulk water transport and vapor diffusion without compromising the interior/exterior liquid and vapor sealing of the wall assembly.

Improvements in building construction have resulted in wall assemblies that are highly energy efficient. These wall assemblies are often highly insulated and include sealed joints around windows and doors to prevent drafts. While these walls have high thermal efficiency, it has been observed that moisture can potentially accumulate inside the wall over time due to naturally occurring temperature and/or humidity gradients. In addition, moisture can potentially accumulate inside sealed walls due to water running down a steeply pitched roof, for example in the case where the joint/seal between the wall and the roof deteriorates and provides an ingress location for water into the wall.

Insulated exterior walls in the northern climate are configured to maintain warmth on an interior side of the wall and protect against cold conditions on an exterior side of the wall. Heating the inside of the structure can result in moisture condensation forming on interior portions of the wall assembly because warm air has a greater capacity for holding moisture as compared to cold air. Since the wall assembly is insulated and sealed, any moisture that condenses on interior surfaces of the wall assembly can be undesirably trapped in the wall. Embodiments describe herein provide a passive mechanism for draining moisture out of a sealed wall assembly to an exterior location, regardless of the transport mechanism that delivers the water inside the wall. Other embodiments provide active (or dynamic) transportation of moisture out of a sealed wall assembly to a collection area that is ventilated to dynamically evaporate the moisture.

It has been surprisingly discovered that implementing the moisture transporting features of embodiment described herein enable maintaining the exterior sheathing of a tightly sealed and insulated wall assembly at a low moisture content of about 2%. This represents an improvement of between a factor of 2-4 times in the dryness of a state of the art wall assembly.

Embodiments provide mechanisms to remove moisture that accumulates within a sealed wall assembly, providing sealed walls with a moisture content of less than about 6% for a wide range of humidity gradients and even in the case where bulk water begins to undesirably accumulate inside the wall. In one embodiment, the moisture removal mechanisms described herein dry the interior portions of a sealed wall assembly down to a moisture content that will not support the growth of mold and/or bacteria.

Embodiments of the wall assemblies described herein apply to exterior wall assemblies, sealed and insulated exterior wall assemblies, interior wall assemblies, and/or subterranean wall assemblies. However, sealed exterior wall assemblies and subterranean wall assemblies are more susceptible to retaining moisture in the form of condensation and thus benefit directly from the embodiments described herein.

FIG. 1 is a schematic representation of a building 100 including a wall assembly 102 according to one embodiment. Wall assembly 102 includes a wall frame 104, a first seal 106 attached to a first flexible sheet 108, and a second seal 116 attached to a second flexible sheet 118. Each flexible sheet 108, 118 is configured to transport moisture away from wall frame 104 and out of wall assembly 102. In one embodiment, at least one of the flexible sheets 108, 118 is configured to transport moisture by capillary action away from wall frame 104.

In one embodiment, wall assembly 102 includes one or more openings 120 formed to receive a window or a door, as examples, and first sheet 108 cooperates with a drain 122 to collect and transport moisture that enters into opening 120 away from wall frame 104. In one embodiment, wall assembly 102 includes a moisture transport spacer 124 (MTS 124, also termed a Dryspacer) configured to form a water separation plane and collect moisture that accumulates inside wall assembly 102 and direct bulk moisture to second sheet 118 for transportation of the moisture out of wall assembly 102. In one embodiment, MTS 124 forms a water separation plane that is configured to drain/direct moisture along both sides of MTS 124 to sheet 118. Condensation or bulk water entering wall assembly 102 from either the interior or the exterior is removed from wall assembly 102 by the combination of MTS 124 and sheet 118, which minimizes or eliminates the potential for mold and/or rot to be produced by moisture that is trapped within the wall.

In one embodiment, wall assembly 102 is provided as a sealed system and includes first seal 106 attached to first sheet 108 and second seal 116 attached to second sheet 118. Seals 106, 116 are provided as fluid seals that prevent the pressure driven flow of moist interior air and/or moist exterior air toward wall frame 104 and to prevent the diffusion of water vapor across sheets 108, 118 (thus preventing the unchecked movement of humid air into wall assembly 102). Seals 106, 116 limit the exchange of humid air through wall assembly 102 to enable sheets 108, 118 to efficiently collect and direct moisture away from wall frame 104. In one embodiment, seals 106, 116 are configured as vapor seals that enable capillary flow along a structure (for example fibers) coupled to one or both of sheets 108, 118.

In one embodiment, wall frame 104 is fabricated on a base 130 and extends through an insulated section 132 (illustrated in FIG. 5) to drain 122 that is placed within opening 120. In one embodiment, wall frame 104 is fabricated of wood 2×4 boards that attaches to 2×6 boards of base 130, although other materials and sizes are also acceptable. Seals 106, 116 and sheets 108, 118, in combination with their attachment mechanisms, contribute to the effective transfer of loads within wall assembly 102. The view of FIG. 1 is a side view showing a width of the 2×4 wall frame 104. In general, fabrication of wall assembly 102 includes attaching sheet 118 to base 130, attaching MTS 124 to wall frame 104 prior to attaching wall frame 104 to base 130, and installing drain(s) 122 into openings formed in wall frame 104, all aspects of which are described in FIGS. 2-20 below.

Sheets 108, 118 are configured to wick moisture away from wall frame 104. In one embodiment, sheets 108, 118 are configured to wick moisture by capillary action and are formed of a hydrophilic fiber mat. In one embodiment, the hydrophilic fiber mat is a woven fiber mat of rayon fibers. In one embodiment, the hydrophilic fiber mat is a non-woven fiber mat formed of a random array of mutually-bonded rayon staple fibers. In other embodiments, the hydrophilic fiber web is formed on non-woven fiber forming equipment to have a preferential machine direction that configures the flow of moisture out of wall frame 104.

In one embodiment, MTS 124 is a polymer barrier sheet that forms a barrier to moisture transmission through MTS 124 by diffusion, capillary flow, hydrostatic flow or other penetration mechanisms. Moisture within wall assembly 102 will condense on MTS 124 barrier sheet, for at least the reason that the moisture is prevented from passing through MTS 124. The moisture that condenses on MTS 124 is transported down to sheet 118 and further transported along sheet 118 out of wall assembly 102, where the moisture is removed out of the wall and eventually evaporated. In one embodiment, MTS 124 is formed of a 10 mil polyethylene sheet.

Figure 2:
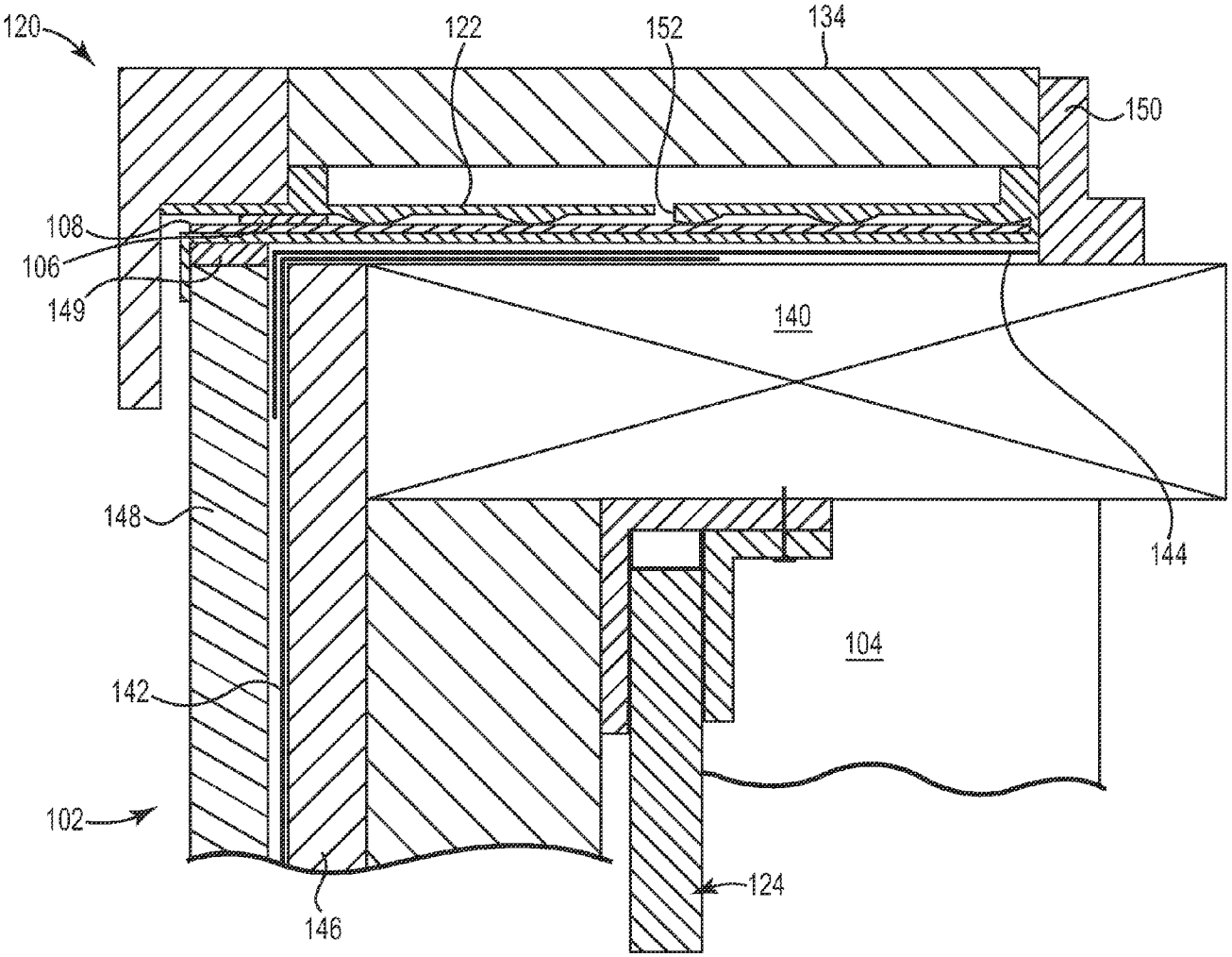
FIG. 2 is a schematic cross-sectional view of a moisture drain disposed in a window opening of the wall assembly illustrated in FIG. 1 according to one embodiment.

FIG. 2 is a schematic cross-sectional view of drain 122 placed in opening 120. Opening 120 is a rough opening sized to receive an envelope penetrating component 134 or EPC 134 (such as a window, a door, an air conditioner, or a vent). Opening 120 is formed within wall frame 104 between, for example, a cross-support 140 fixed between wooden studs. After rough opening 120 is formed, building paper 142 (such as a house wrap material) is attached to an exterior portion of wall assembly 102, a pan flashing 144 is set within rough opening 120, and drain 122 is placed on pan flashing 144 to overhang a sheathing 146 (e.g., oriented-strand board, plywood, or other sheathing material) and siding 148 that form the exterior of wall assembly 102.

Suitable cross-supports 140 include wooden beams such as a 2×4 or 2×6 wood beams attached to wall frame 104. Building paper 142 includes one or more layers of sixty minute grade D building paper or similar vapor permeable house wrap material stretched over and stapled to oriented-strand board 146. In one embodiment, pan flashing 144 is an appropriately formed sheet of thin metal or plastic or similar material that extends about six inches up the sides of studs formed around rough opening 120. Siding 148 includes any suitable cladding material, including vinyl siding, wood siding, aluminum siding, stucco, etc. In one embodiment, a bulk water seal 149 is disposed between drain 122 and siding 148 to minimize the potential for water undesirably entering between drain 122 and opening 120.

Drain 122 is placed into rough opening 120 and attached to cross-support 140 by any suitable attachment means, such as glue, nails, or screws. In one embodiment, EPC 134 is a window 134 is placed into opening 120 and set on drain 122. For ease of illustration, only a jamb portion of window 134 is illustrated resting on drain 122. Window 134 is subject to wind loading and could potentially shift within opening 120. In one embodiment, an interior bracket 150 is attached to cross-support 140 and window 134 to limit motion of window 134 after its installation.

Typically, wall assemblies are constructed in a manner that attempts to prevent moisture entrance. However, forming openings in the wall assembly for doors and windows unavoidably provides a pathway for moisture to enter the wall assembly. As described above, once moisture enters a wall assembly, it is difficult if not impossible to adequately dry the wall assembly. Drain 122 is configured to collect and direct moisture entering through opening 120 along first sheet 108 to a location outside of siding 148. In one embodiment, sheet 108 includes a capillary structure that is configured to wick moisture out of drain 122 to an outside surface of siding 148. Moisture that enters opening 120 is collected by drain 122, directed through drain holes 152 formed in drain 122 that communicate with flexible sheet 108, and subsequently directed along sheet 108 to an exterior of siding 148. In one embodiment, moisture that enters opening 120 that might bypass drain 122 is collected and directed along MTS 124 downward and out of a bottom portion of wall assembly 102.

Figure 3:
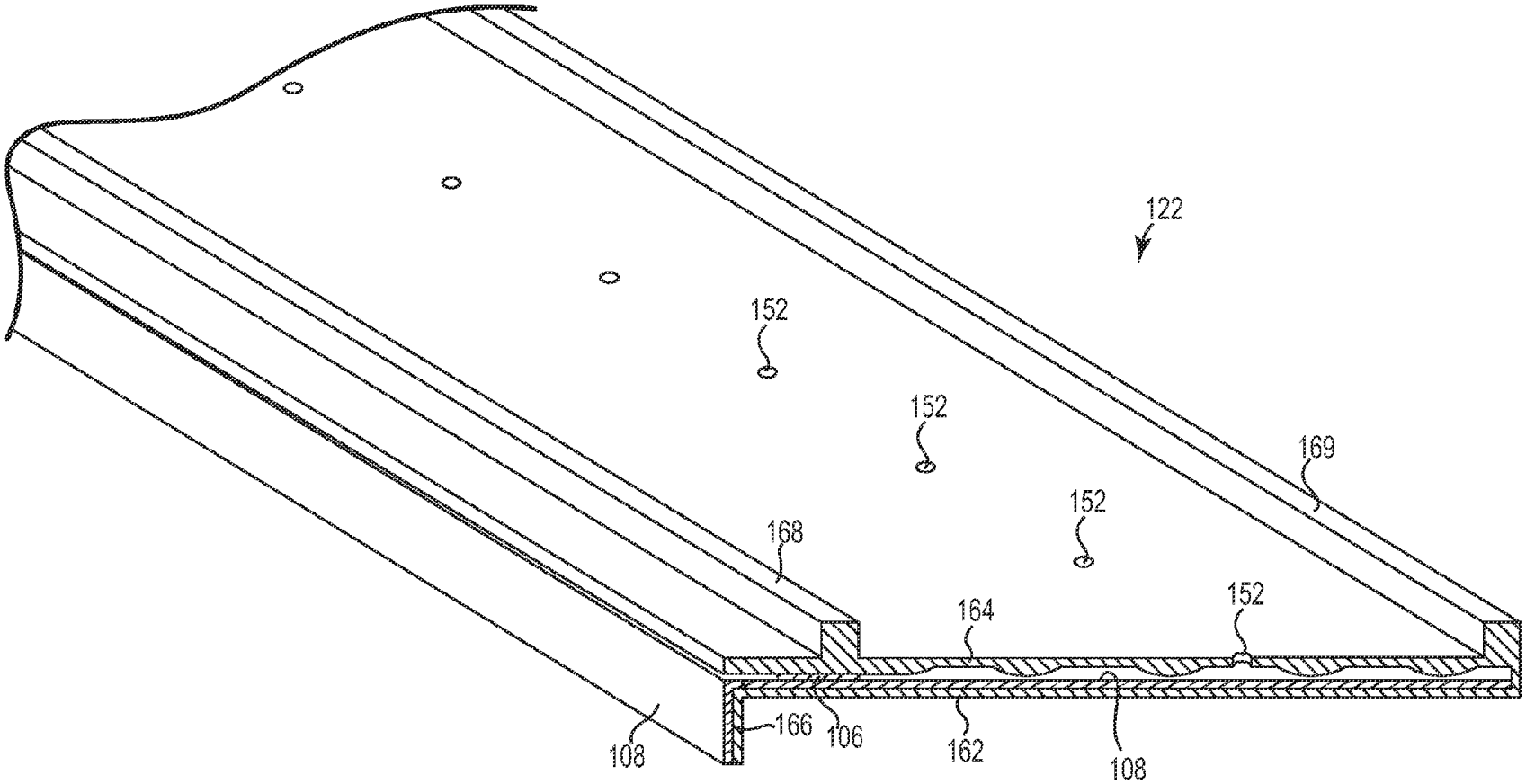
FIG. 3 is a perspective view of the window drain illustrated in FIG. 2 according to one embodiment.
Figure 4:
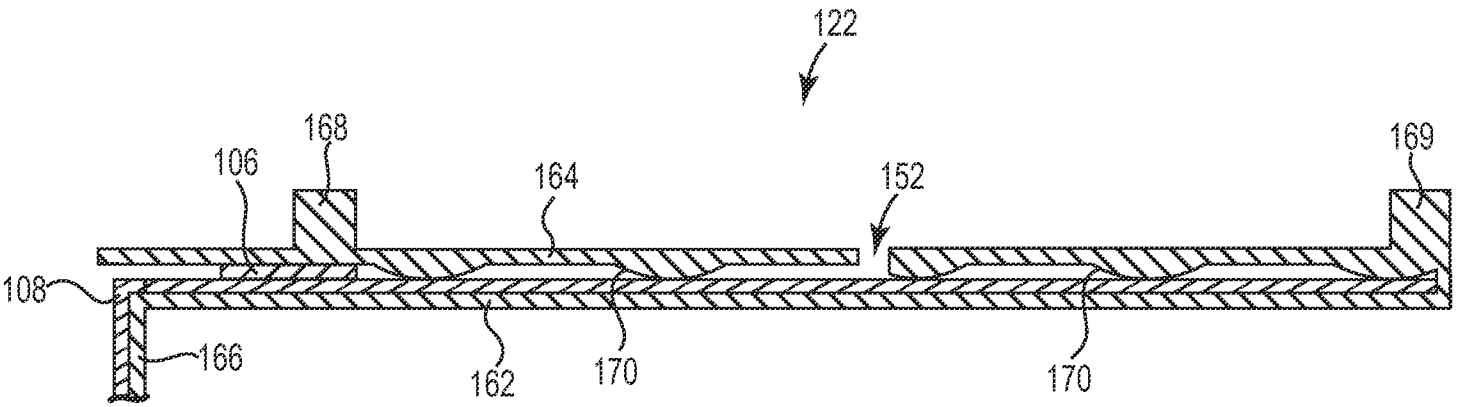
FIG. 4 is a schematic cross-sectional view of the moisture drain illustrated in FIG. 2 according to one embodiment.

FIG. 3 is a perspective view and FIG. 4 is a cross-sectional view of drain 122 according to one embodiment. Drain 122 includes a bottom plate 162 spaced apart form a top plate 164 with flexible sheet 108 disposed between plates 162, 164. In one embodiment, bottom plate 162 includes an angled flange 166 and flexible sheet 108 is attached to bottom plate 162 and a portion of angled flange 166. In this manner, moisture that is wicked along flexible sheet 108 is directed out of drain 122 and downward along angled flange 166.

In one embodiment, top plate 164 includes drain holes 152 and a first footing 168 spaced from a second footing 169. Holes 152 are formed in top plate 164 to enable water captured by the drain 122 to seep into flexible sheet 108 for transport out of drain 122. In one embodiment, a row of holes 152 is provided in top plate 164. In other embodiments, an array of holes or an open grid or screen-like pattern of holes 152 is formed in top plate 164 to enable water collected by drain 122 to flow down to flexible sheet 108. Footings 168, 169 extend from an exterior surface of top plate 164 and are configured to support a bottom jamb of window 134 or EPC 134 (FIG. 2).

In one embodiment, drain 122 is extruded or molded as a single integral piece into which flexible sheet 108 and seal 106 are subsequently inserted. In one embodiment, bottom plate 162 and top plate 164 are extruded from plastic material such as polyethylene or polyvinyl chloride (PVC). Some window openings are formed to a standard size such as 36 inches wide or 48 inches wide or other standard width. In one embodiment, drain 122 is prefabricated in a molded form to fit in a standard width window and includes molded and sealed end caps formed on opposing lateral ends of drain 122.

For example, for a standard width window opening of 36 inches, one embodiment of drain 122 includes integrally formed top and bottom plates 162, 164 extending about 36 inches between sealed end caps. In other embodiments, drain 122 is provided as an integral length of material several feet in length (on a roll, for example) and a desired length of drain 122 is selectively cut by a building contractor depending upon the window size/application.

Seal 106 is disposed between flexible sheet 108 and top plate 164 to prevent or limit ingress of bulk water into drain 122. With additional reference to FIG. 2, drain 122 provides a double seal between top plate 164 and wicking sheet 108 including seal 106 disposed between sheet 108 and top plate 164 and bulk water seal 149 disposed between drain 122 and siding 148. This double seal provides a hydrodynamic seal to prevent wind-driven rain from entering under a window placed into opening 102. In addition, seal 106 enables liquid to be transported under/through seal 106 from drain 122 to the exterior of cladding 148. Thus, drain 122 is configured to drain moisture to the exterior of wall assembly 102 while preventing ingress of wind-driven rain or other bulk water.

In one embodiment, an inside surface of top plate 164 includes pressure distribution bumps 170 that are configured to distribute the load applied to drain 122 by EPC 134 (FIG. 2). Bumps 170 are distributed along a bottom surface of top plate 164 in a pattern or array that enables liquid flow within sheet 108 along the full length and width of flexible sheet 108.

Embodiments of drain 122 enable and provide for the drainage of water from beneath the window jamb to the exterior of the cladding 148. In contrast, the known assemblies drain water from beneath the window jamb to a location between a permeable exterior sheath (house wrap) and the exterior cladding, which has the potential to rot the cladding or give rise to the growth of mold. Thus, the embodiments of drain 122 provide a significant and measurable advantage in moisture removal from sealed exterior wall assemblies over the art.

Figure 5:
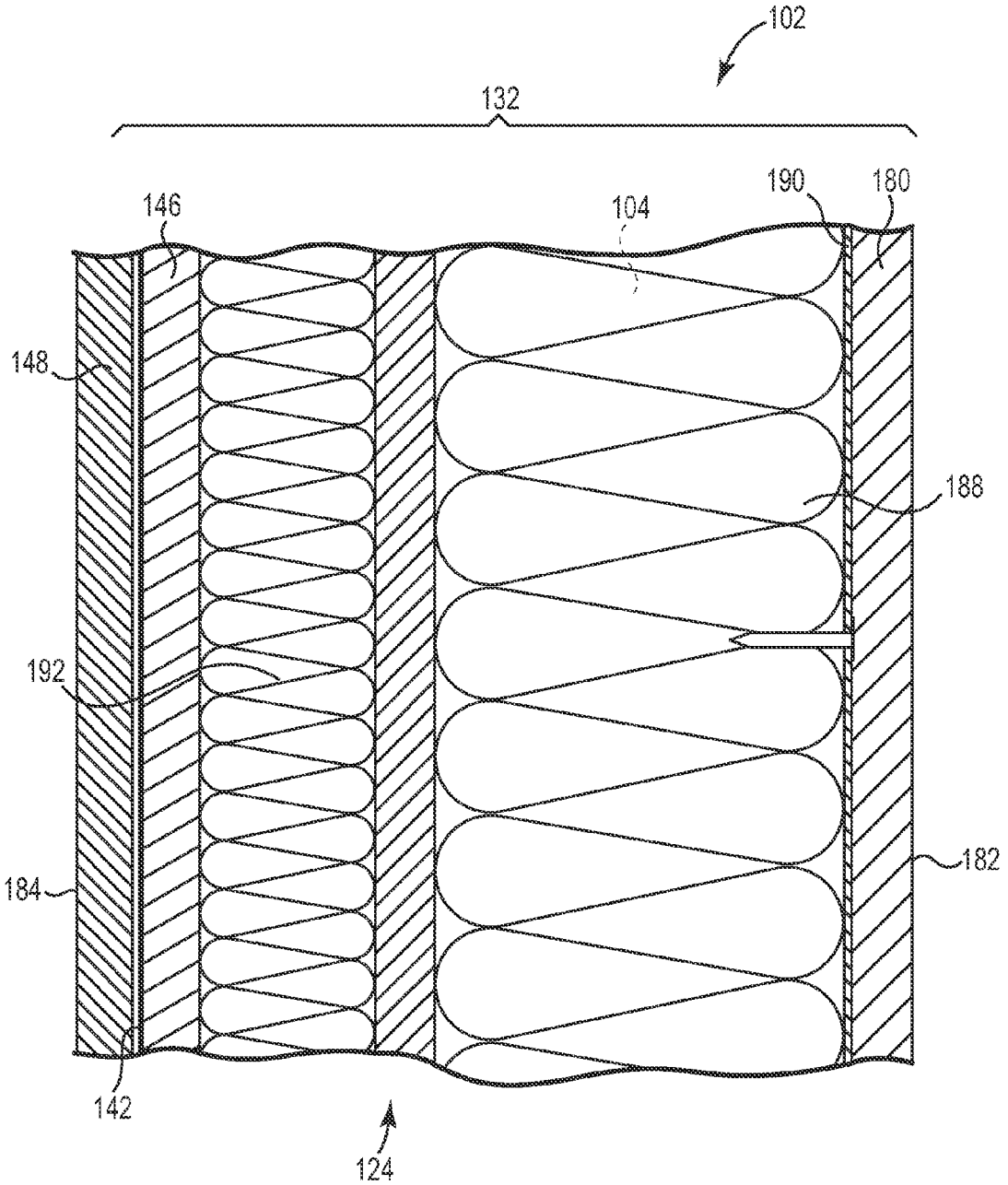
FIG. 5 is a schematic cross-sectional view of an insulated section of the wall assembly illustrated in FIG. 1 including a moisture transport spacer according to one embodiment.

FIG. 5 is a schematic cross-sectional view of insulated section 132 of wall assembly 102 according to one embodiment. In general, wall frame 104 supports an interior wall layer 180 defining an interior side 182 and siding 148 that defines an exterior side 184 opposite interior side 182. In one embodiment, wall frame 104 is fabricated from 2×4 studs having a first insulation 188 disposed between adjacent studs with a first membrane 190 attached to an interior side of frame 104 between interior wall layer 180 and frame 104. In one embodiment, MTS 124 is attached along an exterior side of frame 104 and wall assembly 102 includes a second insulation 192 disposed between MTS 124 and oriented-strand board 146 or other suitable sheathing to which siding 148 is attached. FIG. 5 illustrates one embodiment of insulated section 132, but it is to be understood that additional house wrap layers or other membranes can be suitably fastened between siding 148 and oriented-strand board 146 depending upon the construction application.

In one embodiment, interior wall layer 180 is a gypsum sheet configured to be nailed or screwed into wall frame 104. Siding 148 is typically a weather resistant board and includes any suitable form of exterior building siding including aluminum siding, vinyl siding, wood siding, stucco or the like. In one embodiment, an exterior vapor permeable barrier 142 is disposed between oriented-strand board 146 and siding 148, where the exterior vapor permeable barrier 142 allows moisture vapor on the exterior side of MTS 124 to dry to the exterior side of wall assembly 102.

In one embodiment, first insulation 188 is R-13 fiberglass insulation, although other suitable forms of insulation are also acceptable. In one embodiment, first membrane 190 is a vapor permeable polyamide membrane such as a 2 mil thick PA-6 membrane having humidity-dependent permeability or other suitable home construction membranes with similar vapor permeable characteristics. First membrane 190 is configured to allow moisture vapor on the interior side of MTS 124 to dry to the interior side of wall assembly 102. In one embodiment, second insulation 192 is an extruded polystyrene insulation having a thickness of about 1.5 inches. In one embodiment, oriented-strand board 146 is 0.5 inches thick as typically employed in the building construction industry.

In one embodiment, exterior vapor permeable barrier 142 is attached to an exterior of sheathing 146, first membrane 190 is a vapor permeable warm side vapor retarder attached to interior wall layer 180, and MTS 124 is disposed between vapor permeable barrier 142 and vapor permeable warm side vapor retarder 190.

In one embodiment, insulated section 132 is tightly constructed to prevent drafts or heat loss through wall assembly 102. Temperature gradients across insulated section 132 have the potential to create moisture condensation on one or more layers of wall assembly 102. In one embodiment, MTS 124 includes a film that forms a substantial barrier to the passage of air and moisture vapor through MTS 124. This film barrier to the passage of moisture also provides a surface onto which moisture condensate will naturally form. In one embodiment, MTS 124 includes one or more surfaces configured to transport the moisture condensate by capillary action vertically along (e.g., downward) wall frame 104 for eventual exit from wall frame assembly 102.

In contrast to conventional wall assemblies, wall assembly 102 includes a film within MTS 124 that is a barrier against both the passage of air and the passage of moisture vapor carried in the air, and thus provides a barrier for wall assembly 102. MTS 124 provides a surface that traps and collects moisture within wall assembly 102 and a wicking mechanism that directs the moisture away from wall frame 104 and out of wall assembly 102, which is contrary to the conventional approach to fabricating wall assemblies.

It has been discovered that the R-value of insulation 192 and the ratio of the R-values between the insulation 188 and insulation 192 relates to the successful operation of system 102. The principle is to place MTS 124 where the sensible temperature on the interior surface of MTS 124 is less than the dew point temperature in the heating season so that condensation will form on the interior surface of MTS 124 where it is eventually removed from wall assembly 102 by sheet 118. Conversely, during the cooling season, the sensible temperature on the exterior surface of MTS 124 is less than the dew point temperature allowing exterior sourced vapor to condense on the exterior surface of MTS 124, where it is likewise removed from wall assembly 102 by sheet 118.

In one embodiment, the ratio of interior insulation R-value to exterior insulation R-value is 1.73 and is so selected to permit the favorable dew points in the heating and cooling seasons to occur on the interior and exterior surfaces of MTS 124, respectively.

In one embodiment, MTS 124 is positioned within the insulation such that the temperature on the interior condensing surface is less than the dew point temperature in the heating season, and the temperature on the exterior condensing surface is less than the dew point temperature in the cooling season.

Embodiments of MTS 124 and other embodiments of moisture transport spacers described herein are compatible with any internal sheathing, any external sheathing, and any external cladding suited for use in insulated external wall assemblies.

Figure 6:
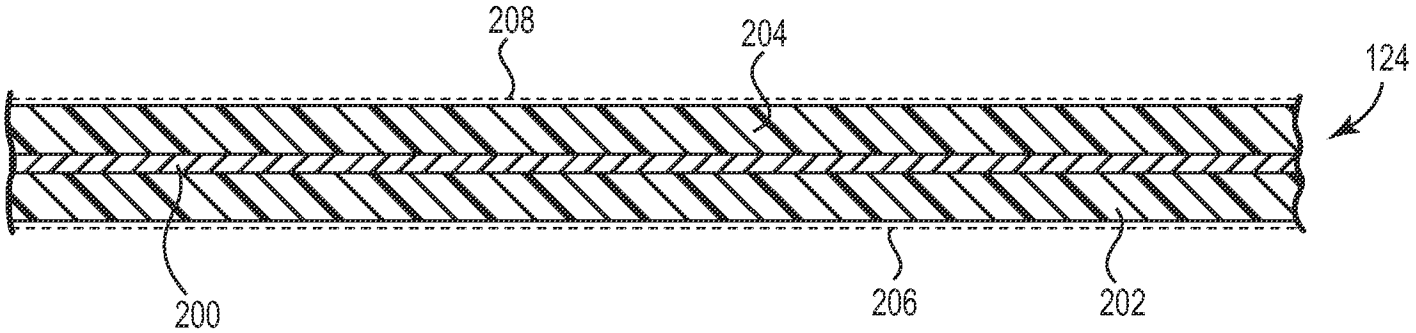
FIG. 6 is a schematic cross-sectional view of the moisture transport spacer illustrated in FIG. 5 according to one embodiment.

FIG. 6 is a schematic cross-sectional view of MTS 124 according to one embodiment. In one embodiment, MTS 124 includes a film 200, a first moisture wicking layer 202 (MWL 202) disposed on a first side of film 200 and a second moisture wicking layer 204 (MWL 204) disposed on an opposing second side of film 200.

In one embodiment, MTS 124 includes mold preventing additives and/or a suitable flame retarding additive. In one embodiment, MTS 124 is fabricated from recyclable material(s).

In one embodiment, film 200 forms a substantial barrier to the passage of air and moisture vapor through MTS 124 and is a polymer film having a caliper of 0.010 inches (e.g., 10 mil film). Suitable polymer films include polyolefin, polyethylene, or polypropylene, as examples. In one exemplary embodiment, film 200 is a 10 mil polyethylene membrane configured to form a substantial barrier to the passage of air and moisture vapor through MTS 124. In one embodiment, film 200 is a substantially flat uniform-caliper film, although structured films as described below are also acceptable.

MWL 202 and 24 are configured to wick moisture away from film 200. In one embodiment, MWL 202 and 24 are configured to wick moisture away from film 200 by capillary action and are formed of a hydrophilic fiber mat. In one embodiment, the hydrophilic fiber mat is a woven fiber mat of rayon fibers. In one embodiment, the hydrophilic fiber mat is a non-woven fiber mat formed of a random array of mutually-bonded rayon staple fibers. In other embodiments, the hydrophilic fiber web is formed on non-woven fiber forming equipment to have a preferential machine direction that configures the flow of moisture along MWL 202, 204 to be uni-directional (for example, the moisture flows longitudinally along MWL 202, 204 which is vertical relative to wall assembly 202 as illustrated in FIG. 1).

MTS 124 optionally includes a first mesh 206 attached to MWL 202 and a second mesh 208 attached to MWL 204. Meshes 206, 208 are configured to maintain a useful level of bending stiffness that assists in handling MTS 124 when placing it against wall frame 104 (FIG. 5) during construction of wall assembly 102. In one embodiment, meshes 206, 208 are configured to prevent loose fiber insulation material such as fiberglass batts from clogging the drainage cavities.

In one embodiment, MTS 124 is approximately 0.5 inches thick, including the 10 mil polymer film 200 and about ¼ inch thick sections for each of MWL 202 and MWL 204. Suitable meshes 206, 208 include nettings or other open materials that assist in keeping MWL 202, 204 in place for handling when attaching MTS 124 to wall frame 104.

Figure 7:
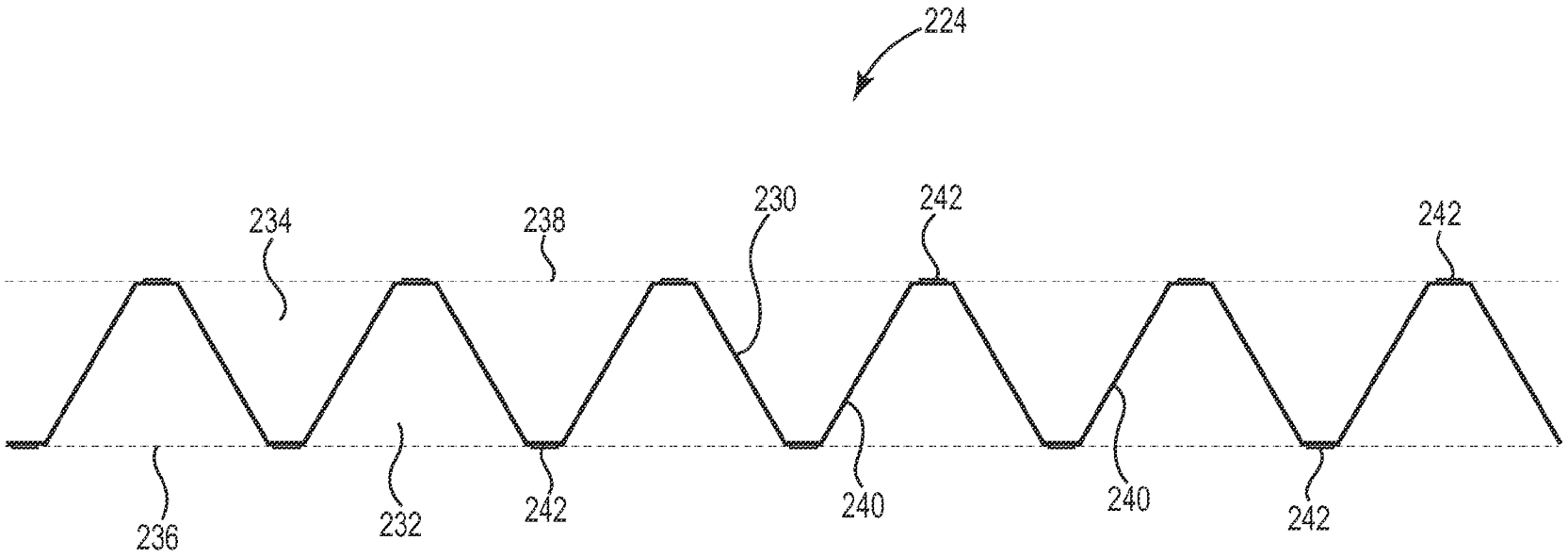
FIG. 7 is a schematic cross-sectional view of another embodiment of the moisture transport spacer illustrated in FIG. 5.
Figure 8B:
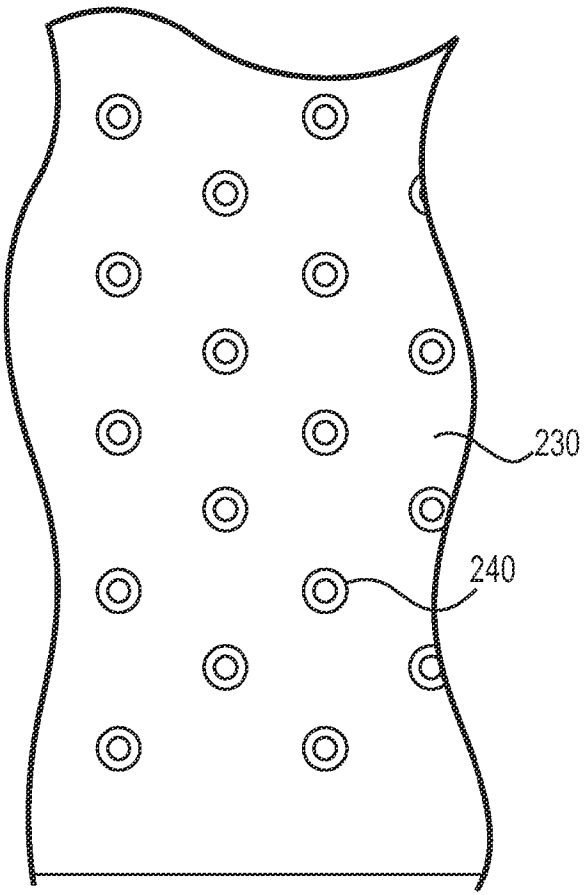
FIGS. 8A-8B are top views of two embodiments the moisture transport spacer illustrated in FIG. 7.
Figure 8A:
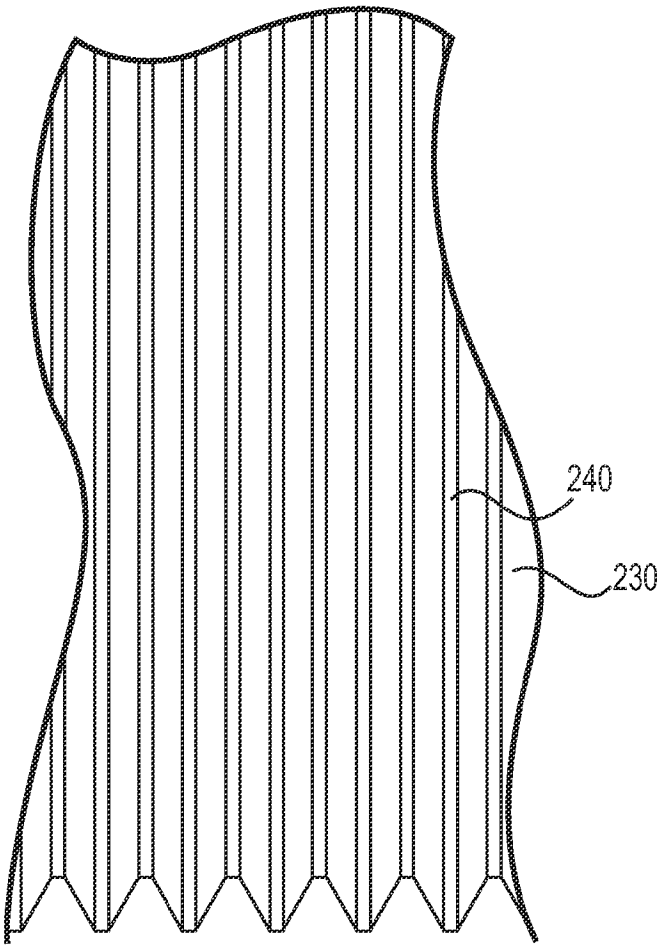

FIG. 7 is a schematic cross-sectional view of another embodiment of a moisture transport spacer 224 (MTS 224). In one embodiment, MTS 224 includes a structured film 230, a first moisture wicking layer 232 (MWL 232) disposed on a first side of film 230, and a second moisture wicking layer 234 (MWL 234) disposed on an opposing side of film 230. In one embodiment, structured film 230 includes a plurality of discrete troughs 240 as illustrated in FIG. 8A. In one embodiment, structured film 230 includes a plurality of discrete cones 240 as illustrated in FIG. 8B. MWL 232, 234 are packed in the troughs 240 or around the array of cones 240 and held in place by opposing meshes 236, 238 that are bonded to peaks 242 of the structure. In one embodiment, MWL 232, 234 are attached to film 230, for example by pneumatically spraying MWL 232, 234 and an adhesive component onto film 230.

FIG. 8A is a top view of troughs 240 formed in film 230 and FIG. 8B is a top view of discrete cones 240 formed in film 230 according to various embodiments. In one embodiment, film 230 is provided as a corrugated sheet of a polymer configured to form a substantial barrier to the passage of air and moisture vapor. One suitable polymer includes polyvinyl chloride, although other film materials are also acceptable.

In one embodiment, troughs 240 are provided as continuous longitudinal troughs extending along film 230 and are configured to capture and transport moisture down the troughs 240. In one embodiment, troughs 240 are at least partially filled with MWL 232, 234 that combine with troughs 240 to assist in transporting moisture along film 230.

In one embodiment, film 230 includes an array of cones 240 formed laterally across film 230 as illustrated in FIG. 8B. Cones 240 provide increased surface area for film 230, which provides a greater area for the formation of condensation as humid air comes into contact with film 230. Peaks 242 of cones provide a depth for film 230, which forms a spacing between wall frame 104 and second insulation 192 (FIG. 5) when MTS 224 is installed in wall assembly 102.

MWL 232, 234 are similar to MWL 202, 204 as described in FIG. 6 and include a mat of water-wettable or hydrophilic fibers configured to wick moisture along MTS 224, whether along troughs 240 or between the array of cones 240.

Figure 9:
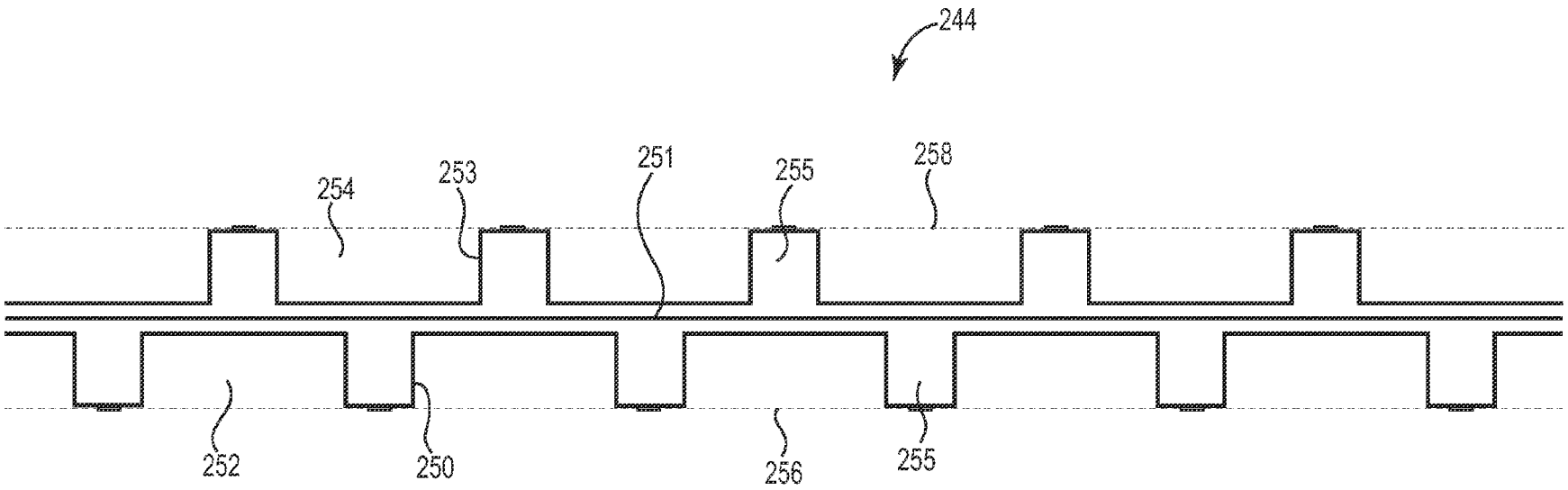
FIG. 9 is a schematic cross-sectional view of another embodiment of the moisture transport spacer illustrated in FIG. 5.

FIG. 9 is a schematic cross-sectional view of another embodiment of a moisture transport spacer 244 (MTS 244). In one embodiment, MTS 244 includes a first uni-directional dimpled sheet 250 attached to a center film 251 and a second uni-directional dimpled sheet 253 attached to an opposing side of center film 251. Uni-directional dimpled sheets 250, 253 each provide dimples 255 oriented to project away from center film 251. A first moisture wicking layer 252 (MWL 252) is disposed between adjacent dimples 255 along dimpled film 250, and a second moisture wicking layer 254 (MWL 254) is disposed between adjacent dimples along dimpled film 253.

In one embodiment, the three-part laminate formed by dimpled films 250, 253 attached to center film 251 is configured to form a substantial barrier to the through-passage of air and moisture vapor, and MWL 252, 254 are configured to transport/remove moisture captured by the three-part laminate.

In one embodiment, dimpled films 250, 253 include an ordered array of dimples 255 disposed along films 250, 253. In one embodiment, dimpled films 250, 253 include a staggered array of dimples 255 disposed along films 250, 253.

MWL 252, 254 are similar to MWL 202, 204 as described in FIG. 6 and include a mat of water-wettable or hydrophilic fibers configured to wick moisture along MTS 244. In one embodiment, MWL 252, 254 are configured to wick moisture along MTS 244 by capillary action.

In one embodiment, a first open mesh 256 is attached to dimples 255 along film 250 and a second mesh 258 is attached to dimples 255 along film 253. Meshes 256, 258 are similar to meshes 206, 208 described above and are configured to assist in handling MTS 244.

Figure 10:
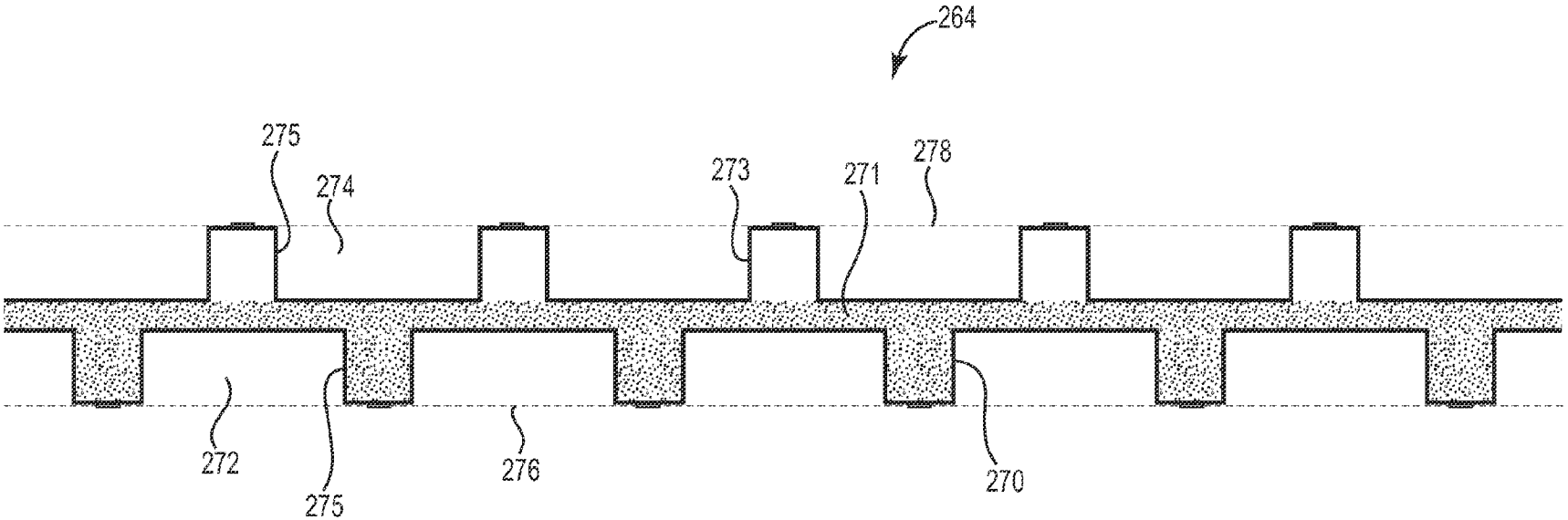
FIG. 10 is a schematic cross-sectional view of another embodiment of the moisture transport spacer illustrated in FIG. 5.

FIG. 10 is a schematic cross-sectional view of another embodiment of a moisture transport spacer 264 (MTS 264). In one embodiment, MTS 264 includes a two-part laminate of uni-directional sheets including a first uni-directional dimpled film 270 attached to a second uni-directional dimpled film 273 by an adhesive 271. In one embodiment, adhesive 271 fills the pockets or cavities that are formed on a back side of dimples 275 in dimpled film 270, and second uni-directional dimpled film 273 is attached to adhesive 271. In a manner similar to MTS 244 (FIG. 9), a first moisture wicking layer 272 (MWL 272) is disposed between adjacent dimples 275 along first film 270, and a second moisture wicking layer 274 (MWL 274) is disposed between adjacent dimples 275 of second film 273. Opposing open meshes 276, 278 are bonded to the peaks of dimples 275 to retain MWL 272, 274 within dimples 275 and facilitate handling of MTS 264. Films 270, 273 are configured to provide a substantial barrier to the passage of water and moisture vapor through MTS 264, and MWL 272, 274 are configured to transport moisture and/or condensate away from films 270, 273. In one embodiment, the two part assembly of MTS 264 provides a continuous bulk water seal along its edges that is configured to prevent bulk water movement.

Figure 11:
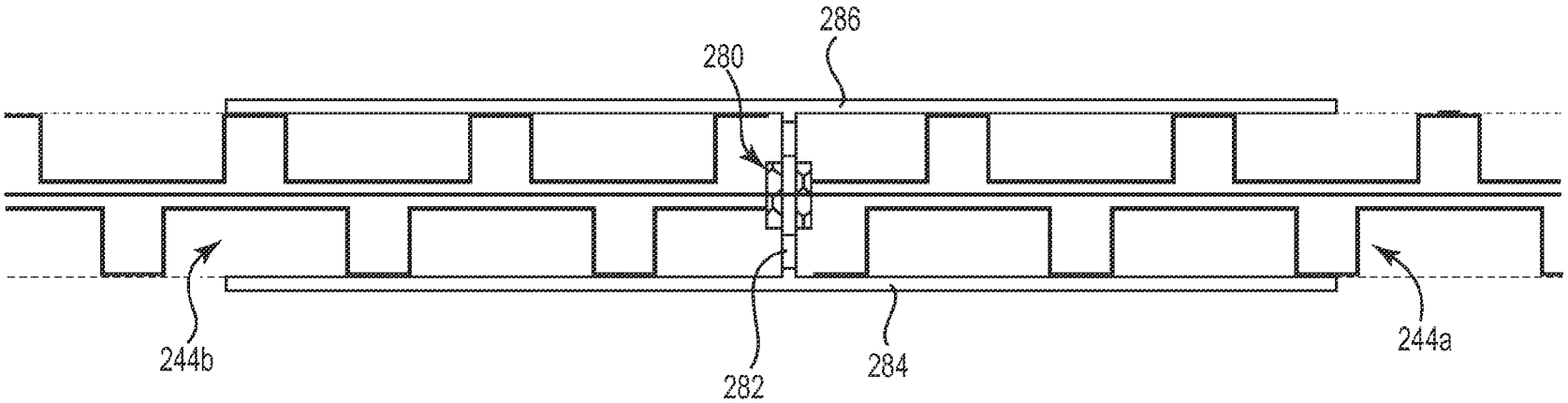
FIG. 11 is a schematic cross-sectional view of two sections of the moisture transport spacer illustrated in FIG. 10 bonded together according to one embodiment.

FIG. 11 is a schematic cross-sectional view of a bond 280 formed between a first segment 244*a* of MTS 244 and a second segment 244*b* of MTS 244. With additional reference to FIG. 5, the moisture transport spacers/sheets described herein are desirably provided in sections that are sized for convenient handling, for example having a width of between about 2-6 feet. During construction of a wall, the moisture transport sheet is attached to frame 104 in segments until the area of frame 104 is covered to ensure that the entire height of insulated section 132 is covered by a portion of the moisture transport sheet. With this in mind, it is desirable to provide a mechanism for attaching first segment 244*a* of MTS 244 to second segment 244*b* of MTS 244 in a manner that maintains the barrier function of the moisture transport sheet.

In one embodiment, first section 244*a* of MTS 244 is sealed to the second section 244*b* of MTS 244 along a common edge 282 by bond 280. In one embodiment, bond 280 is suitably formed by a foam seal mat extending along common edge 282 or by an adhesive caulk deposited along common edge 282. In one embodiment, additional sealing support is provided across the union formed along common edge 282 by a first tape 284 attached and extending on either side of bond 280 and a second opposing tape 286 attached and extending on either side of bond 280.

Similar bonding methodologies are applied to achieve a bond for one or more of MTS 124, 224, or 264 as described above. Bond 280 is acceptably formed prior to inserting MTS 244 into wall assembly 102 (FIG. 5). However, bond 280 is also compatible with attaching a first segment of the moisture transport sheet to a second segment of the moisture transport sheet after the moisture transport sheet is attached to frame 104.

Figure 12A:
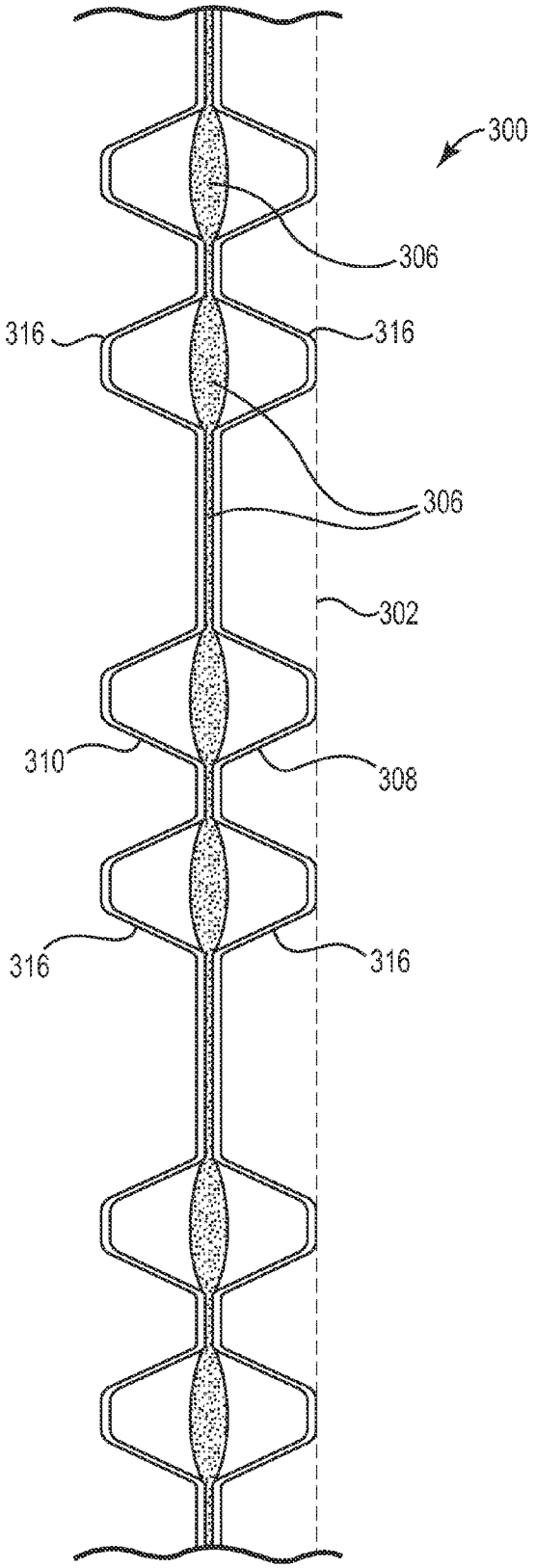
FIG. 12A is a schematic cross-sectional view of another embodiment of the moisture transport spacer illustrated in FIG. 5.

FIG. 12A is a schematic cross-sectional view of another embodiment of a moisture transport spacer 300 (MTS 300). In one embodiment, MTS 300 includes an adhesive 306 bonding a first dimpled sheet 308 to a second opposing dimpled sheet 310, and a scrim 302 attached to one of the dimpled sheets 308, 310. Adhesive 306 attaches first dimpled sheet 308 to second dimpled sheet 310, and scrim 302 is provided to prevent fiberglass-based insulation from impeding moisture flow along the dimpled sheets 308, 310 that it is attached to. Dimpled sheets 308, 310 provide an air and moisture barrier that prevents moisture from passing through MTS 300. In one embodiment, adhesive 306 forms a continuous surface at the edges of MTS 300, which minimizes the possibility that bulk water will bypass a junction formed where a flat portion of one sheet is juxtaposed to a cone portion of a second sheet.

In one embodiment, sheets 308, 310 are polymer films that are attached in a back-to-back arrangement such that opposing dimples 316 are oriented to project outward. In one embodiment, MTS 300 is provided as a flexible profiled sheet having an array of protrusions (e.g., dimples 316) formed to project away from at least one major surface of the sheet. The dimples 316 are provided as a profiled pattern of round protrusions projecting about ¼ inch outward to define a dimpled drainage plane, where the protrusions are formed in an ordered array on each exterior surface of films 308, 310. In one embodiment, scrim 302 is a nylon mesh that is attached to dimples 316 on one of the dimpled films 308, 310.

When MTS 300 is assembled into wall assembly 102 (FIG. 5), scrim 302 is oriented to face toward fiberglass insulation 188 and the drainage planes provided by dimpled sheets 308, 310 are configured to enable moisture accumulated on the surface of each of the sheets 308, 310 to cascade down between the dimples 316 under the force of gravity.

Figure 12B:
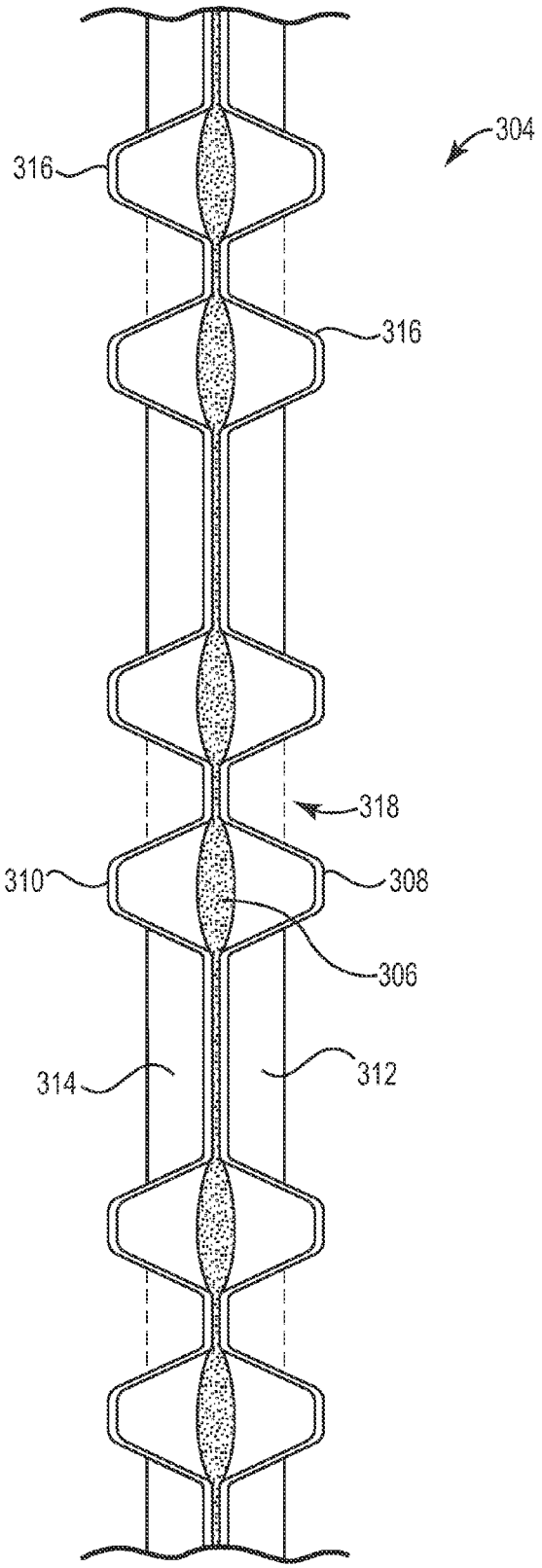
FIG. 12B is a schematic cross-sectional view of another embodiment of the moisture transport spacer illustrated in FIG. 5.

FIG. 12B is a schematic cross-sectional view of another embodiment of a moisture transport spacer 304 (MTS 304) including a fiber-based wicking layer. In one embodiment, MTS 304 includes adhesive 306 bonding first dimpled film 308 to second opposing dimpled film 310, with a first wicking layer 312 attached to first film 308 and a second wicking layer 314 attached to second film 310. In one embodiment, adhesive 306 and films 308, 310 combine to configure MTS 304 as an air and moisture vapor barrier, and wicking layers 312, 314 are provided to transport moisture that condenses on or is collected by films 308, 310. In one embodiment, a section 318 of MTS 304 has a portion of wicking layers 312, 314 removed to provide a demarcation or zone that facilitates splicing and bonding segments of MTS 304.

In one embodiment, adhesive 306 is provided as a soft, repositionable adhesive configured to removably attach first dimpled film 308 to second dimpled film 310. Adhesive 306 is suitable applied to interior surfaces of films 308, 310. In one embodiment, adhesive 306 is provided as a sheet of adhesive pressed between films 308, 310.

In one embodiment, films 308, 310 are formed from a polymer to have a caliper between about 4-14 mils thick and are structured to provide opposing dimples 316 that are formed in an ordered array on each exterior surface of films 308, 310. In one embodiment, dimples 316 are disposed in a staggered array across surfaces of films 308, 310, although aligned linear arrays of dimples 316 are also acceptable.

Wicking layers 312, 314 are similar to wicking layers 202, 204 (FIG. 6) described above. Generally, wicking layers 312, 314 are fabricated to provide capillary wicking of moisture along films 308, 310. One suitable material for forming wicking layers 312, 314 includes a non-woven sheet of rayon staple fiber formed to have a basis weight of 2.8 ounces with a 0.4 mm thickness.

Figure 13:
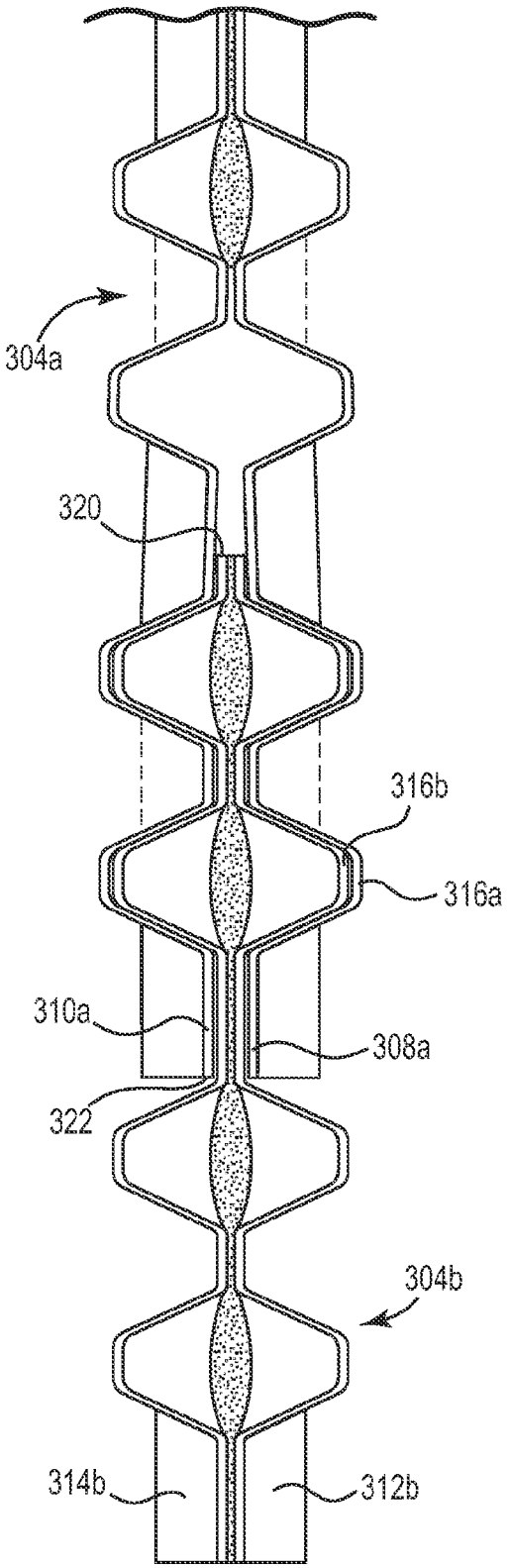
FIG. 13 is a schematic cross-sectional view of two segments of the moisture transport spacer illustrated in FIG. 12B bonded together according to one embodiment.

FIG. 13 is a schematic cross-sectional view of a first section 304*a* of MTS 304 spliced over and bonded to a second section 304*b* of MTS 304. In one embodiment, a leading edge 320 of second section 304*b* has been spliced along splicing section 318 (FIG. 12B) and a portion of wicking layers 312*b*, 314*b* has been removed from second section 304*b*. A leading end 322 of first section 304*a* is plied apart such that first film 308*a* is separated from second film 310*a*. Separated films 308*a*, 310*a* are deposited over exterior surfaces of second section 304*b* to mate dimples 316 on each section 304*a*, 304*b* together. In this manner, a sealed joint between first section 304*a* and second section 304*b* of MTS 304 is formed that maintains the barrier properties of MTS 304.

The above-described mating of sections 304*a*, 304*b* does not require hand tools (apart from a scissors) and results in a durable seal between the sections 304*a*, 304*b* without the use of additional layers of tapes/adhesives. In addition, the resulting thickness of the combined two segments 304*a*, 304*b* is similar to the original thickness of MTS 304.

Figure 14:
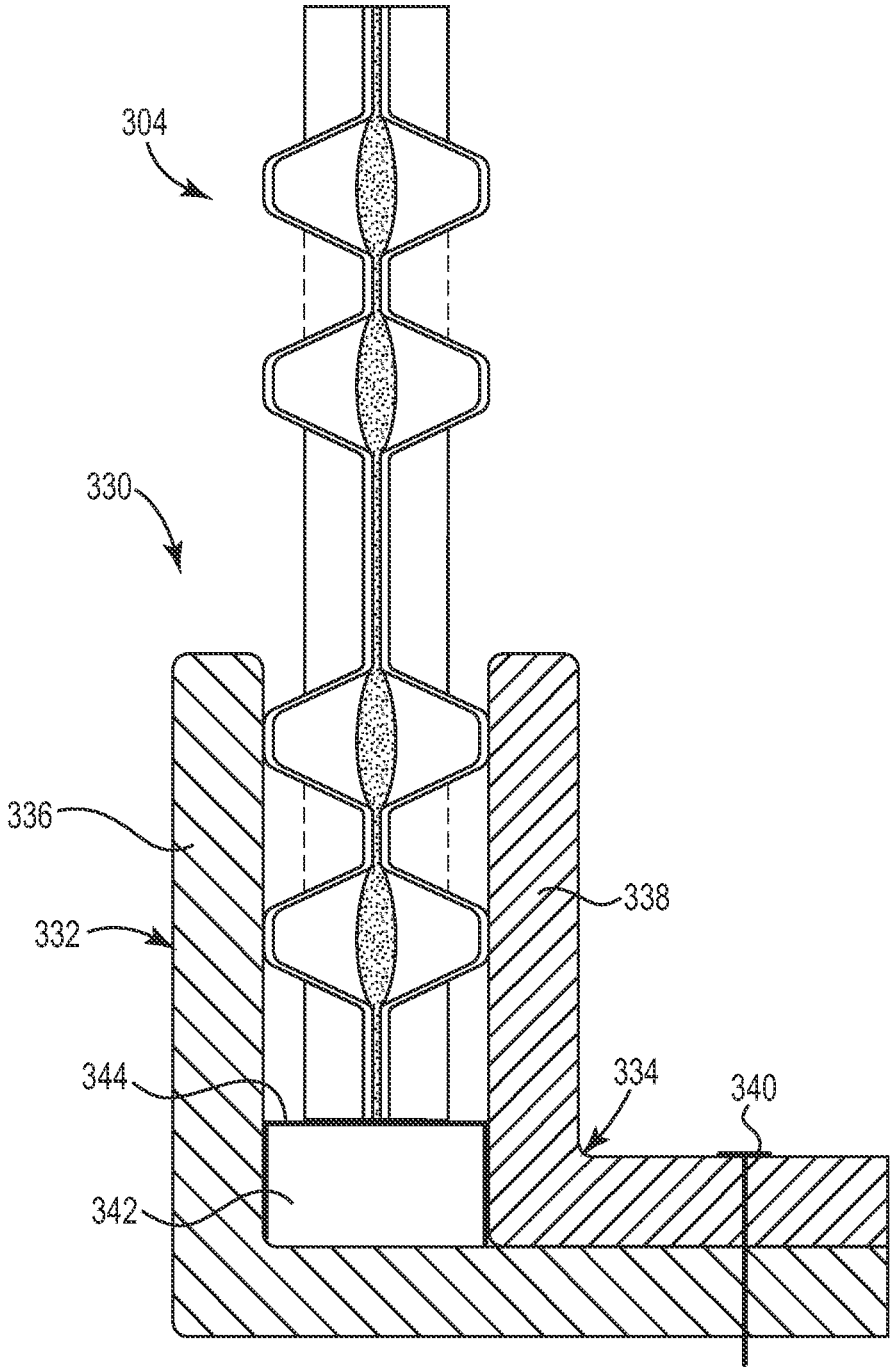
FIG. 14 is a schematic cross-sectional view of the moisture transport spacer illustrated in FIG. 12B retained in a rough opening edge seal according to one embodiment.

FIG. 14 is a schematic cross-sectional view of an edge seal 330 configured to retain ends of MTS 304 according to one embodiment. MTS 304 is attached to wall frame 104 (FIG. 5) from a location adjacent to a top edge of the wall down to a location adjacent to a bottom edge of the wall. It is desirable to provide the contractor with an easy-to-use mechanism that will retain and seal the ends/edges of MTS 304 (and the other moisture transport sheets described herein) as wall assembly 102 is erected. Since wall frame sizes can vary in width and height, in one embodiment edge seal 330 is provided as a rough opening edge seal 330 that is selectively cut to fit the size of the wall frame being erected.

In one embodiment, edge seal 330 includes a first angled flange 332 and a second angled flange 334 that is adjustable relative to and attachable to first angled flange 332. Edge seal 330 is configured for use along the edges of wall frame 104 (FIG. 5). During assembly, first angled flange 332 is placed against wall frame 104 and MTS 304 is pressed against an upright 336 of angled flange 332. Second angled flange 334 slid over first angled flange 332 until upright 338 sandwiches MTS 304 against upright 336. MTS 304 is thus retained in place between uprights 336, 338 and a fastener 340 is subsequently secured to hold first and second angled flanges 332, 334 in the desired orientation.

In one embodiment, angled flange 332 has a height of about 1.5 inches with a thickness of about 3/16 inches, and angled flange 334 has a height of about 1.25 inches with a thickness of about 3/16 inches. In one embodiment, angled flanges 332, 334 are formed from plastic. Suitable plastics for forming edge seal 330 include polyolefins, nylon, polyester, polyvinyl chloride or other plastics.

One advantage of rough opening edge seal 330 is that second angled flange 334 can be selectively pressed against MTS 304 to provide a desired amount of pressure sandwiching 304 between angled flanges 332, 334. In one embodiment, it is desirable to seal MTS 304 within wall assembly 102 (FIG. 5), and a seal strip 342 is provided that is attached between flanges 336, 338 to provide a moisture seal around the edges of MTS 304. In one embodiment, seal strip 342 is formed of a foam rubber having a thickness of about 0.25 inches and including an adhesive barrier seal 344 on an exterior surface. In one embodiment, one or more exterior surfaces of seal strip 342 include an exposed adhesive surface that attaches seal strip 342 to rough opening edge seal 330.

Figure 15:
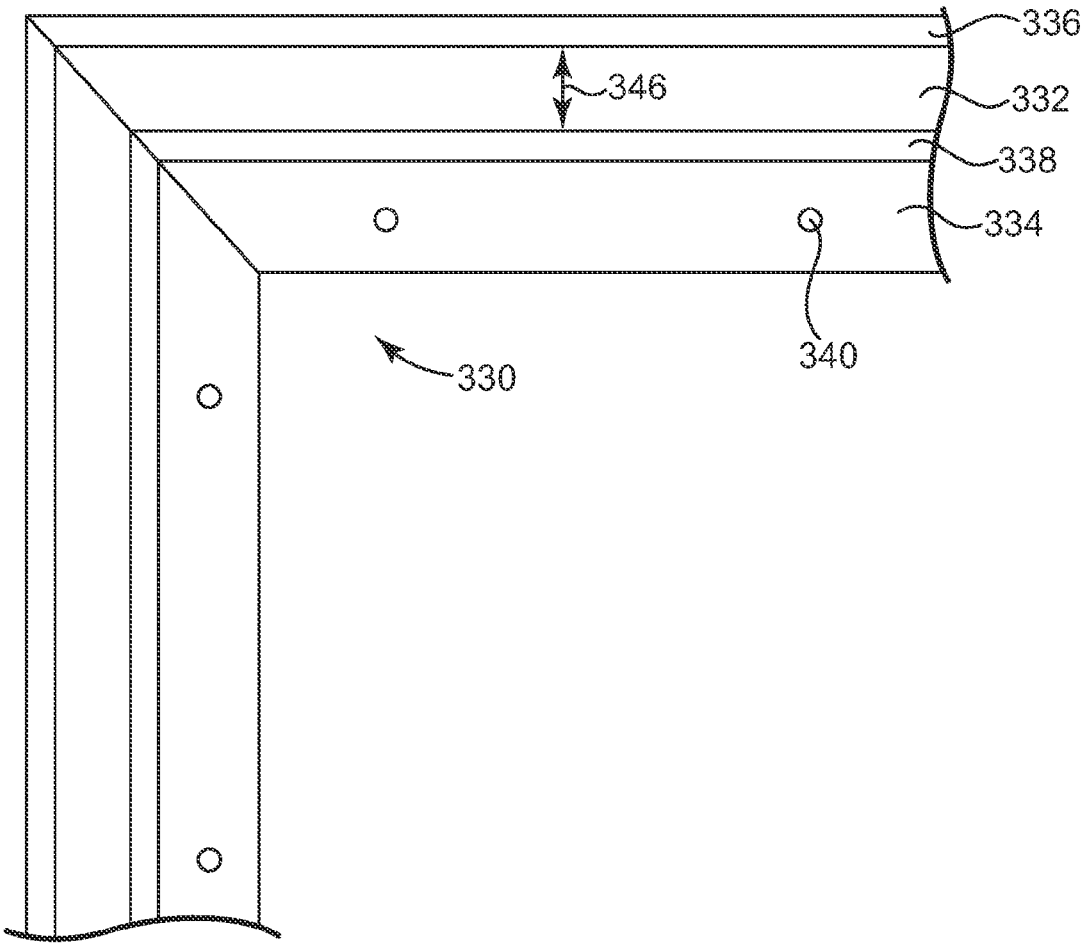
FIG. 15 is a top view of the rough opening edge seal illustrated in FIG. 14 according to one embodiment.

FIG. 15 is a top view of edge seal 330 according to one embodiment. Edge seal 330 includes linear segments suited for placement along lateral edges of wall assemblies and corner segments suited for placement along corners of abutted wall frames. FIG. 15 illustrates a corner segment for a rough opening inside edge seal 330 including second angled flange 334 placed on top of first angled flange 332 such that uprights 336, 338 are spaced apart to provide an opening 346 to receive MTS 304 (FIG. 14). The width of opening 346 between uprights 336, 338 is varied by selectively positioning second angled flange 334 a desired distance from first angled flange 332 before fixing it in place with fastener 340.

Figure 16:
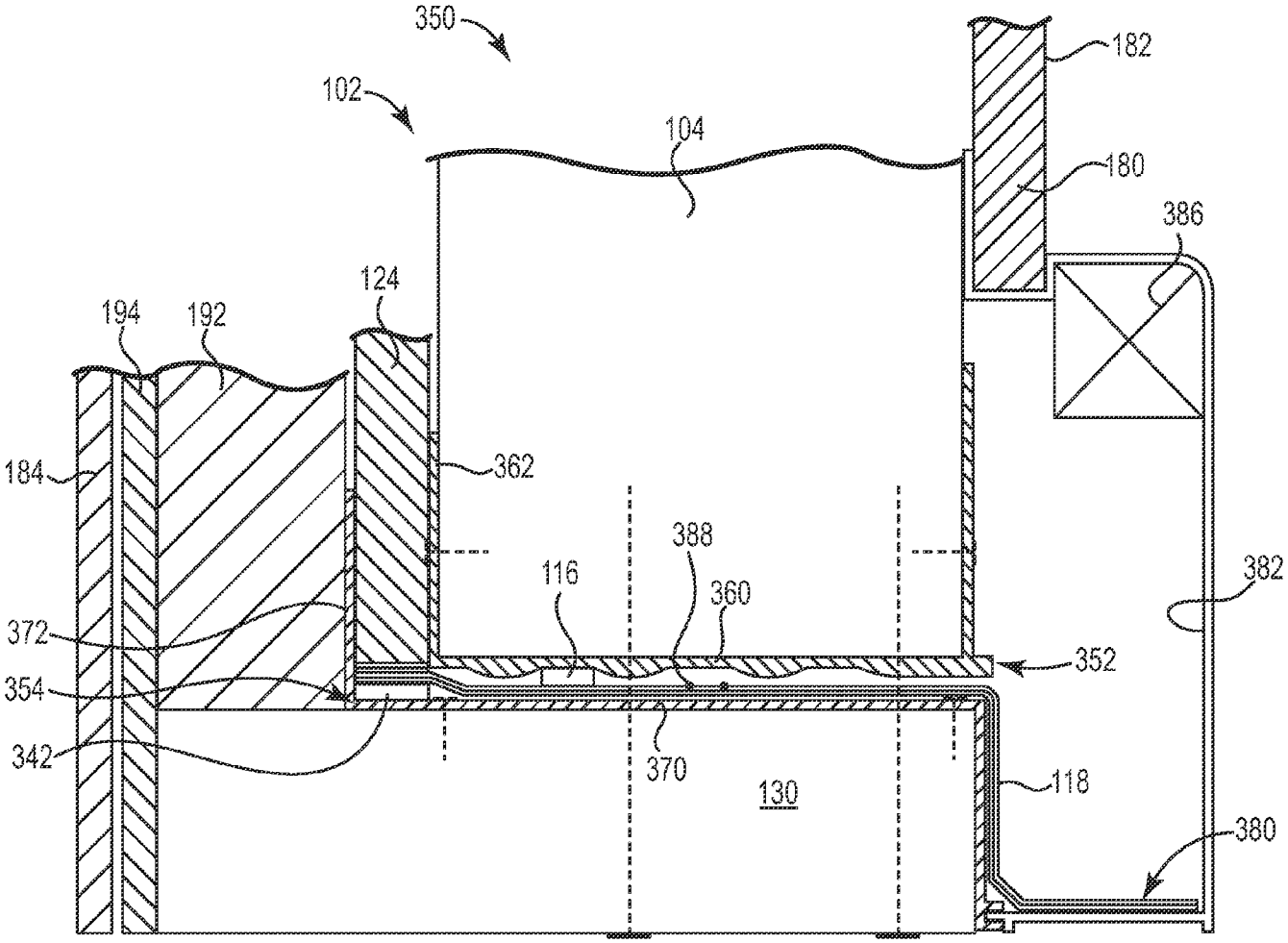
FIG. 16 is a schematic cross-sectional view of a system of components for erecting an exterior wall assembly according to one embodiment.

FIG. 16 is a schematic cross-sectional view of a system 350 of components for erecting an exterior wall assembly according to one embodiment. With additional reference to FIG. 1 and FIG. 5, system 350 includes a stud cap 352 attachable to wall frame 104 and a base cap 354 attachable to base 130 of wall assembly 102. Stud cap 352 and base cap 354 cooperate to retain any of the moisture transport sheets described above, such as MTS 124, against wall frame 104 and secure moisture wicking sheet 118 under wall frame 104 and in contact with MTS 124.

In one embodiment, stud cap 352 is coupled to ends of vertical studs of wall frame 104 through pre-located slots from to provide a desired spacing between the studs and includes a stud plate 360 attached to a bottom of the vertical studs and a stud flange 362 extending from stud plate 360. In one embodiment, base cap 354 includes a base plate 370 attachable to base 130 and a base flange 372 extending from base plate 370. When assembled, MTS 124 is retained between stud flange 362 and base flange 372, and moisture wicking sheet 118 is placed on seal strip 342 in contact with MTS 124 and extends out from wall frame 104 between stud plate 360 and base plate 370. Thus, moisture wicking sheet 118 communicates with MTS 124 when wall assembly 102 is erected and forms a moisture conduit (a pathway for the flow of moisture to follow) extending from wall frame 104 to a dynamically ventilated trough 380.

Moisture vapor that accumulates within wall assembly 102 will condense on film 200 (FIG. 6) of MTS 124 and bulk moisture that enters wall assembly is captured and directed by one of the moisture wicking layers 202, 204 (FIG. 6). The moisture, whether from vapor or liquid, is transported down MTS 124 toward wicking sheet 118. Wicking sheet 118 directs moisture out of wall assembly 102 into a trough 380 formed by a baseboard plate 382 that is attached to base cap 354.

Trough 380 communicates with a dynamic ventilation system configured to remove moisture that is collected in trough 380. Trough 380 is attached to an interior side of wall assembly 102 in one embodiment. Trough 380 is attached to base 130 inside of wall assembly 102 in one embodiment.

In one embodiment, baseboard plate 382 forms a plenum and includes a fan 386 or an active drying mechanism 386 that is configured to blow air into/across trough 380 and evaporate moisture delivered into trough 380 by wicking sheet 118. Operating fan 386 will generally form a region or zone of lower vapor pressure within trough 380, which will encourage or dynamically drive the flow of moisture away from wall frame 104, down MTS 124, and along wicking sheet 118. Fan 386 is thus configured to dynamically draw moisture out of wall assembly 102 into trough 380 and to actively evaporate the moisture as it is collected in trough 380. It is acceptable to provide baseboard plate 382 with openings that enable air blown by fan 386 to exit the plenum formed by the baseboard plate 382. In one embodiment, active drying mechanism 386 includes a connection between the plenum and a central forced air system, where the central forced air system is configured to force warm, dry air through the trough 380 in winter and cool, dry air through the trough 380 in summer.

In one embodiment, trough 380 includes a heated rod disposed inside baseboard plate 382, where the heated rod (or other source of heat) is employed to drive moisture out of trough 380. Such an arrangement can also serve as a baseboard space heating device.

Seal 116 prevents pressure driven advection of moist air that could possibly be blown back into the space between stud cap 352 and base plate 354 as fan 386 operates. In addition, during humid months seal 116 prevents the diffusion of water vapor from humid exterior regions outside of wall assembly 102 from being drawn into regions of wall assembly 102 that have already been dried by MTS 124 and wicking sheet 118. Seal 116 and seal 342 combine to allow liquid to be drained from a lower portion of wall assembly 102 while sealing interior and exterior cavities of wall assembly 102 (relative to MTS 124) from interior sources of moisture. The interior sources of moisture include the diffusion of moisture caused by humidity gradients or moisture that arises from a pressure differential within wall assembly 102 in which the interior pressure of wall assembly 102 is greater than the exterior pressure. In addition, seal 116 and seal 342 combine to prevent leakage of moisture arising from a negative pressure differential (where the exterior pressure of wall assembly 102 is greater than the interior pressure), which prevents exterior air from infiltrating to the interior.

In one embodiment, fan 386 is an electric fan having a cross-sectional area between about 2-10 square inches and is electrically coupled to a moisture sensor 388 coupled to wicking sheet 118. Moisture sensor 388 includes a pair of spaced apart electrodes that are sensitive to the presence of moisture in the form of sensed capacitance or sensed change in resistance. For example, when wicking sheet 118 is transporting moisture, the moisture will generally increase capacitance across the electrodes. The change in the capacitance across the electrodes of moisture sensor 388 is configured to be sensed by fan 386, resulting for example in activating fan 386 at a predetermined sensed moisture level as recorded by moisture sensor 388. In one embodiment, moisture sensor 388 includes a voltage output that correlates to a level of moisture within wicking sheet 118. Fan 386 is selectively activated when moisture in sheet 118 exceeds the pre-set desired moisture level, thus dynamically drying moisture within trough 382 and sheet 118. When the moisture in sheet 118 drops below the pre-set desired moisture level fan 386 shuts off.

In the embodiment, moisture sensor 388 includes two wires of particular resistivity, and the wicking material forms a capacitor with the wicking material as the dielectric. The dielectric strength (capacitance) increases with moisture content in a direct and measurable way. This capacitance is detected by the electronics and converted into a voltage signal that is used in the embodiment to control the fan as well as provide a visual (e.g., via a light emitting diode) and digital indication (e.g., via a data logger) of the state of moisture of the wicking layer and thus by inference of the wall system.

In one embodiment, the moisture transport spacer (MTS 124 or Dryspacer) is positioned between interior and exterior vapor permeable membranes 142, 190 (FIG. 5). MTS described herein include a barrier to the through-passage of moisture through wall assembly 102, such that the vapor permeable membrane 142 enables water vapor entering wall assembly 102 from the exterior to be dried to the exterior by evaporation, and the vapor permeable membrane 190 enables water vapor entering wall assembly 102 from the interior to be dried to the interior by evaporation.

Figure 17:
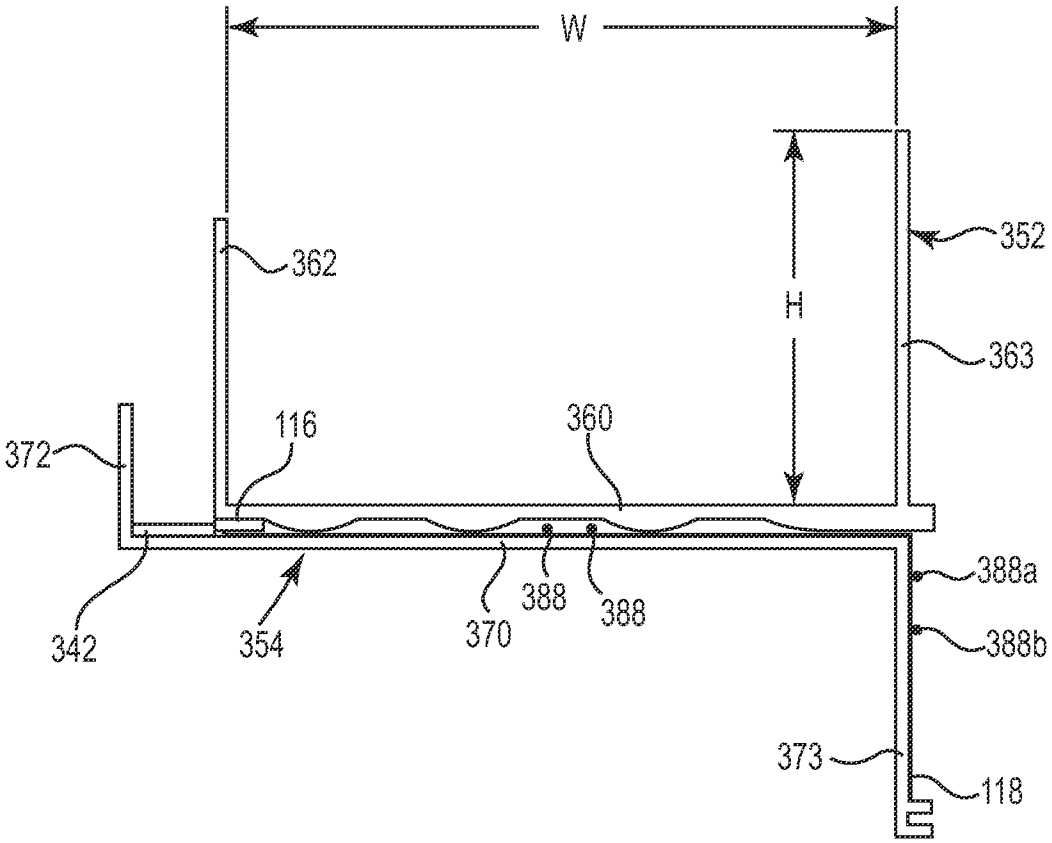
FIG. 17 is a schematic cross-sectional view of a stud cap configured for attachment to wall studs and attachable to a base cap configured for attachment to a base of an exterior wall assembly according to one embodiment.
Figure 18:
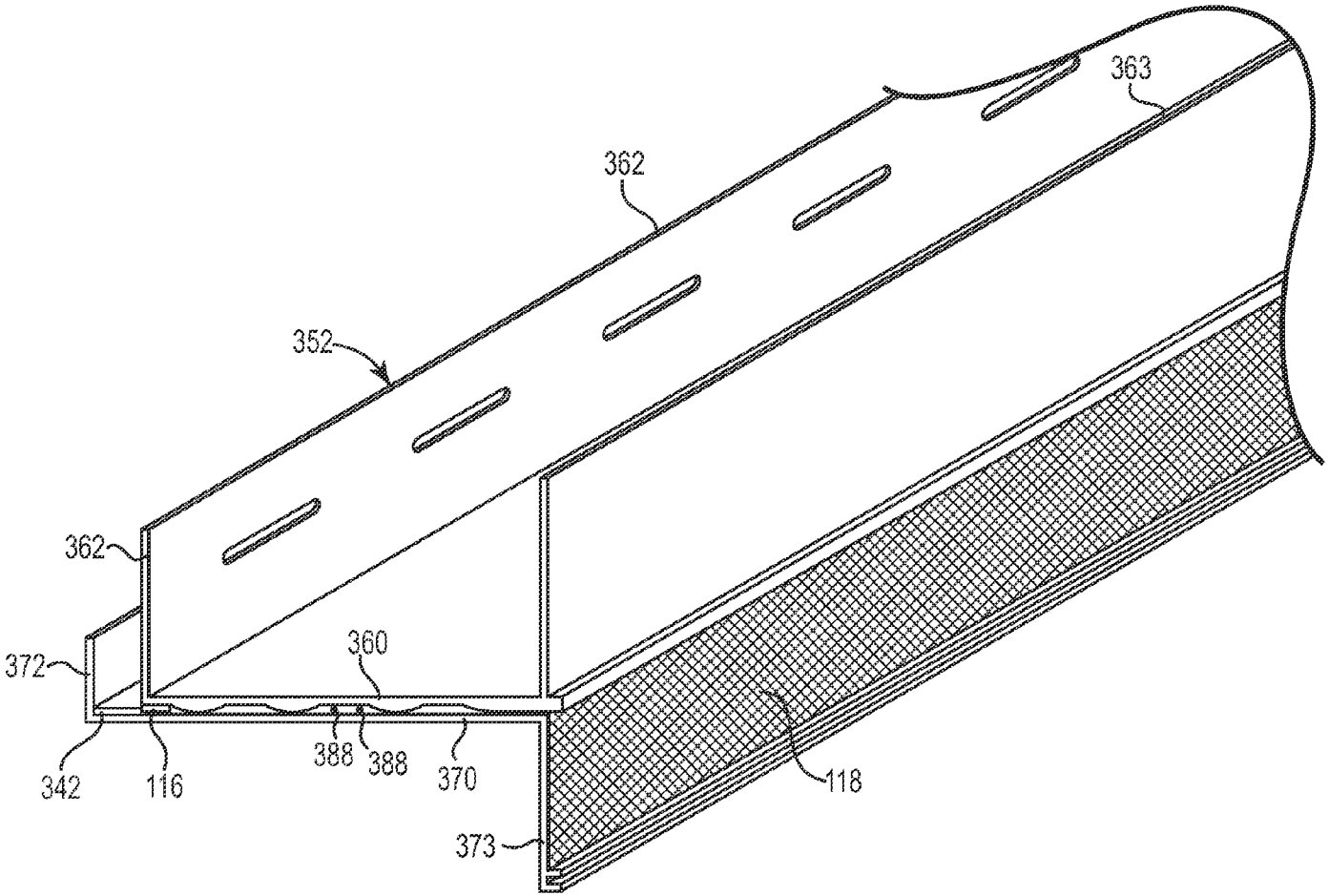
FIG. 18 is a perspective view of the stud cap attached to the base cap as illustrated in FIG. 17 according to one embodiment.

FIG. 17 is a schematic cross-sectional view and FIG. 18 is a perspective view of stud cap 352 operatively oriented relative to base cap 354. In one embodiment, stud cap 352 is generally a U-shaped cap including opposing flanges 362, 363 extending from base plate 360. Wall frame 104 (FIG. 5) includes vertical studs supported by a lateral bottom board, and flanges 362, 363 are configured to engage with the lateral bottom board. For example, in one embodiment the lateral bottom board is provided as a 2×4 stud and stud cap 352 has a width W of about 3.5 inches and a height H of about 2 inches to enable flanges 36, 363 to be secured over the 2×4 bottom board.

Stud cap 352 is configured to carry and distribute the load of wall frame 104, and in one embodiment an exterior surface of base plate 360 is structured to have a load dissipating structure that distributes the weight of wall assembly 102 evenly over base 130 (FIG. 16) and base cap 354.

When stud cap 352 is assembled relative to base cap 354, foam seal 342 is disposed between flanges 362, 372, a portion of wicking sheet 118 is attached to foam seal 342 to communicate with MTS 124 (FIG. 16), and seal 116 is disposed between wicking sheet 118 and the exterior lower surface of stud plate 360 to provide an air-sealed gap between stud cap 352 and base cap 352. Wicking sheet 118 and MTS 124 combine to transport moisture out from between stud cap 352 and base cap 352. In one embodiment, wicking sheet 118 extends over a surface of base plate 370 and an exterior surface of lower flange 373 to ensure that moisture is directed away from the wall frame to which the caps 352, 354 are attached. As illustrated, one embodiment includes multiple moisture sensors 388 attached to and distributed over wicking sheet 118.

Figure 19:
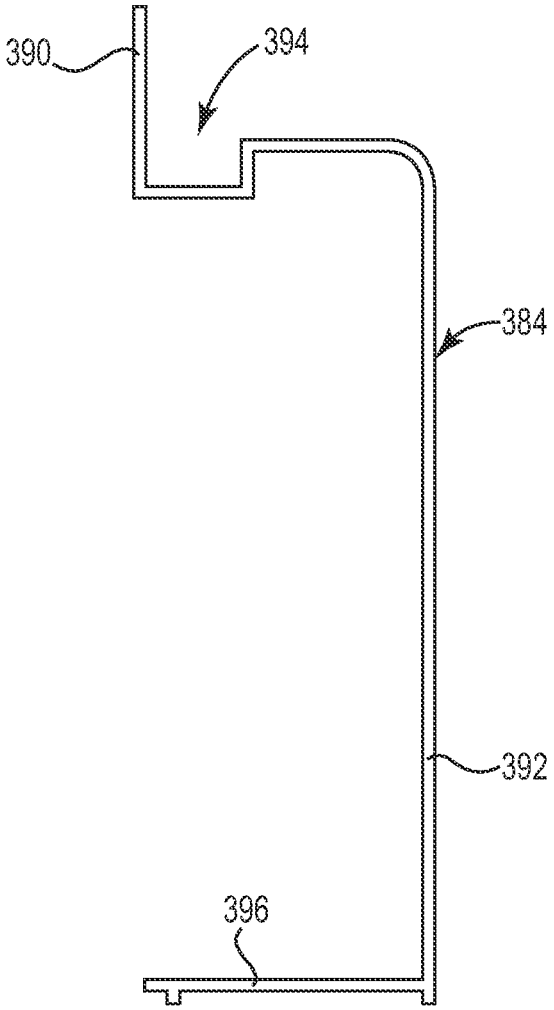
FIG. 19 is a side view of a baseboard housing configured for attachment to the stud cap and the base cap illustrated in FIG. 18 according to one embodiment.

FIG. 19 is a schematic cross-sectional view of baseboard plate 382. In one embodiment, baseboard plate 382 includes a frame plate 390 that combines with a face plate 392 to form a recess 394 that is sized to receive interior wall layer 180 of wall assembly 102 (FIG. 16). A trough flange 396 extends from face plate 392 and is attachable to flange 373 (FIG. 17) of base cap 354 to form trough 380 (FIG. 16).

Frame flange 390 is attachable to wall frame 104 to rigidly secure baseboard plate 382 against stud cap 352 and base cap 354 to form the plenum described in FIG. 16. In one embodiment, fan 386 (FIG. 16) is attached to an interior side of baseboard plate 382 and is electrically coupled to moisture sensors 388. In one embodiment, baseboard plate 382 defines a height of about 4.5 inches and a width of about 1.5 inches. Other sizes and shapes for housing 384 are also acceptable.

Figure 20:
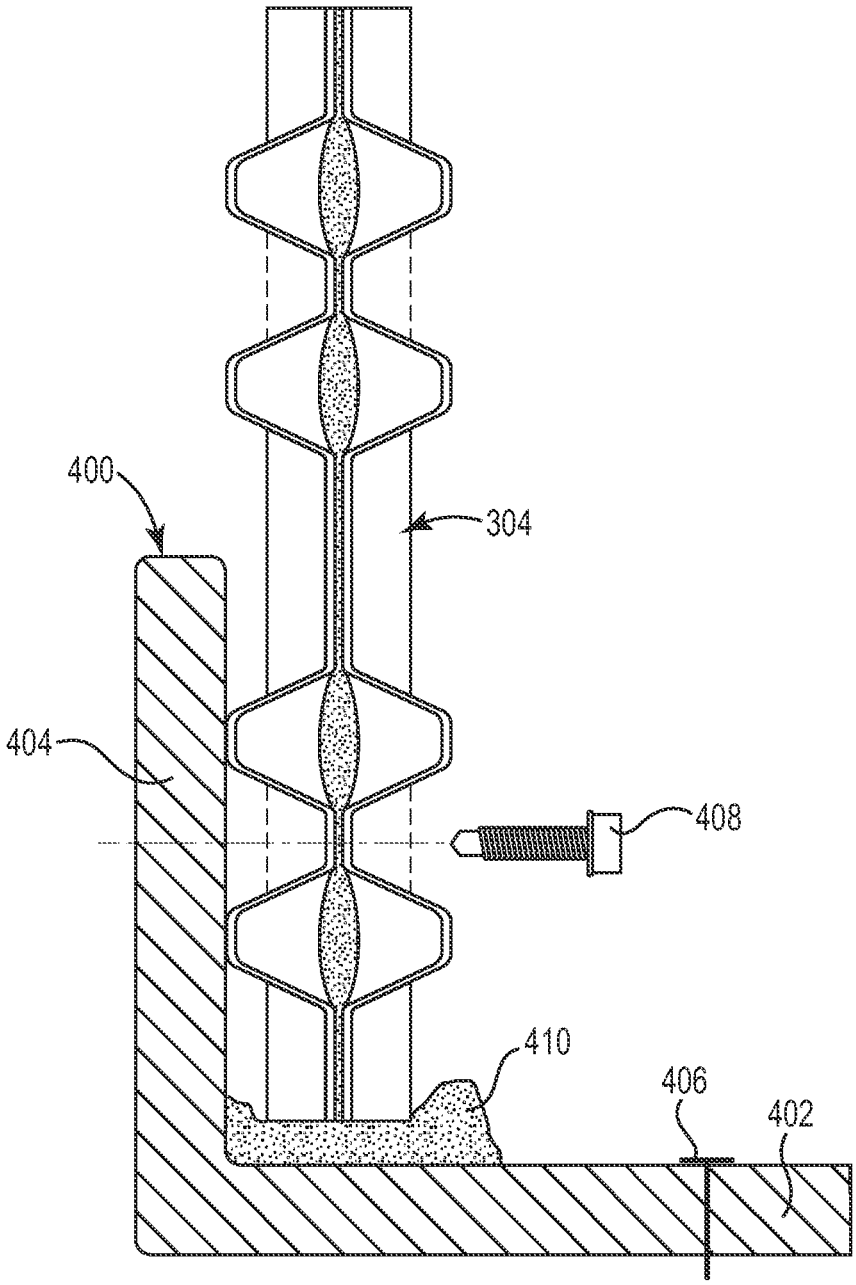
FIG. 20 is a schematic cross-sectional view of the moisture transport spacer illustrated in FIG. 12B retained in another rough opening edge seal according to one embodiment.

FIG. 20 is a schematic cross-sectional view of moisture transport spacer 304 (MTS 304) retained in another embodiment of a rough opening edge seal 400. Rough opening edge seal 400 is configured to retain any of the moisture transport sheets described above. In one embodiment, edge seal 400 is configured to simplify the installation of MTS 304 and includes a base flange 402 coupled to a vertical flange 404. Base flange 402 is configured to be placed on a horizontal support within the wall assembly, for example base 130 (FIG. 16), and is held in place by a suitable attachment device such as a nail 406. Vertical flange 404 is configured to mate against a vertical stud or other support within the wall and is held in place by a suitable attachment device, such as a self-drilling screw 408.

In one embodiment, MTS 304 is coupled to edge seal 400 by a sealant 410 that seals an end of MTS 304 to one or both of base flange 402 and vertical flange 404. In one embodiment, sealant 410 is a moisture-curing sealant foam, although other forms of sealant are also acceptable. In one embodiment, sealant 410 is a foam adhesive delivered from a pressurized spray canister. Edge seal 400 is compatible with accepted practices for wall construction and is configured to enable a contractor to conveniently install MTS 304 along any rough opening within a wall assembly by simply securing edge seal 400 and bonding MTS 304 in place against edge seal 400.

Figure 21:
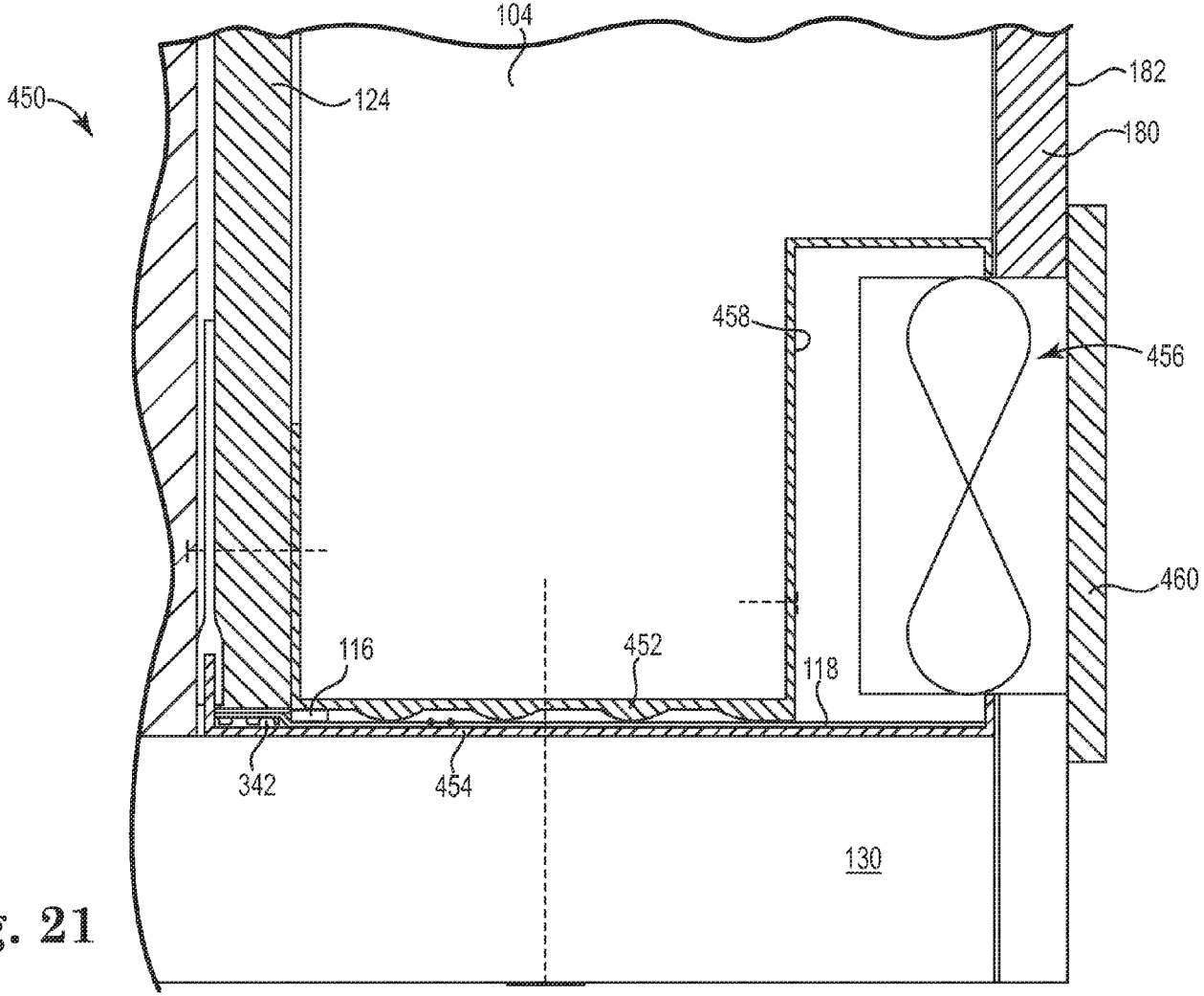
FIG. 21 is a schematic cross-sectional view of an exterior wall assembly according to one embodiment.

FIG. 21 is a schematic cross-sectional view of an exterior wall assembly 450 according to one embodiment. Exterior wall assembly 450 includes a stud cap 452 attachable to wall frame 104, a base cap 454 attachable to base 130 of wall assembly 102, MTS 124 disposed alongside wall frame 104, and an active drying mechanism 456 disposed within a trough 458 that is integrated into interior wall 180, where trough 458 is covered with a vent 460.

Stud cap 452 and base cap 454 cooperate to retain any of the moisture transport sheets described above, such as MTS 124, against wall frame 104 and secure moisture wicking sheet 118 under wall frame 104 and in contact with MTS 124.

Trough 458 collects bulk moisture extracted from wall assembly 102 by MTS 124, and active drying mechanism 456 evaporates the moisture from trough 458. In one embodiment, active drying mechanism 456 is a fan that evaporates the moisture from trough 458 by forcing air along trough and out of vent 460. In one embodiment, active drying mechanism 456 is a heat source that evaporates the moisture from trough 458 into an interior room through vent 460.

In one embodiment, vent 460 and trough 458 are integrated into wall assembly so that vent 460 has the appearance of a baseboard.

Figure 22:
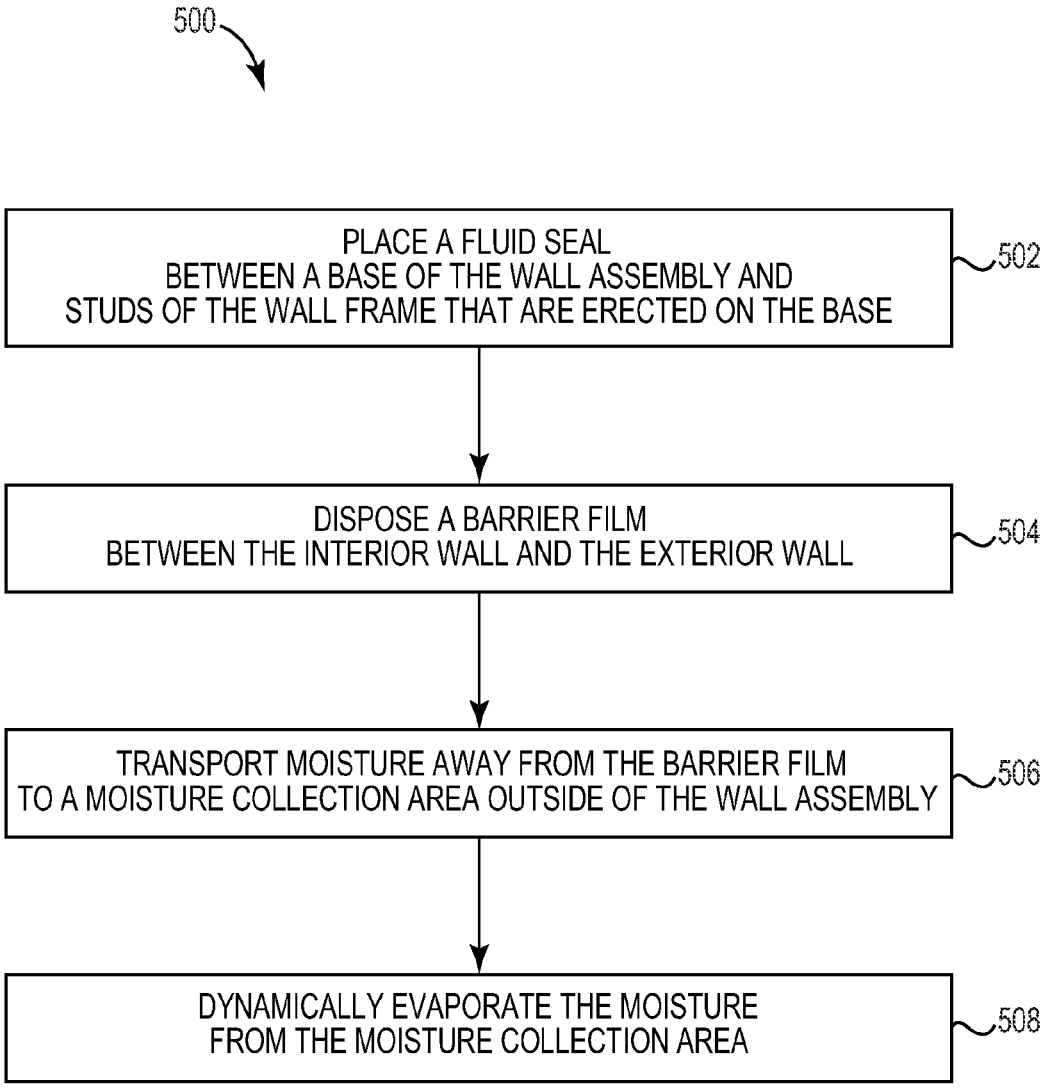
FIG. 22 is a flow diagram of a method of removing moisture from a wall assembly according to one embodiment.

FIG. 22 is a flow diagram of a process 500 of removing moisture from a wall assembly according to one embodiment. Process 500 includes placing a fluid seal between a base of a wall assembly and studs of a wall frame at 502. At 504, process 500 includes disposing a barrier film between the interior wall and the exterior wall of the wall assembly. At 506, moisture is transported away from the barrier film to a moisture collection area outside the wall assembly. At 508, the moisture within the moisture collection area is dynamically evaporated to dry out the moisture collection area and to dry a space between the interior wall and the exterior wall. In one embodiment, process 500 dries interior surfaces of a sealed wall assembly to a moisture content of less than approximately 6%, for example to a moisture content of approximately 2%, which is a level that resists the growth of mold and/or bacteria.

COMPARATIVE EXAMPLE

Features of embodiments of exterior wall assemblies as illustrated in FIG. 16, for example, were compared to a Reference Standard Test Panel.

The Reference Standard Test Panel and a Comparative MTS Test Panel similar to the structure illustrated in FIG. 16 were evaluated in a conditioned environment having a relative humidity of about 50 percent. The moisture content inside of the wall assembly was recorded over the course of about 100 days for both the Reference Standard Test Panel and the Comparative MTS Test Panel.

The components of each of each of the test panels are listed in Table 1 below. The Reference Standard Test Panel includes components that are typically used in the construction industry to form a sealed wall assembly and include a breathable water resistive layer attached to a sheathing of oriented-strand board (OSB) which is covered by exterior cladding, insulation, and a warm-side vapor retarder (e.g., a 2 mil polyamide-6 membrane) placed inside an interior finish layer. The insulation is provided by an unfaced fiberglass batt (R-19 insulation value) placed between the wall studs.

The Comparative MTS Test Panel is constructed in a manner similar to the Reference Standard Test Panel but includes an MTS layer as described herein deposited between the sheathing and the warm-side vapor retarder. For example, the insulation is provided by an extruded polystyrene insulation, and unfaced fiberglass batt (R-13 insulation value) placed between the wall studs with the MTS layer placed between the studs and the extruded polystyrene insulation. Consequently, the comparative results between the two test panels represent the performance advantage provided by the MTS (or Dryspacer layer).

TABLE 1

| Wall Assembly Component | Reference Standard Test Panel | Comparative MTS Test Panel |
|---|---|---|
| Cladding | Fiber cement board | Fiber cement board |
| Breathable Water resistive layer | Spun bonded polyolefin | Spun bonded polyolefin |
| Sheathing | ½" OSB | ½" OSB |
| Insulation system | R-19 unfaced fiberglass batt | 1.5" extruded polystyrene, MTS, R-13 unfaced fiberglass batt |
| Warm-side vapor retarder | 2-mil. PA-6 | 2-mil. PA-6 |
| Interior finish layer | ½" gypsum with 3-coats of latex paint | ½" gypsum (unpainted) |

Each of the test panels were evaluated in a conditioned environment.

Figure 23A:
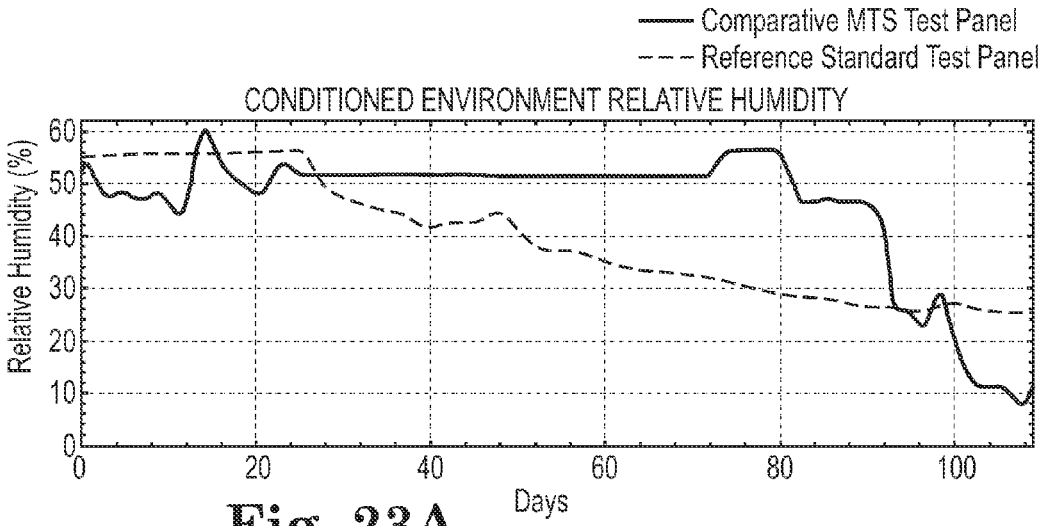
FIG. 23A is a graph of relative humidity inside a conditioned environment to which a standard wall and a comparative wall were challenged with high relative humidity and FIG. 23B is a graph of relative humidity inside each of the standard wall and the comparative wall during the high-humidity challenge.

FIG. 23A is a graph of the relative humidity in the conditioned environment. The interior side of each test panel was exposed to the conditioned environment. Note that the relative humidity in the conditioned environment was generally above 30%, and that the conditioned environment to which the Comparative MTS Test Panel was exposed was maintained at a nearly constant 50% relative humidity between approximately days 25-75. Thus, as illustrated in FIG. 23A, the Comparative MTS Test Panel was challenged with a generally higher relative humidity as compared to the Reference Standard Test Panel.

Figure 23B:
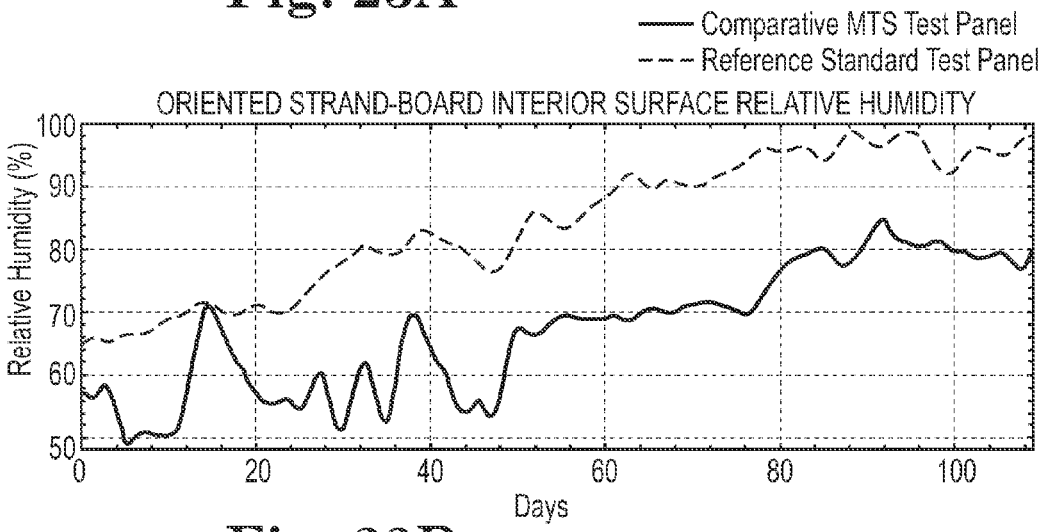

FIG. 23B is a graph of relative humidity measured along an inside surface of oriented-strand board for both the Comparative MTS Test Panel and the Reference Standard Test Panel. With additional reference to FIG. 16, the data for FIG. 23B were measured along an inside surface of OSB 194.

Figure 23C:
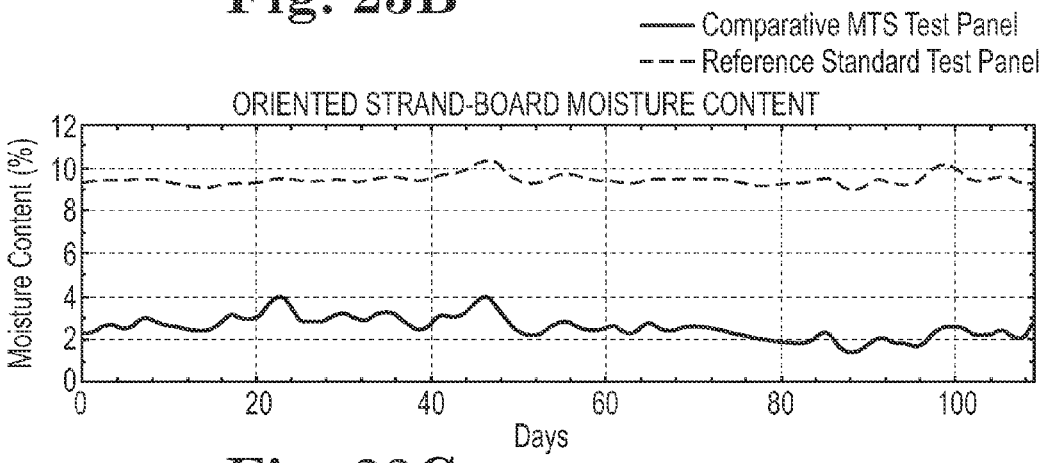
FIG. 23C is a graph of moisture content for a layer of oriented-strand board moisture for each of the standard wall and the comparative wall as recorded over a hundred day period.

FIG. 23C is a graph of moisture content in the oriented-strand board layer over a 100 day period for both the Comparative MTS Test Panel and the Reference Standard Test Panel. The Reference Standard Test Panel has a moisture content of approximately 10% measured on the inside surface of the OSB in the sealed wall assembly. In contrast, the moisture transport sheet 124 and the moisture wicking sheeting 118 (FIG. 16) as described above combine to transport moisture out of the sealed wall assembly such that the Comparative MTS Test Panel has a moisture content of approximately 2% measured on the inside surface of the OSB in the sealed wall assembly.

In one embodiment, the Comparative MTS Test Panel has a moisture content that is approximately a factor of 2.5 less than a moisture content of the Reference Standard Test Panel. The Comparative MTS Test Panel is drier than the conventional wall structure and can be dried to a level that precludes the growth of bacteria, mold, or the formation of rot.

It is noted that the Comparative MTS Test Panel was assembled in the configuration illustrated in FIG. 16 and included fan 286. Over the course of the evaluation, fan 386 would occasionally be activated to evaporate moisture drawn out of the wall assembly. Fan 386 did not run continuously.

Mechanisms are provided that are configured to remove moisture from interior surfaces of a sealed wall assembly. It has been surprisingly discovered that providing a moisture barrier (in the form of a moisture transport spacer) that communicates with a moisture wicking sheet will remove high levels of moisture from the wall assembly, thus drying out the wall assembly.

The sealed wall assembly described above includes one or more moisture transporting sheets that are sealed within the wall assembly and provide a moisture wicking pathway for water to be directed out of the wall assembly. The wall assemblies described above comply with local and state building codes and are configured to be easily assembled without additional tools or approaches that would be new to the skilled contractor.

The sealed wall assemblies described above are believed to offer improved severe weather performance, for example in acting to stop of slow down flying debris; offer increased R-value insulation performance; and offer improved structural acoustics.

Figure 24A:
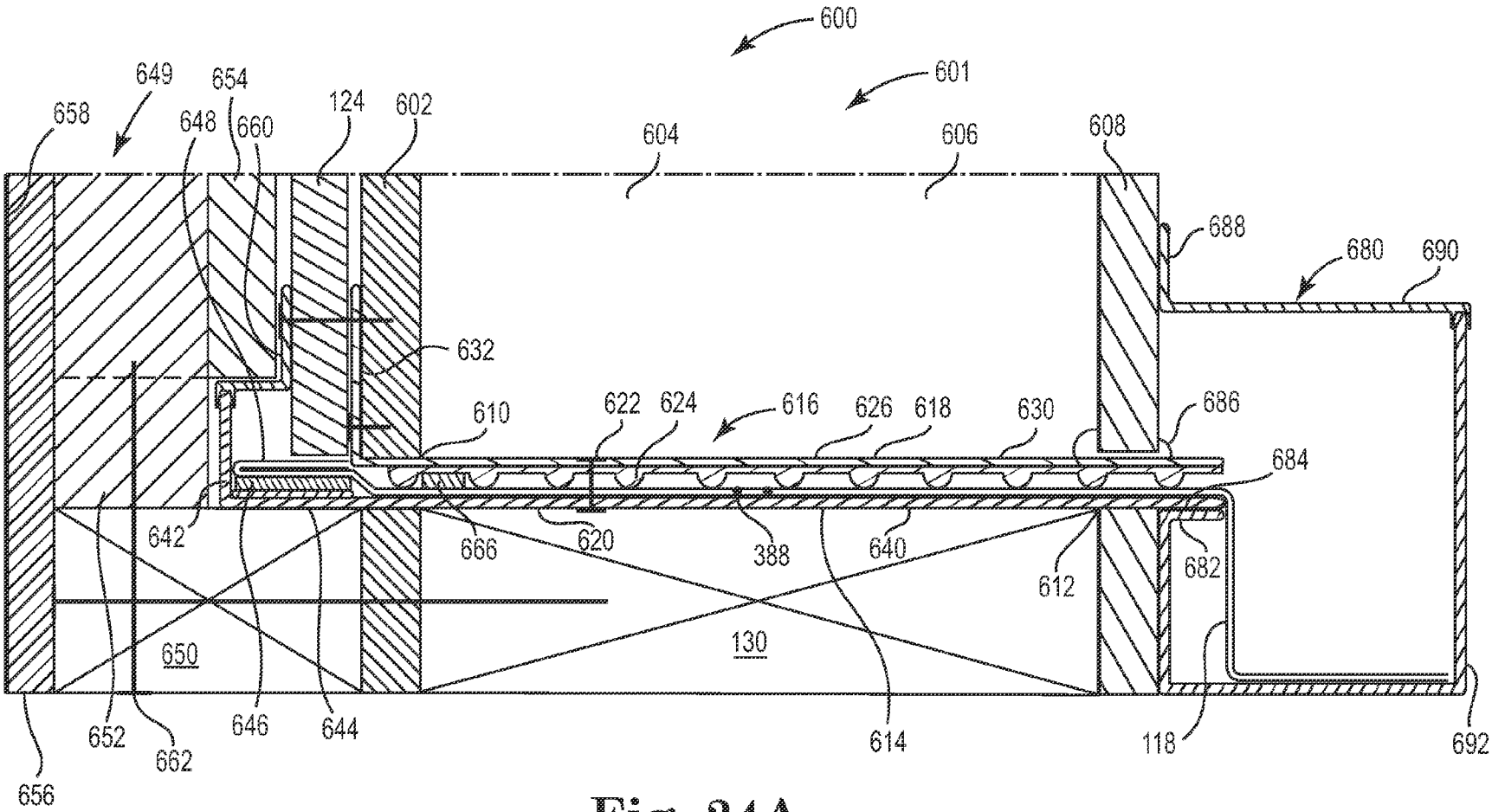
FIG. 24A is a schematic cross-sectional view of a building envelope assembly according to one embodiment.

FIG. 24A is a schematic cross-sectional view of a building envelope assembly 600 according to one embodiment. In one embodiment, building envelope assembly 600 includes existing wall assembly 601 and exterior wall system 649. In one embodiment, existing wall assembly 601 is retrofitted with exterior wall system 649, MTS 124, drain spacer assembly 616, and trough 680 in order to improve the building envelope assembly's performance in the areas previously described.

In one embodiment, existing wall assembly 601 includes existing sheathing 602, existing wall frame 604, insulation 606, and existing gypsum 608. Siding, stucco or other pre-existing exterior finishes of existing wall assembly 601 may have previously been removed and, thus, are not shown. In one embodiment, slots 610 and 612 are located between the studs of wall frame 604. In one embodiment, slots 610 and 612 are sawn or otherwise provided as rough openings in existing sheathing 602 and existing gypsum 608. In one embodiment, the bottom of slots 610 and 612 are flush with the top surface 614 of base 130. In one embodiment, slots 610 and 612 provide an initial means of assembly for exterior wall system 649 and bottom drain spacer assembly 616 with wall assembly 601, as further described below.

In one embodiment, exterior wall assembly 649 is a new wall assembly erected parallel with existing assembly 601. In one embodiment, exterior wall system 649 consists of plate 650, wall framing studs 652, insulation 654, sheathing 656, and vapor permeable water resistive barrier (WRB) 658. In one embodiment, plate 650 and wall framing 652 are assembled prior to erection and attachment of exterior wall system 649 with existing assembly 601. Exterior wall system 649 is secured to the existing assembly 601 using nails, screws, or other suitable fasteners. In one embodiment, the tops of base 130 and plate 650 are flush and provide a coplanar surface for drain spacer assembly 616. In one embodiment, prior to wall system 649 being secured to existing assembly 601, MTS 124 is assembled to existing sheathing 602 and drain spacer assembly 616 is installed.

In one embodiment, drain spacer assembly 616 is a predetermined size to be inserted into slots 610 and 612. In one embodiment, assembly 616 is of segments suitable to be inserted between the existing vertical wall framing studs 604. For example, assembly 616 may be 14 inches long when the stud framing 604 is spaced at 18 inch on center or less, while assembly 616 may be 20 inches long when the stud framing 604 is 24 inch on center studs.

Drain spacer assembly 616, in one embodiment, includes top cap 618 assembled with, and spaced apart from, base cap 620. In one embodiment, top cap 618 is formed as a right angle including flat plate 630 and upright 632. Flat plate 630, in one embodiment, is a two-part assembly with a flat upper portion 626 and a variated lower portion 624. In another embodiment, flat plate 630 is constructed as a single piece. In one embodiment, base cap 620 is a formed at a right angle and includes upright 642 and plate 640. In one embodiment, top cap 618 and base cap 620 are constructed of a rigid material. In one embodiment, top cap 618 and base cap 620 are joined together by connectors 622 prior to insertion into slots 610 and 612.

In one embodiment, top cap 618 and base cap 620 cooperate to retain any of the moisture transport sheets described above, such as MTS 124, against existing sheathing 602 and secure moisture wicking sheet 118 to base 130 and in contact with MTS 124. In one embodiment, top cap 618 is placed on top of base cap 620 such that uprights 632, 642 are spaced apart to provide an opening to receive MTS 124. The width of the opening between uprights 632, 642 is varied by selectively positioning uprights 632, 642 a desired distance apart before fixing in place with connector 622. Connectors 622 may be an I-shaped fastener, rivet or other suitable fastening mechanism.

In one embodiment, moisture wicking sheet 118 and seal 666 are assembled between plates 630, 640 of drain spacer assembly 616. In one embodiment, drain spacer assembly 616 further includes seal 666 and moisture sensors 388, similar to those previous embodiments. In one embodiment, seal 666 is attached between moisture wicking sheet 118 and plate 630 and enables moisture to be wicked through sheet 118 to an exterior of the building envelope assembly 600. In one embodiment, spacer 644 is placed in the interior junction of the flat plate 640 and leg 642 in a horizontal fashion with the seal strip 646 and termination end 648 of moisture wicking sheet 118. Spacer 644, in one embodiment, is a material thickness equal to the thickness of the coupling channel 698 material. In one embodiment, seal strip 646 is attached between plate 640 and the wall space provided for MTS 124, acting as a bulk seal to prevent the transport of water vapor and infiltration air from the exterior assembly 649 to the interior assembly 601.

In one embodiment, drain spacer assembly 616 extends from within wall system 649, through existing wall assembly 601, to terminate a predetermined distance inside trough 680. In one embodiment, the top surface of plate 630 of drain spacer assembly 616 is sealed to slot 612 in existing gypsum 608 with a vapor/air seal 686. In one embodiment plate 640 mates with extension 682 of trough 680. In one embodiment, adhesive 684 bonds extension 682 with plate 640. Adhesive 684 may be PVC cement or other suitable adhesive, for example.

In one embodiment, vented trough 680 provides an outlet for moisture passively transported by the drain spacer assembly 616 and moisture wicking sheet 118. In one embodiment, vented trough 680 is attached to interior existing gypsum 608. In one embodiment, vented trough 680 is secured to existing gypsum 608 with tab 688. In one embodiment, vented trough 680 is a two-piece assembly and includes upper portion 690 and lower portion 692, although other configurations are also suitable. In one embodiment upper piece 690 is snap fit with lower piece 692. Trough 680 is assembled in sections to achieve a desired overall length suitable to accommodate moisture transportation for the building envelope assembly 600. In one embodiment, the vented trough 680 includes moisture sensors (not shown) similar to the moisture sensors used in previous embodiments. In one embodiment, mechanical device 694 (see FIG. 24B) is provided in trough 680 to assist with moisture removal.

Figure 24B:
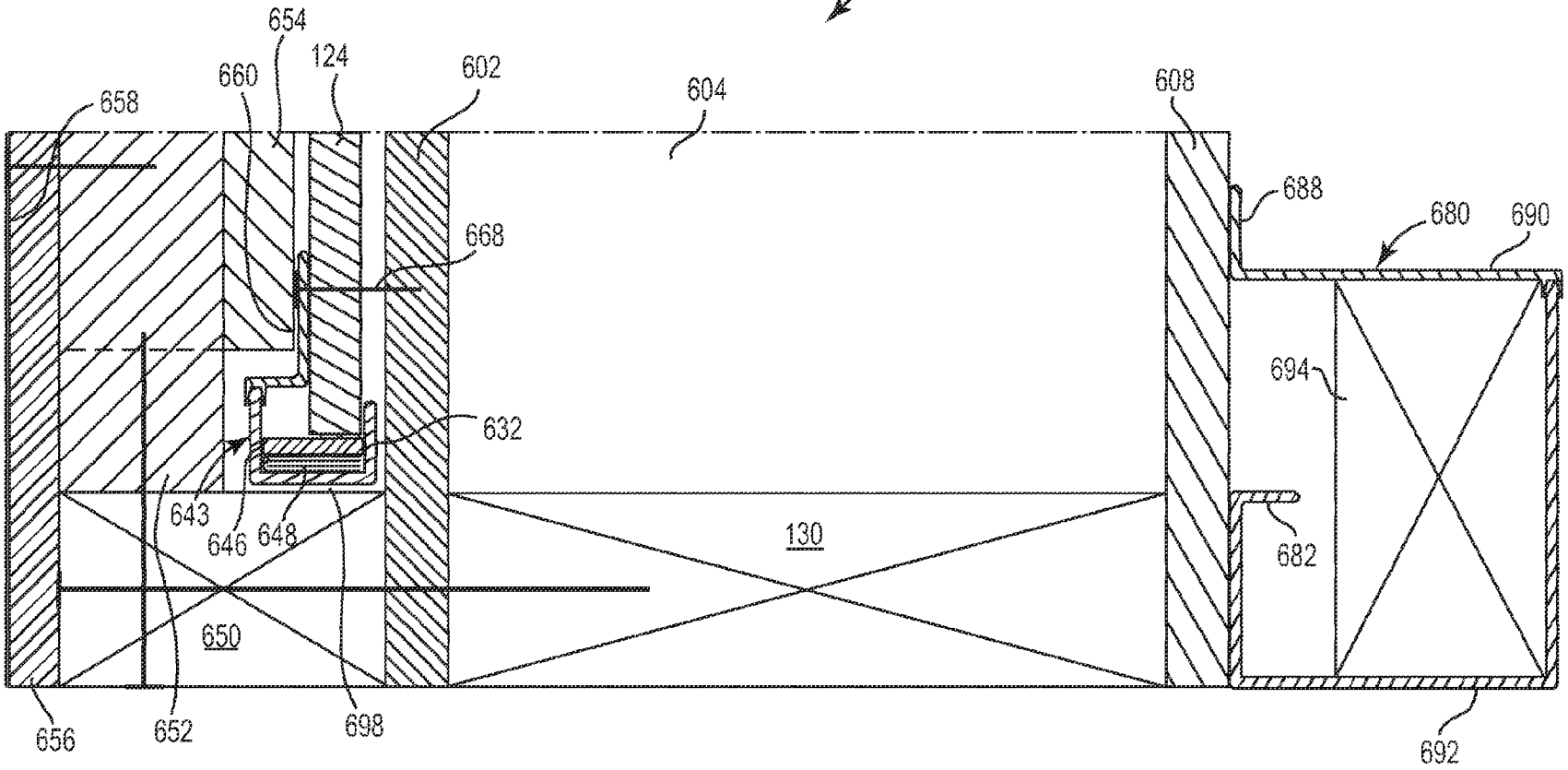
FIG. 24B is a schematic cross-sectional view of a building envelope assembly illustrated in FIG. 24A according to one embodiment.

FIG. 24B is a schematic cross-sectional view of the building envelope assembly 600 of FIG. 24A according to one embodiment as located at a vertical framing member 604 of existing wall assembly 601. In one embodiment, coupling channel 698 is assembled between sections of the drain spacer assembly 616 illustrated in FIG. 24A. Coupling channels 698 are located at framing members 604 to provide a continuous surface for MTS 124 to terminate and drain to between drain spacer assemblies 616. In one embodiment, both base cap 620 and coupling channels 698 are assembled with closure piece 660 which is secured through MTS 124, upright 632 (where appropriate), and existing sheathing 602. In one embodiment, coupling channel 698 is removably disposed between leg 632 and leg 642.

With continued reference to FIG. 24B, coupling channel 698 extends from adjacent plate assembly 616 at framing members 604, overlapping onto base plate 620 to provide a continuous surface below MTS 124. In one embodiment, seal strip 646 and terminating end 648 of moisture wicking sheet 118 extend across both the coupling channel 690 and plate assembly 616. In one embodiment, an uninterrupted seal is provided. In one embodiment, MTS 124 fits within the c-shaped channel of coupling channel 690 and angled cap 660 secures the bottom of MTS 124 in the coupling channel 690.

Figure 25A:
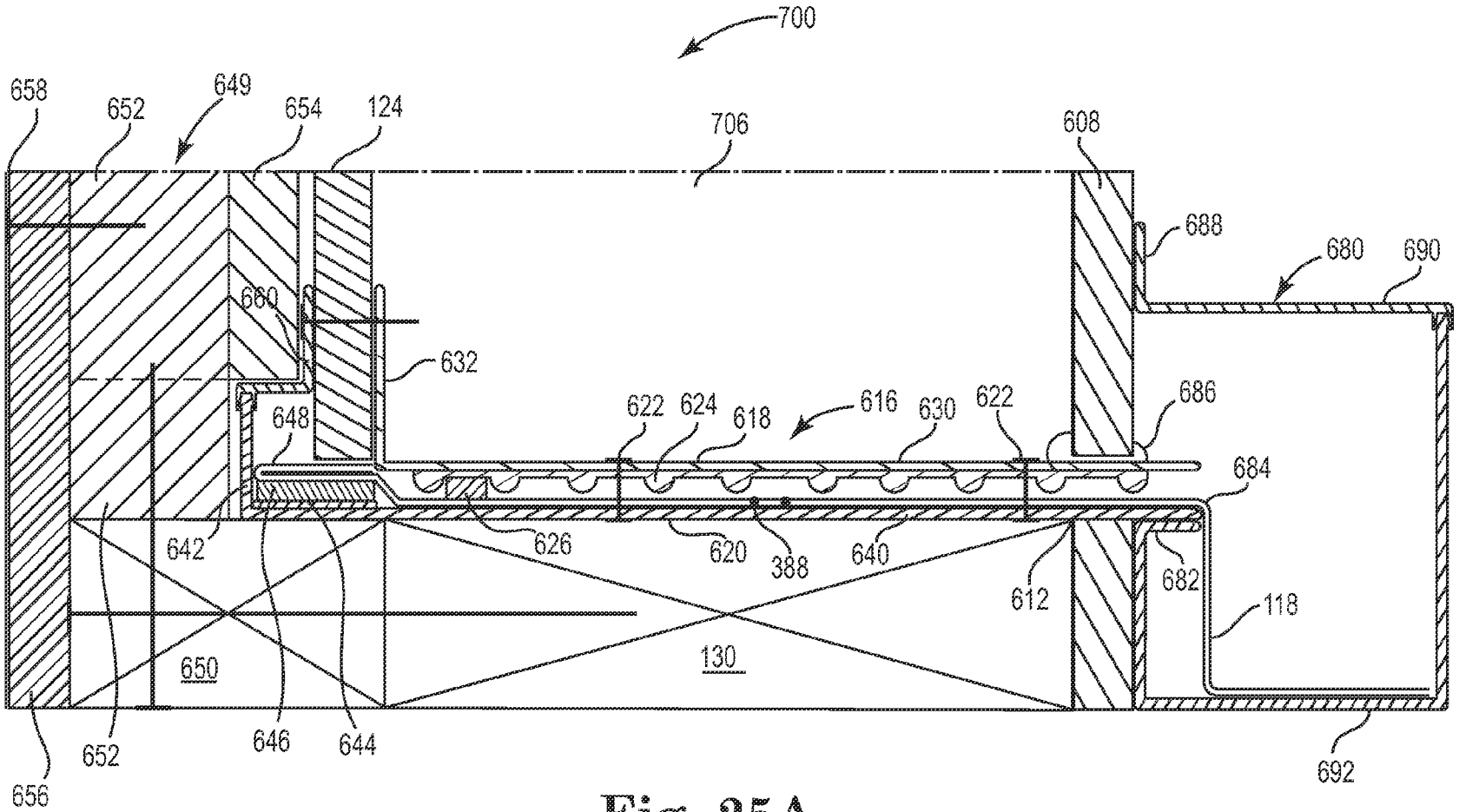
FIG. 25A is a schematic cross-sectional view of a building envelope assembly according to one embodiment.
Figure 25B:
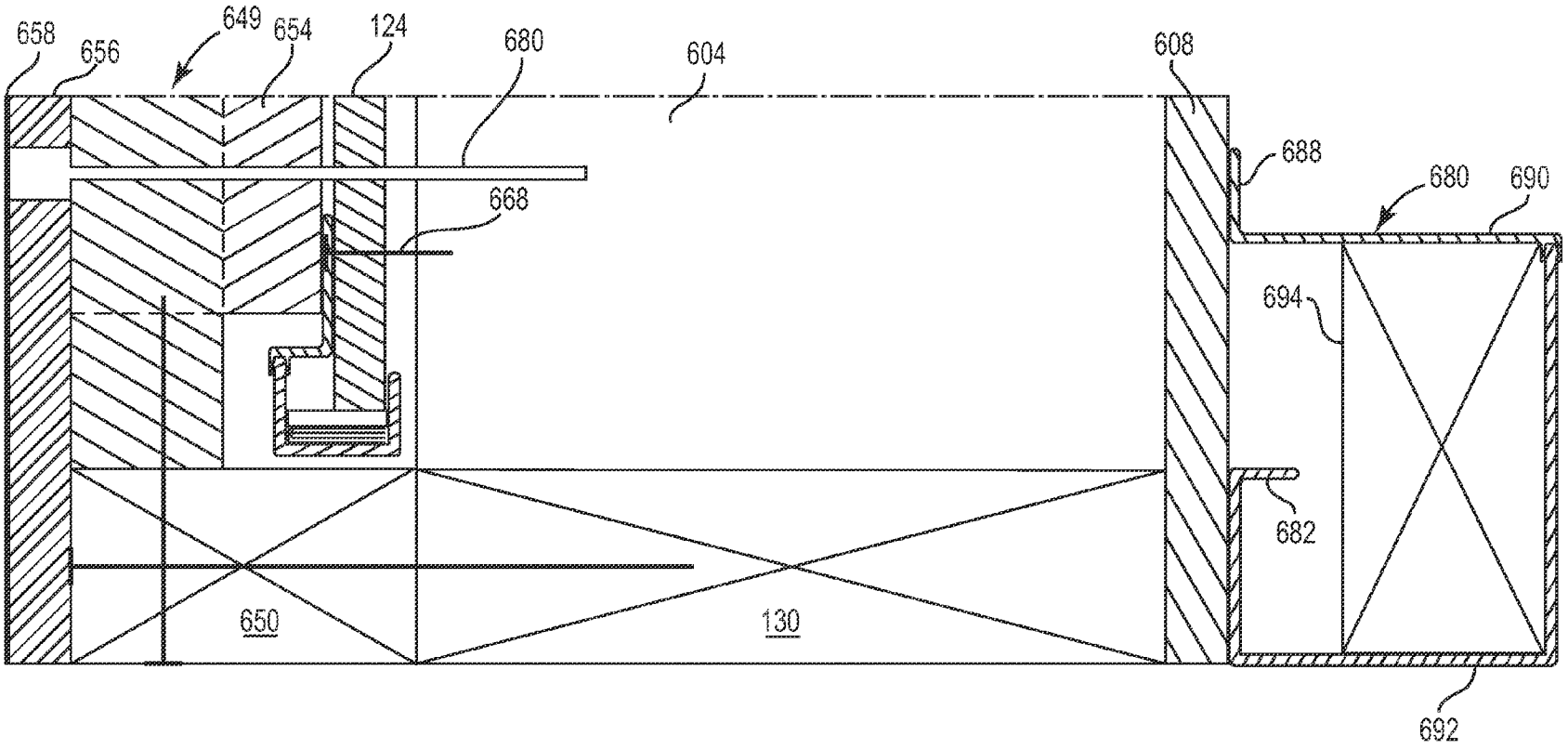
FIG. 25B is a schematic cross-sectional view of the building envelope assembly illustrated in FIG. 25A according to one embodiment.

FIGS. 25A and 25B illustrate an embodiment of a building envelope assembly 700. In one embodiment, assembly 700 is a retrofit of an existing wall system similar to assembly 600 described above. Existing sheathing 602 of FIGS. 24A and 24B has been removed in this embodiment. The existing sheathing may have been removed due to moisture or other damage or may have been removed to replace the insulation within the existing wall cavity. In one embodiment, new insulation 706 is disposed between existing wall framing members 604 (FIG. 25B) to increase the nominal wall R-value. In one embodiment, insulation 654 is extruded polystyrene while insulation 706 is batt insulation, for example, R-19 batt or R-21 batt with a nominal wall R-value of 29 or 31, respectively. Insulation 706 may also be open cell SPU, closed cell SPU, or a hybrid open/closed cell SPU giving a nominal wall R-value of 30, 43, and 35, for example. MTS 124 is attached to framing members 604. In one embodiment, exterior wall assembly fastener 680 attaches the new wall assembly 648 to the existing wall assembly 601 at framing members 604. Fasteners 680 are described in Provisional Utility Patent Application Ser. No. 61/249,497.

Figure 26:
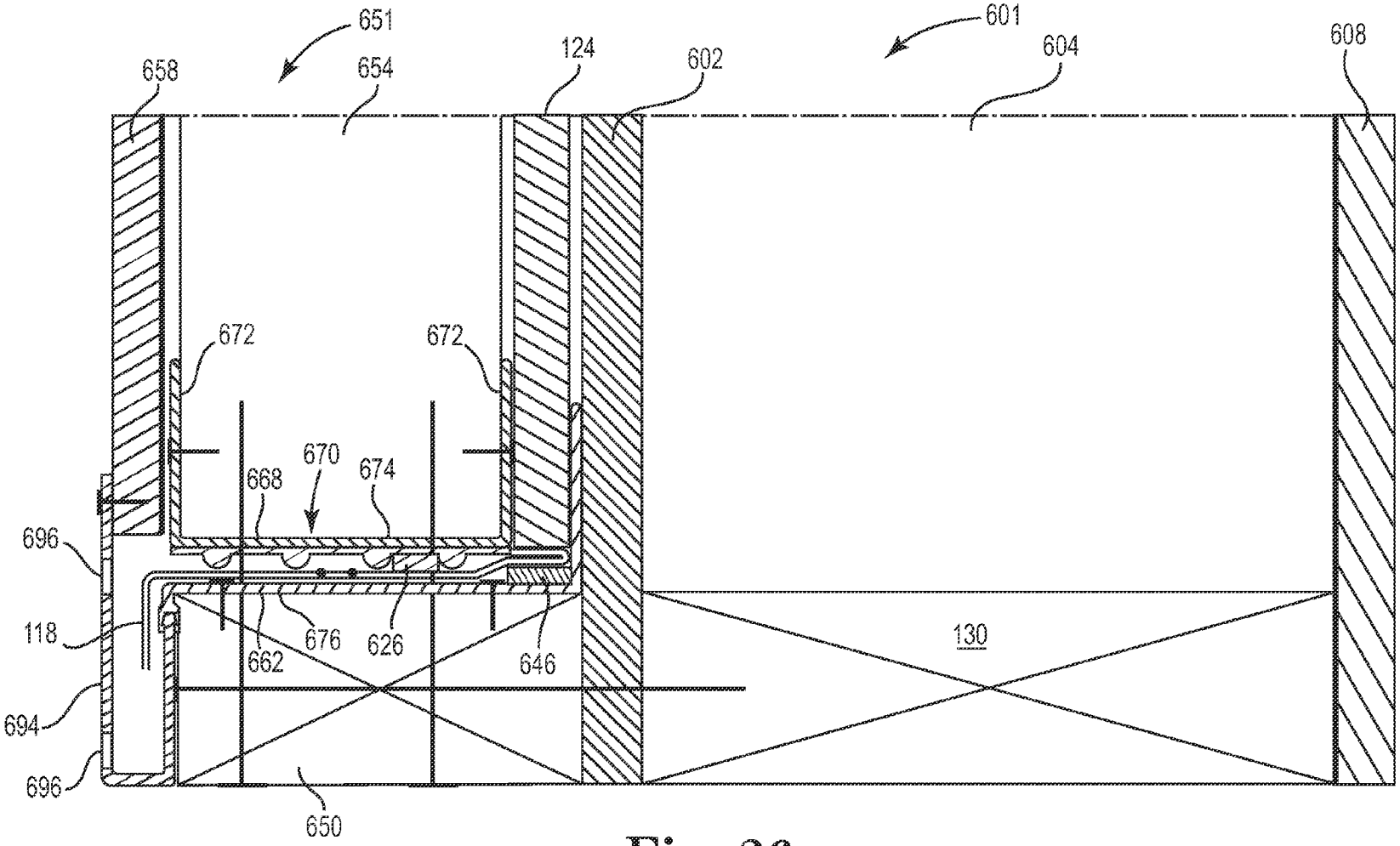
FIG. 26 is a schematic cross-sectional view of a building envelope assembly according to one embodiment.

The building envelope assembly illustrated in FIG. 26 includes a retrofit of an existing wall assembly 601 in a non-freezing climate. In one embodiment, existing sheathing 602 is retained; however, sheathing 602 may also be removed if desired. In one embodiment, plate 650 is aligned and secured to base 130. In one embodiment, drain spacer assembly 670 includes stud cap 668 as a C-shaped channel including two opposing flanges 672 extending from base 674. In one embodiment, stud cap 668 is assembled to the bottom of framing members 654 of exterior wall system 651. When stud cap 670 is assembled relative to base cap 676, a portion of moisture wicking sheet 118 is attached to seal strip 646 to communicate with MTS 124. Moisture wicking sheet 118 and MTS 124 passively transports moisture out from between stud cap 670 and base cap 676 and into trough 694. In one embodiment, trough 694 extends from the outside face of base board 650 to attach at the outside face of sheathing 658. In one embodiment, sheathing 658 is a non-structural sheathing such as ⅜" OSB. Seal 646 prevents ingress of bulk water and water vapor from the exterior, into the wall assembly. In one embodiment, trough 694 includes a series of openings 696 to the exterior. In one embodiment, openings 696 are an equally spaced series of openings at two different elevations and provide air circulation within trough 694.

Figure 27A:
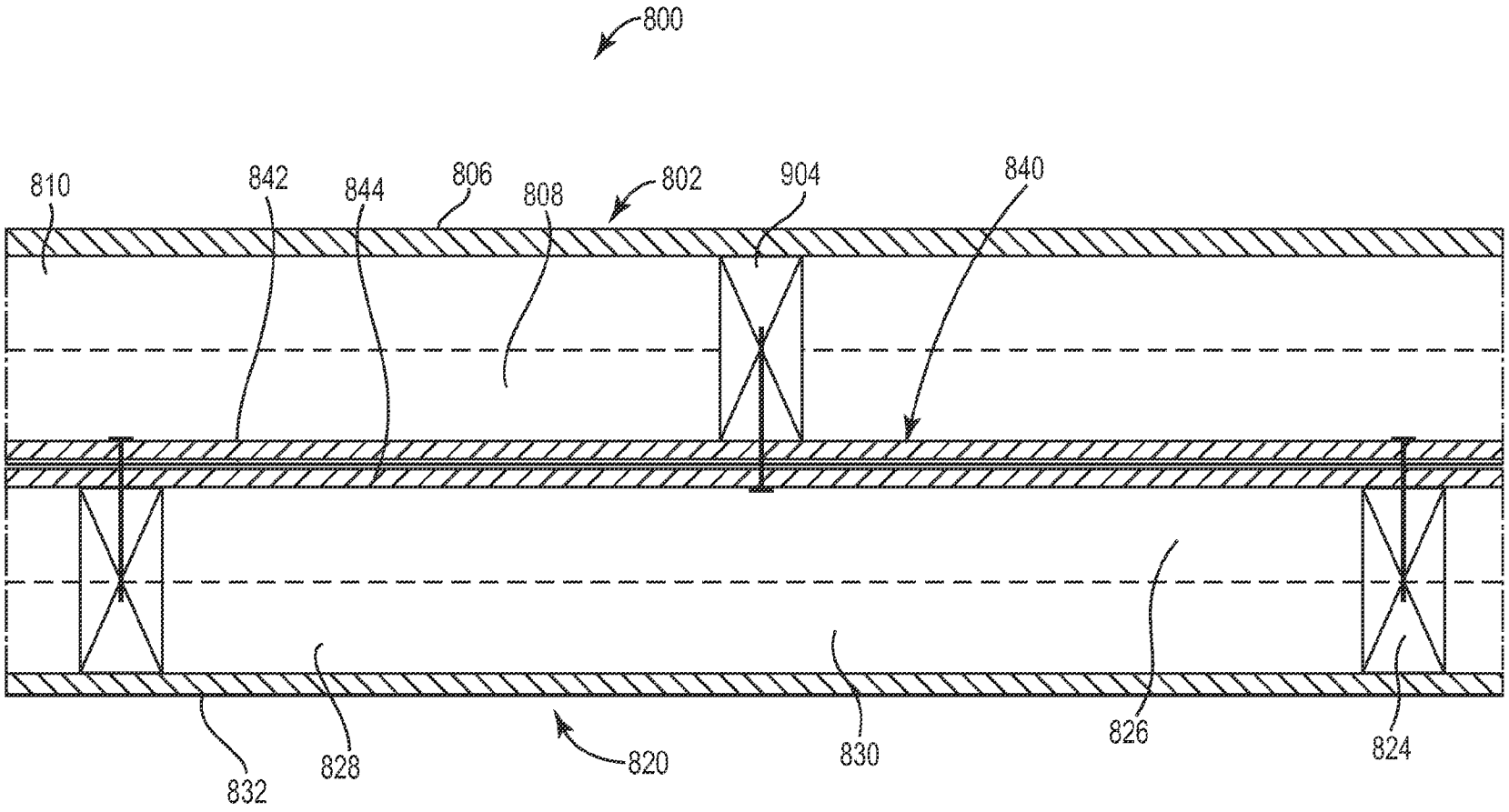
FIG. 27A is a schematic cross-sectional view of a building envelope assembly according to one embodiment.
Figure 27B:
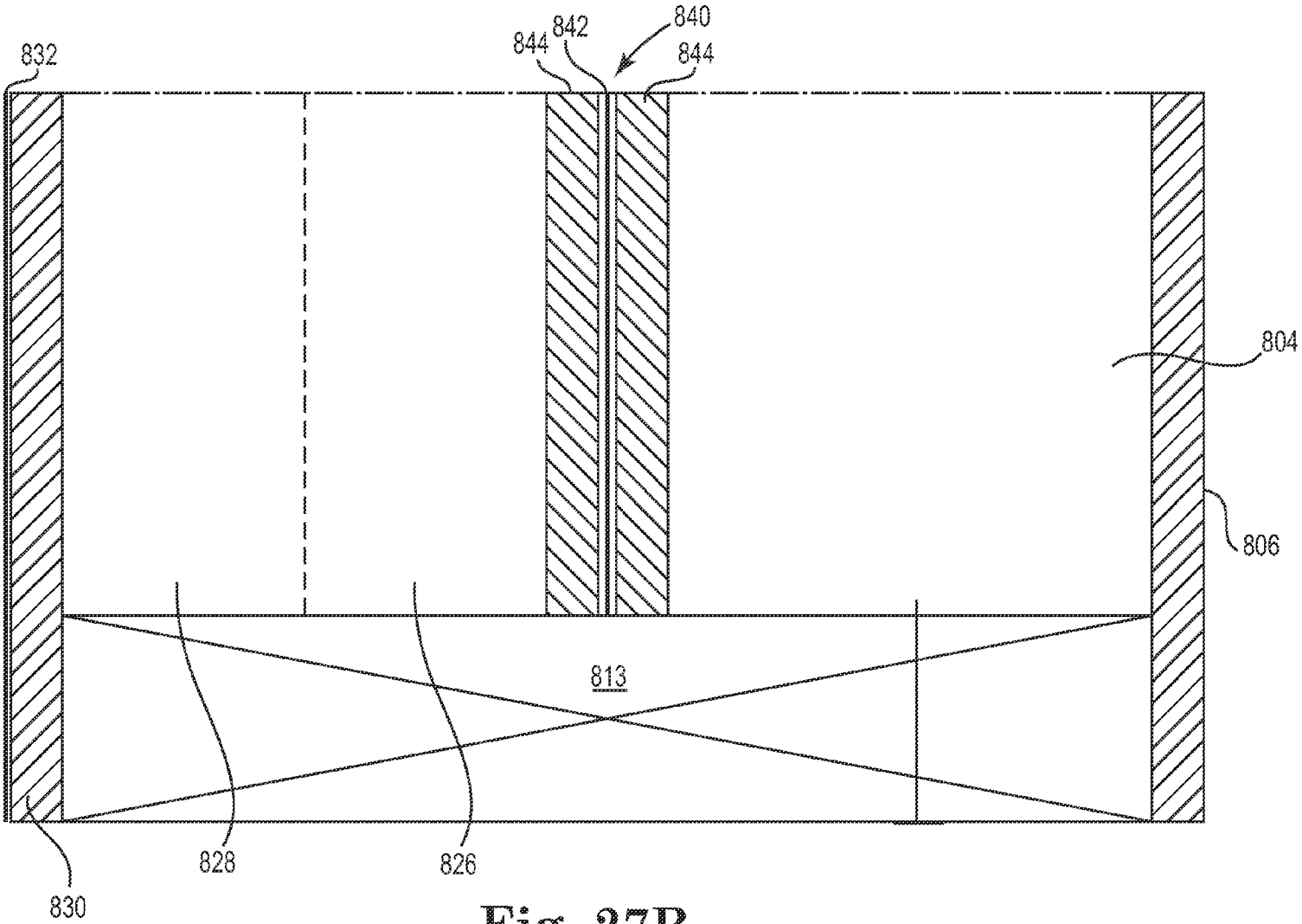
FIG. 27B is a schematic cross-sectional view of the building envelope illustrated in FIG. 27A according to one embodiment.

FIGS. 27A and 27B are schematic cross-sectional views of a building envelope assembly 800 according to one embodiment. Building envelope assembly 800 may be pre-fabricated as a panelized wall or roof system. In one embodiment, building envelope assembly 800 is a new exterior wall assembly. In one embodiment, assembly 800 includes interior structural bearing assembly 802, exterior structural load bearing assembly 820, and passive dry spacer 840 disposed between assemblies 802 and 820. In one embodiment, interior load bearing assembly 802 includes studs 804, sheathing 806, closed cell spray polyurethane or extruded polystyrene rigid insulation 808, and open/closed cell spray polyurethane foam or extruded/expanded rigid polystyrene thermal insulation 810. In one embodiment, studs 804 and sheathing 842 only are load bearing. In one embodiment, exterior load bearing assembly 820 includes studs 824, closed cell spray polyurethane or extruded polystyrene rigid insulation 826, open/closed cell spray polyurethane foam or extruded/expanded rigid polystyrene thermal insulation 828, and exterior sheathing 830. In one embodiment, studs 824 and sheathing 844 only are load bearing. In one embodiment, exterior load bearing assembly 820 further includes vapor permeable water resistive barrier 832. Vapor permeable water resistive barrier (WRB) 832 is a spun bonded polyolefin or two layers of grade D building paper, for example. Assembled between the interior load bearing assembly 802 and exterior load bearing assembly 820, passive dry spacer 840 includes membrane 842 and sheathing 844 on each side of membrane 842. In one embodiment, sheathing 844 is ⅜" thick; however, other thickness and/or additional layers may be included as structurally necessary.

Studs 804, and similarly studs 824, are secured to base 813. In one embodiment, studs 804 and 824 are 2×4 wood members and base 813 is a 2×8 wood member, although other member types and sizes are also acceptable. In one embodiment, after passive dry spacer 840 is assembled between the stud framing assemblies, insulation is disposed between adjacent studs. This may be completed either prior to or after stud framing members 804, 824 are assembled to base 813.

Figure 28A:
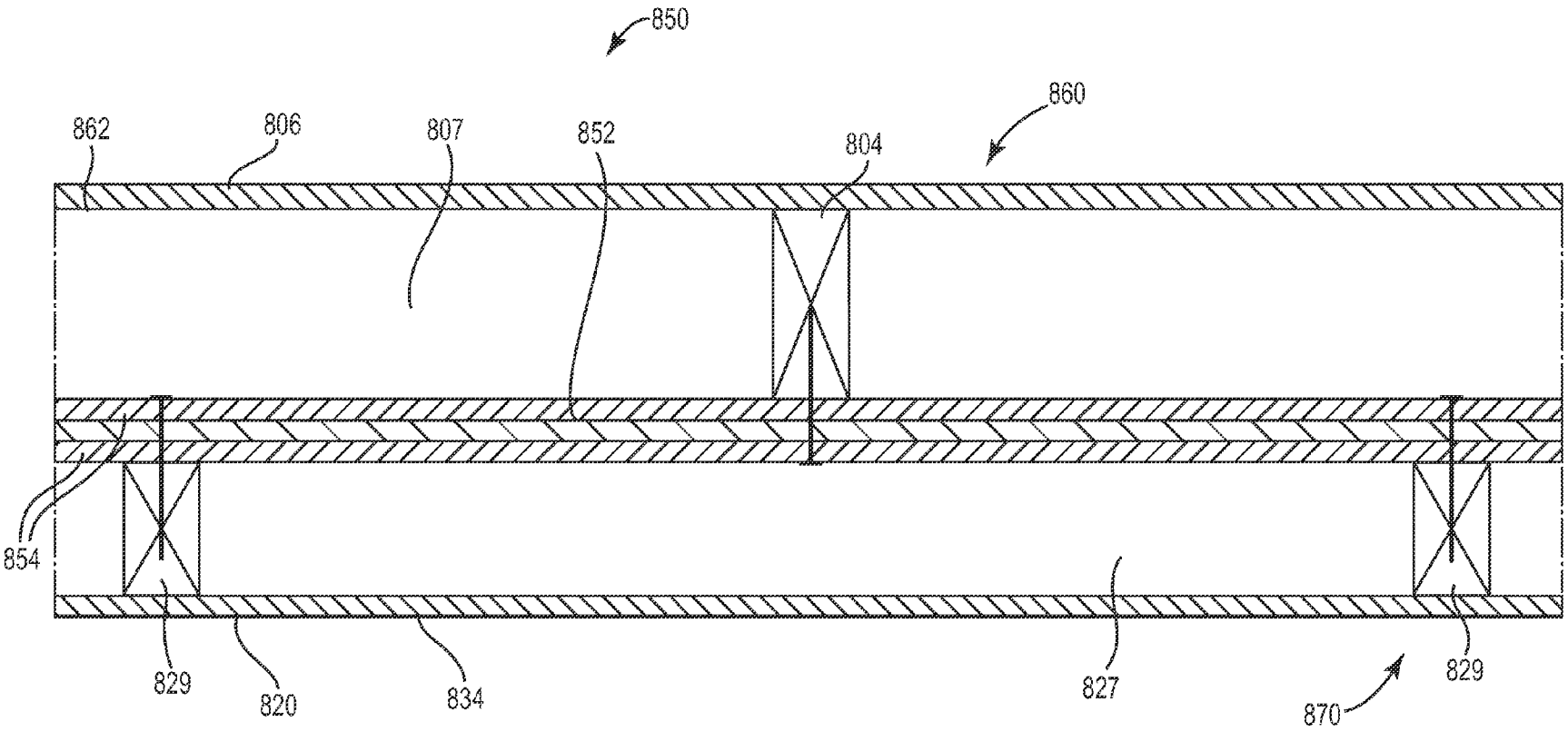
FIG. 28A is a schematic cross-sectional view of a building envelope assembly according to one embodiment.
Figure 28B:
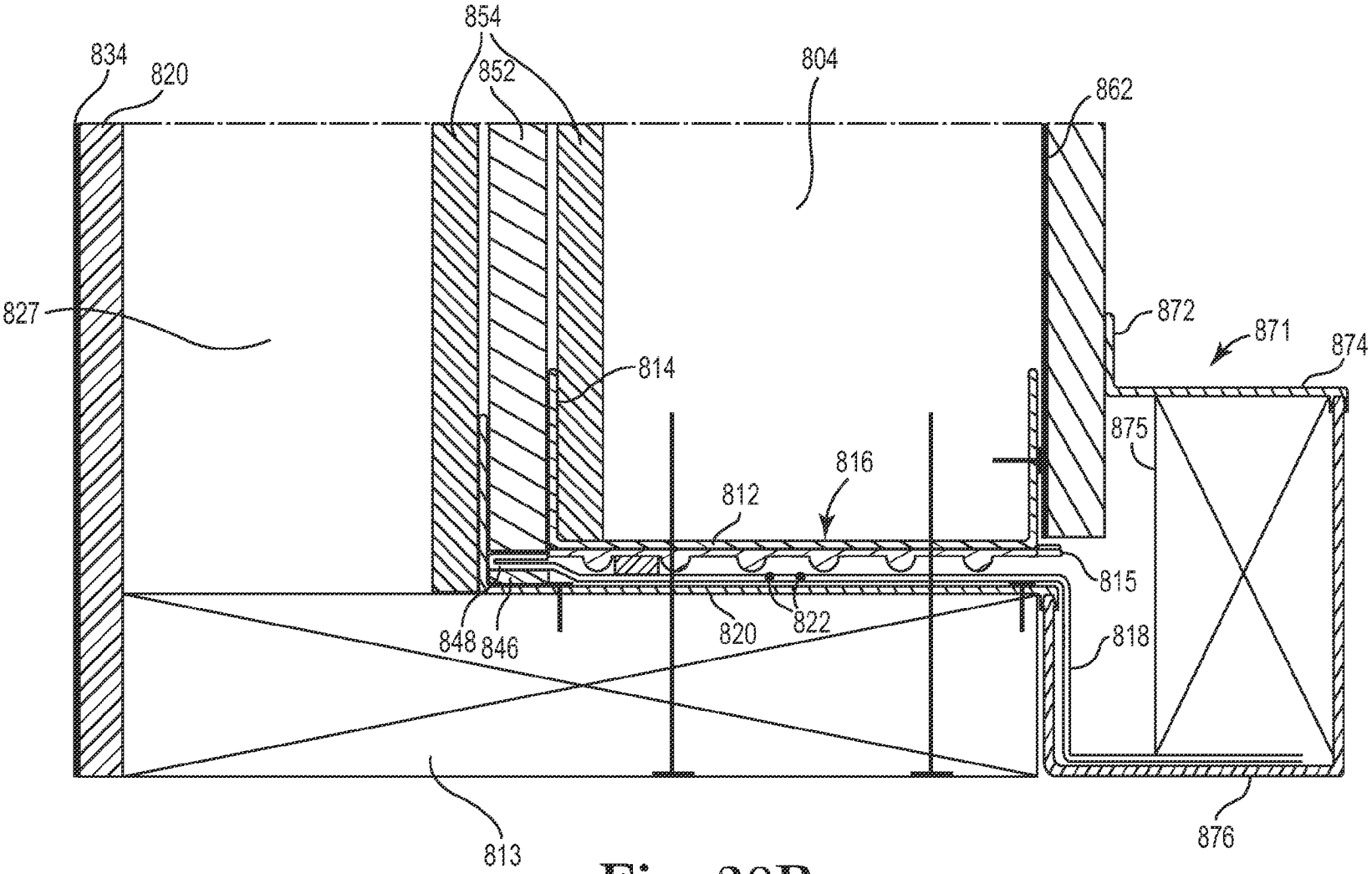
FIG. 28B is a schematic cross-sectional view of the building envelope assembly illustrated in FIG. 28A according to one embodiment.

FIGS. 28A and 28B illustrate a schematic cross-sectional view of a building envelope assembly 850 according to one embodiment. In one embodiment, building envelope assembly 850 includes a drain spacer assembly 816. With continued reference to FIG. 28A, MTS/dry spacer 852 is disposed between sheathing layers 854 of interior load bearing assembly 860 and exterior load bearing assembly 870. In one embodiment, interior load bearing assembly 860 includes exterior sheathing 806, studs 804, and insulation 807 disposed between studs 804. In one embodiment, insulation 807 is fiberglass batt, fiberglass blown-in-blanket, open/closed cell spray polyurethane foam, extruded/expanded rigid polystyrene, or other suitable insulation. In one embodiment, vapor retarder 862 with relative humidity dependent permeance (such as a 2-mil polyamide-6 membrane) is disposed on the interior surface of sheathing 806, adjacent to insulation 807. In one embodiment, stud 804 is a 2×4 wood framing member and stud 829 is a 2×3 wood framing member. In one embodiment, exterior load bearing assembly 870 includes insulation 827, sheathing 820, and vapor permeable water barrier 834. In another embodiment, insulation 827 is extruded rigid polystyrene or closed cell spray polyurethane foam. In one embodiment, studs 804 and 829 and sheathing 854 are load-bearing.

Bottom drain spacer assembly 816 illustrated in FIG. 28B is similar to previous drain spacer assembly embodiments and includes top cap 812 disposed on the bottom edge of stud framing 804. In one embodiment, top cap 812 includes protrusion 815 extending to the exterior of the c-shaped channel. In one embodiment, protrusion 815 prevents vapor barrier 862 and sheathing 806 from blocking moisture wicking sheet 818 into trough 871. Top cap 812 cooperates with base cap 820 to retain a portion of MTS 124 and moisture wicking sheet 118, similar to previous embodiments. In one embodiment, mechanical device 875 (such as a fractional horsepower centrifugal fan) operates to remove moisture transferred into trough 871 by moisture wicking sheet 118.

Figure 29:
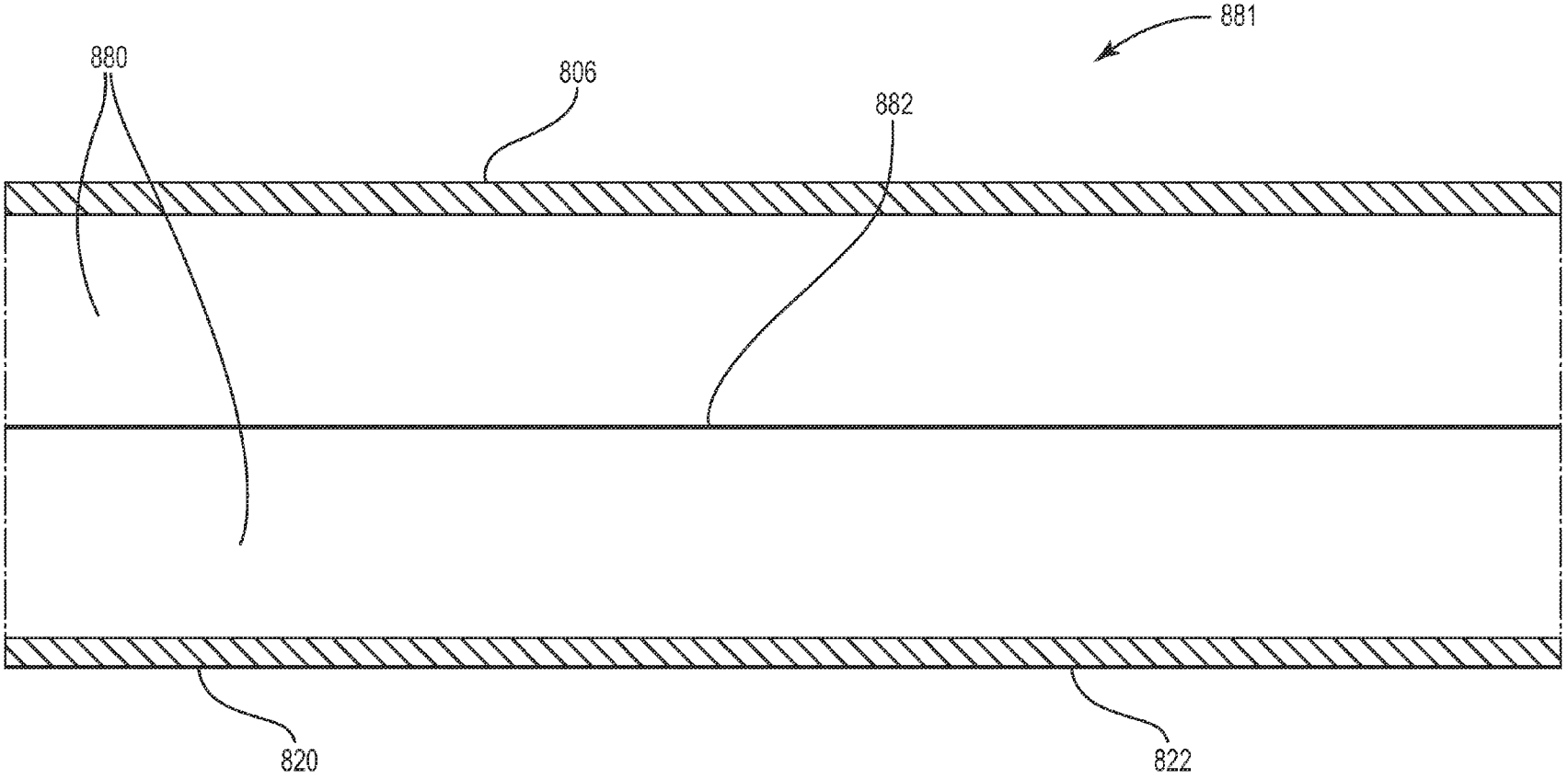
FIG. 29 is a schematic cross-sectional view of a structural insulated panel assembly according to one embodiment.

In another embodiment, the building envelope assembly is a structural insulated panel assembly 881 as illustrated in FIG. 29. In one embodiment, structural insulated panel assembly 881 includes a central membrane 882. In one embodiment, central membrane 882 is a passive dry spacer assembly with rigid insulation board 880 adhered to opposing faces of the membrane 882. In one embodiment, membrane 882 is a synthetic rubber, for example, and rigid insulation 880 is extruded or expanded polystyrene, for example. In one embodiment, membrane 880 is laminated between the two rigid insulation boards 880 using a high strength adhesive. In one embodiment, structural sheathing 806, 820 are adhesively bonded to the outer face of the rigid insulation boards 880. In one embodiment, a vapor permeable water resistant barrier (WRB) 827 is disposed on a structural sheathing board 822.

Figure 30A:
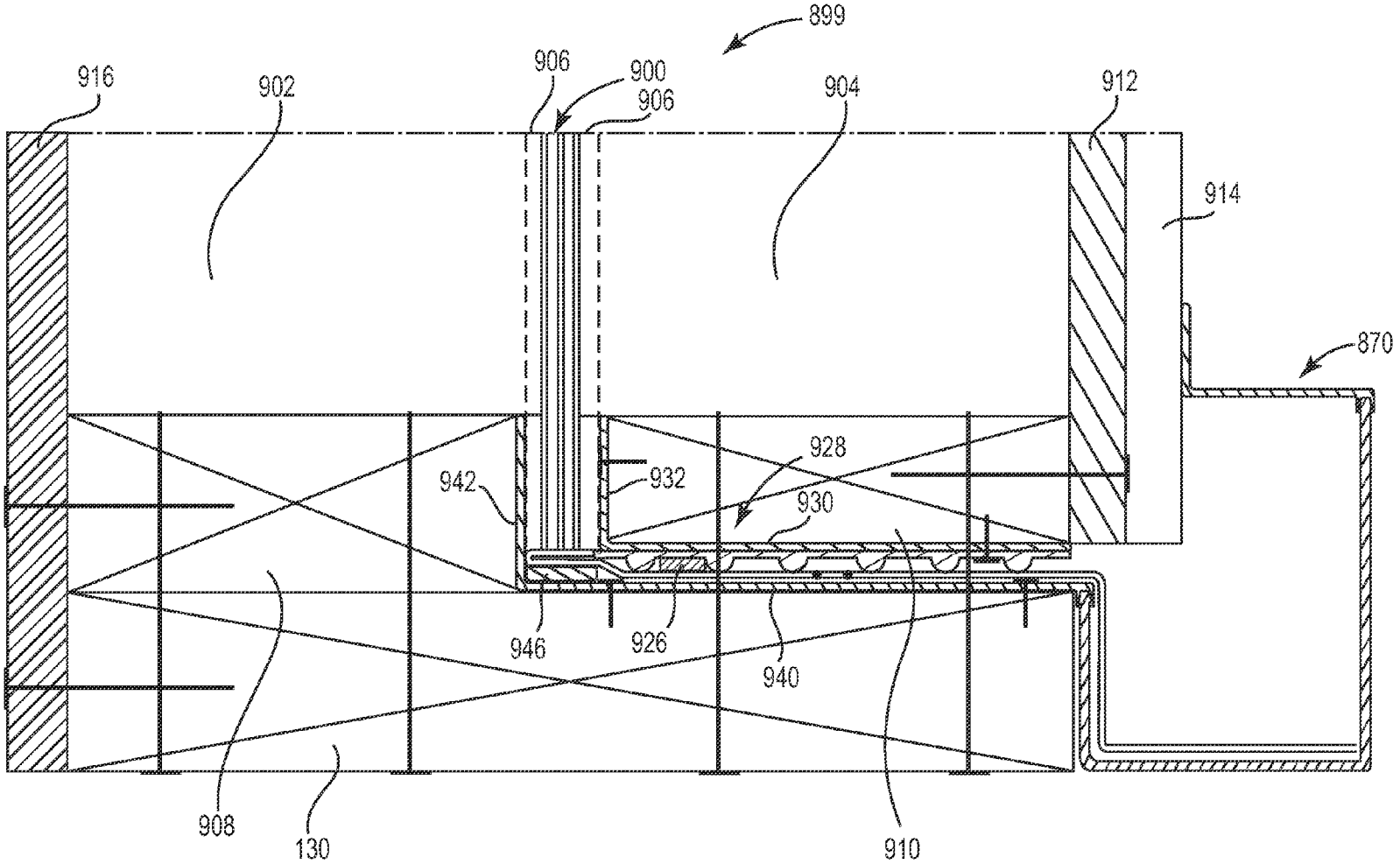
FIG. 30A is a cross-sectional view of a structural insulated panel assembly according to one embodiment.
Figure 30B:
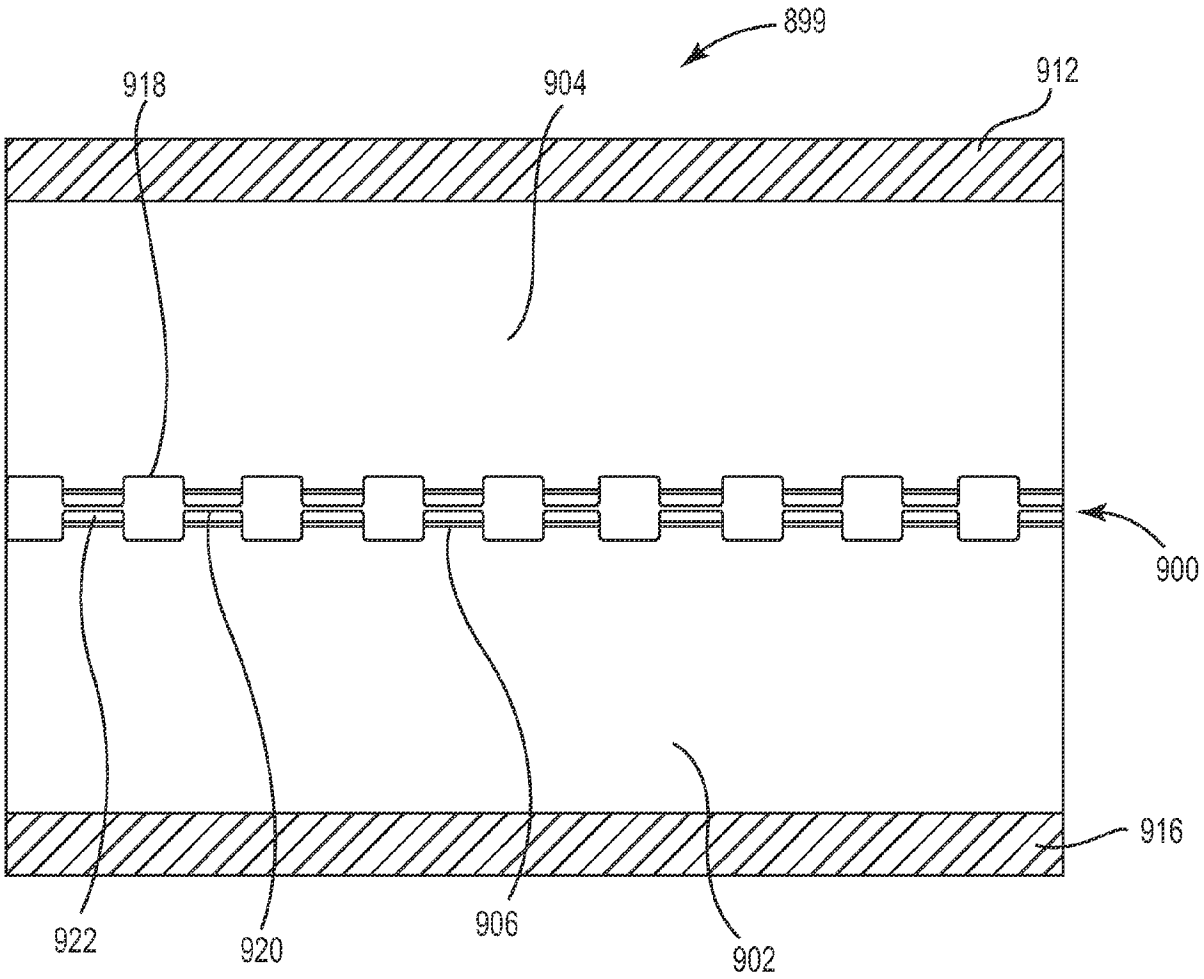
FIG. 30B is a schematic cross-sectional view of the structural insulated panel illustrated in FIG. 30A according to one embodiment.

One embodiment of a building envelope assembly 899 is illustrated in FIGS. 30A and 30B. In one embodiment, assembly 899 is a structural insulated panel and includes a core 900 having at least one flexible sheet 906 having unidirectional dimpling of equal spacing. In one embodiment, sheet 906 is made of polypropylene. In one embodiment, the profiles of two unidirectional dimpled sheets 906 are aligned and the unidirectional dimples 918 oriented to project away from each other in a unified manner. In one embodiment, the unidirectional dimples 918 of the two sheets 906 form generally squared or angular bodies separated by flat length 920. In one embodiment, unidirectional dimples 918 are equally spaced to provide a symmetrical longitudinal channel profile. In one embodiment, unidirectional dimples 918 form vertical channels which transfer structural shear loads within the structural insulated panel 899. In one embodiment, sheets 906 are adhesively joined together at flat lengths 920 although other manners of securing sheets 906 together are also acceptable.

In one embodiment, the profiled sheets 906 are central within the panel 899. In one embodiment, moisture wicking layers 922 are disposed between the unidirectional dimples 918 at the flat lengths 920. On either side of the flexible sheets 906, moisture wicking layers 922, and rigid insulation 902, 904 are attached. In one embodiment, rigid insulation 902, 904 is profiled with longitudinal grooves to fit dimples 918 of flexible sheets 906 while also allowing space for the moisture wicking layers 902. In one embodiment, rigid insulation 902, 904 is expanded or extruded polystyrene. In one embodiment, moisture wicking layer 922 is a non-woven rayon staple, similar to moisture wicking layer 312 described previously, for example. Structural sheathing 912, 916 are adhesively bonded, in one embodiment, to the exterior face of each of the rigid insulation layers 902, 904.

In one embodiment, the structural insulated panels are factory assembled for field assembly into a component of the building envelope. The structural insulated panels may be fabricated in any suitable length for further assembly on the construction site or out of the factory. The structural insulated panels may be assembled with the edges of the panels abutting one another. The structural insulated panels may also be cut to size to fit appropriate applications.

With further reference to FIG. 30A, plates 908, 910 are attached to rigid insulation layers 902, 904, respectively. As further assembled in the field, base 130 is attached to plates 908 and 910 at the bottom of panel 899. In one embodiment, dry spacer 900 extends and terminates between legs 932 and 942, between plates 908 and 910. In one embodiment, plate 908 is a material thickness equal to the combined thickness of plate 910 and drain spacer assembly 928. In one embodiment, the plates 908 and 910 are attached to base 130 and components of drain spacer assembly 928. In one embodiment, structural sheathing 916 and 912 are further secured to plates 908, 910, and base 130. In one embodiment, top plate 930, leg 932, and seal 926 are pre-attached to plate 910 in the factory, while base cap 940, leg 942, seal 946, wicking layer 118, and plate 908 are pre-attached to base 130. In one embodiment, base 130 with pre-assembled attachments, is then mated to plate 910 and sheathing 916 in the field during panel assembly. In one embodiment, an interior finish layer 914 is applied over structural sheathing 912. Drain spacer assembly 928 is similar to that of previous embodiments and, in one embodiment, extends from core 900 to an outside face of the assembly 899. Trough 922 may also be assembled to interior finish where available, or structural sheathing 912, and attached to base plate 940 of drain spacer assembly 928.

Figure 31B:
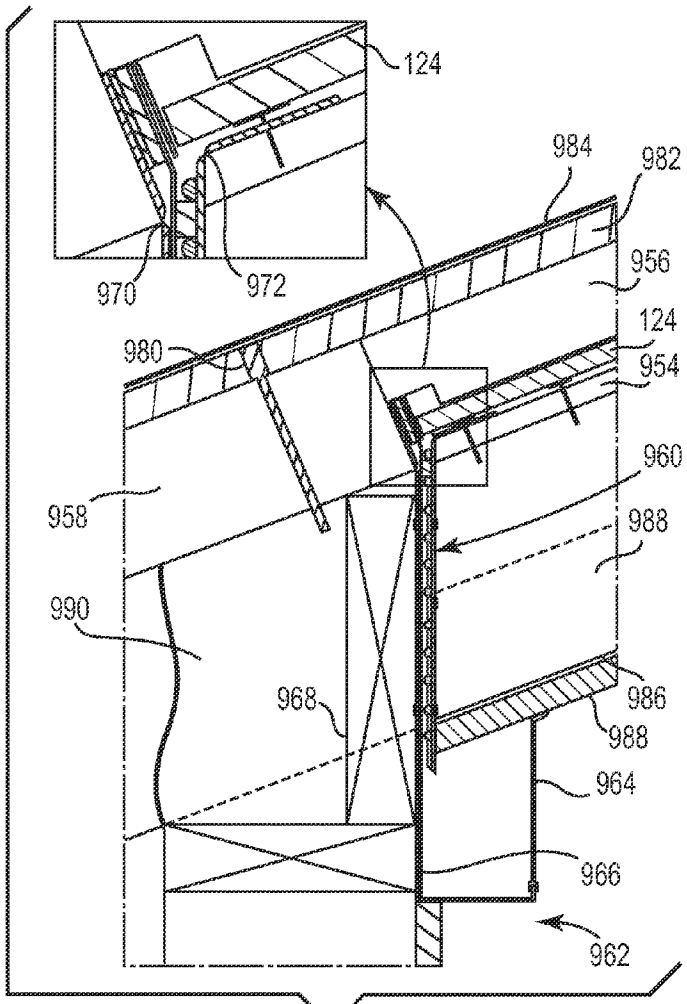
FIG. 31B is a schematic cross-sectional view of the non-vertical building envelope assembly illustrated in FIG. 31A according to one embodiment.
Figure 31A:
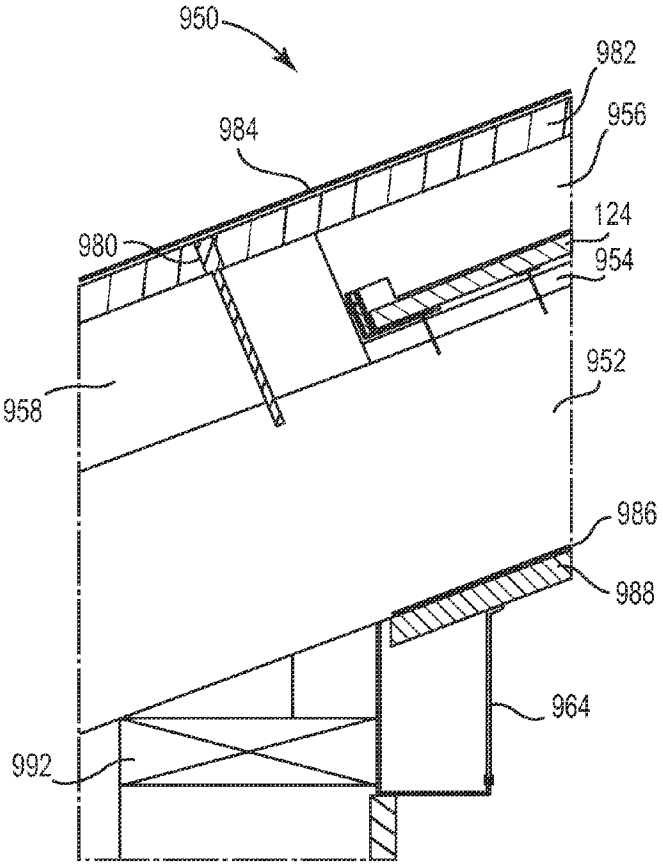
FIG. 31A is a schematic cross-sectional view of a non-vertical building envelope assembly according to one embodiment.

FIGS. 31A and 31B illustrate an embodiment of a non-vertical building envelope assembly 950. In one embodiment, non-vertical system assembly 950 is an element of the building envelope such as a roof. Non-vertical envelope assembly 950 includes many similar elements included in vertical assemblies of previous embodiments. In one embodiment, roof rafter or top cord of truss 952 along with rigid insulation 954 provide underlayment and support for moisture transport system 124. In one embodiment, the structural load of non-vertical building envelope assembly 950 is transferred to a vertical building envelope assembly through trusses 952 on top plate 992.

In one embodiment, a rigid insulation layer 956 is disposed over moisture transfer system 124. Additionally, rigid insulation layer 958 abuts rigid insulation 956 at opposing sides of moisture transport system 124. In one embodiment, rigid insulation 956 is two inch extruded polystyrene and rigid insulation 958 is three inch extruded polystyrene in order that the overall thickness is the same on each side of the moisture transport system 124. In one embodiment, rigid insulation 958 may be comprised of a single layer of rigid insulation or multiple layers of rigid insulation. Similarly, rigid insulation 956 may be a single layer or multiple layers of rigid insulation. In one embodiment, moisture transport system 124 extends to the moisture wicking plate assembly 960. In one embodiment, moisture wicking plate assembly 960 is installed at the juncture of the truss 952 and interior space 962 of the building. In one embodiment, plate assembly 960 extends from MTS 124 to trough 964 at interior space 962. In one embodiment, plate assembly 960 extends in a vertical fashion and moisture wicking transport sheet 966 extends into trough 964. In one embodiment, trough 964 includes an active moisture removal system such as a fan or other mechanical or electrical device or venting method (not shown). In one embodiment, plate assembly 960 is secured to blocking 968. In one embodiment, plate assembly 960 includes movable joint 970 and 972. In one embodiment, moveable joints 970, 972 are flexible in an otherwise rigid plate assembly 960. Joints 970, 972 enable plate assembly 960 to be installed at any angle relative to the moisture transport system 124. For example, a pitch range of 0:12 to 12:1 may be accommodated.

Additionally, fastener 980 secures the roof deck sheathing 982 in a roof application of this assembly. Fastener 980 is described in Provisional Utility Patent Application Ser. No. 61/249,497. In one embodiment, roofing felt 984 is provided over the sheathing 982. In one embodiment, vapor retarder 986 is installed at the interior face of the truss 952. Additionally, sheathing 988 may be installed on the interior face of the vapor barrier 986 with relative humidity dependent permeance (such as a 2-mil polyamide-6 membrane). In one embodiment, insulation 988 is installed between the rafters 952. Insulation 988 may be fiberglass backed insulation, fiberglass blown-in-blanket insulation, extruded/expanded polystyrene, open/closed cell spray polyurethane or other suitable insulation. In one embodiment the roof deck sheathing 982, bounding insulation layers 954 and 956 and drain spacer assembly 124 can be pre-assembled into panels at a manufacturing facility.

Figure 32:
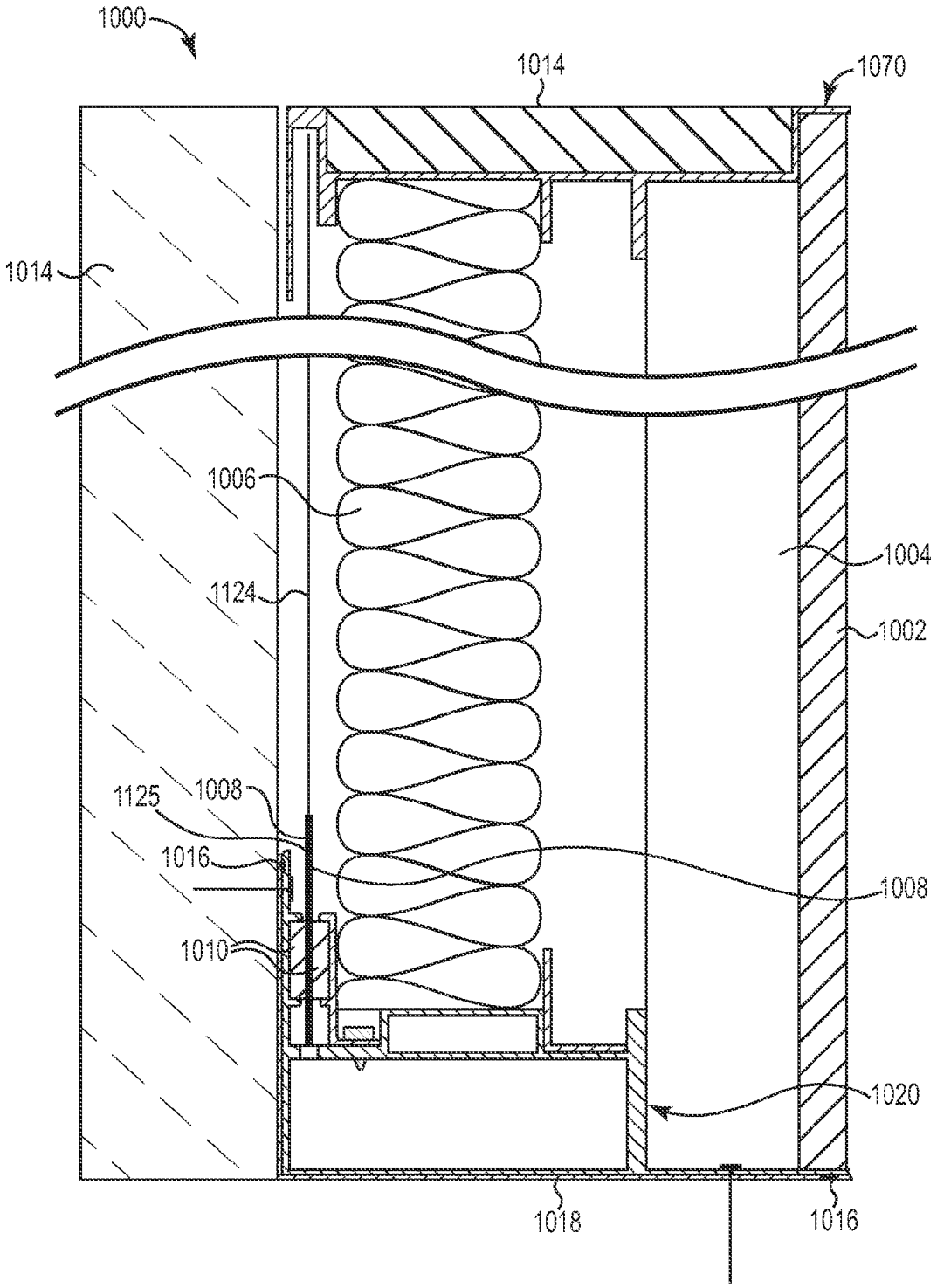
FIG. 32 is a schematic cross-sectional view of a drain assembly and a top plate disposed in a building envelope assembly according to one embodiment.

FIG. 32 illustrates an embodiment of a drain assembly 1020 disposed in a building envelope assembly 1000. Building envelope assembly 1000 includes an interior wall layer 1002, a wall frame 1004, an insulation 1006, a dryspacer or moisture transport spacer 1124 (MTS 1124), and an exterior wall 1014. In one embodiment, exterior wall 1014 is a concrete wall, although exterior wall 1014 may also be a concrete masonry wall or other suitable exterior wall type. In one embodiment, exterior wall 1014 is a subterranean wall, such as a basement or crawl space wall, for example. A moisture wicking sheet 1008 is disposed on at least one side of a bottom portion 1125 of MTS 1124 which terminates within drain assembly 1020.

MTS 1124 includes wicking sheet 1008 attached along bottom portion 1125. Bottom portion 1125 is generally planar. Wicking sheet 1008 provides capillary wicking of moisture along MTS 1124. Similar to wicking layers described in previous embodiments, one suitable material for wicking sheet 1008 includes a non-woven sheet of rayon staple fiber. In one embodiment, wicking sheet 1008 is attached to bottom portion 1125 with an adhesive. In one embodiment, wicking sheet 1008 is adhered to both major faces of bottom portion 1125 and may extend around the bottom edge of MTS 1124. Wicking sheet 1008 may extend the same or different heights of the opposing faces of bottom portion 1125. In one embodiment, wicking sheet 1008 extends 3¼" to 3½" high. Alternatively, wicking sheet 1008 is disposed along only one face of bottom portion 1125. As assembled within building system assembly 1000, bottom portion 1125 is disposed between opposing seals 1010 and terminates within drain assembly 1020.

Drain assembly 1020 is disposed at the base of building envelope assembly 1000 and is configured to receive seals 1010 and bottom portion 1125 of MTS 1124. Seals 1010 are disposed on opposing faces of MTS 1124 within drain assembly 1020. In one embodiment, seal 1010 is a Q-LON material. In one embodiment, Q-LON, manufactured by Schlegel, is ½" wide by ⅜" thick. In one embodiment, seal 1010 is Q-LON compressed within the sealing cavity of drain assembly 1020 to 3/16" on either side of MTS 1124.

Drain assembly 1020 is mechanically attached to at least one of either the exterior wall 1014 or the floor (not shown). In one embodiment, interior wall layer 1002, wall frame 1004, insulation 1006, and MTS 1124 extend fully between drain assembly 1020 and a top channel 1070. Drain assembly 1020 and top channel 1070 will be described in greater detail below with particular reference to FIGS. 33 and 34 respectively.

Top channel 1070 is configured to extend along a top edge of, and secure, interior wall layer 1002, wall frame 1004, insulation 1006, and MTS 1124. In one embodiment, top channel 1070 is configured to provide a transition from a below grade building envelope assembly to an above grade building envelope assembly. In one embodiment, fill 1014 is disposed in a recessed area 1078 of top channel 1070. In one embodiment, fill 1014 is CertainTeed ¾" ProRoc shaftliner type X gypsum board, for example. Other suitable materials, particularly materials which have suitable fire rating to meet applicable building code requirements may also be disposed within recessed area 1078. For example, a wood stud may be used. In an alternative embodiment, a wood stud is installed along the top of building envelope assembly 1000 and top channel 1070 is not used.

Figure 33:
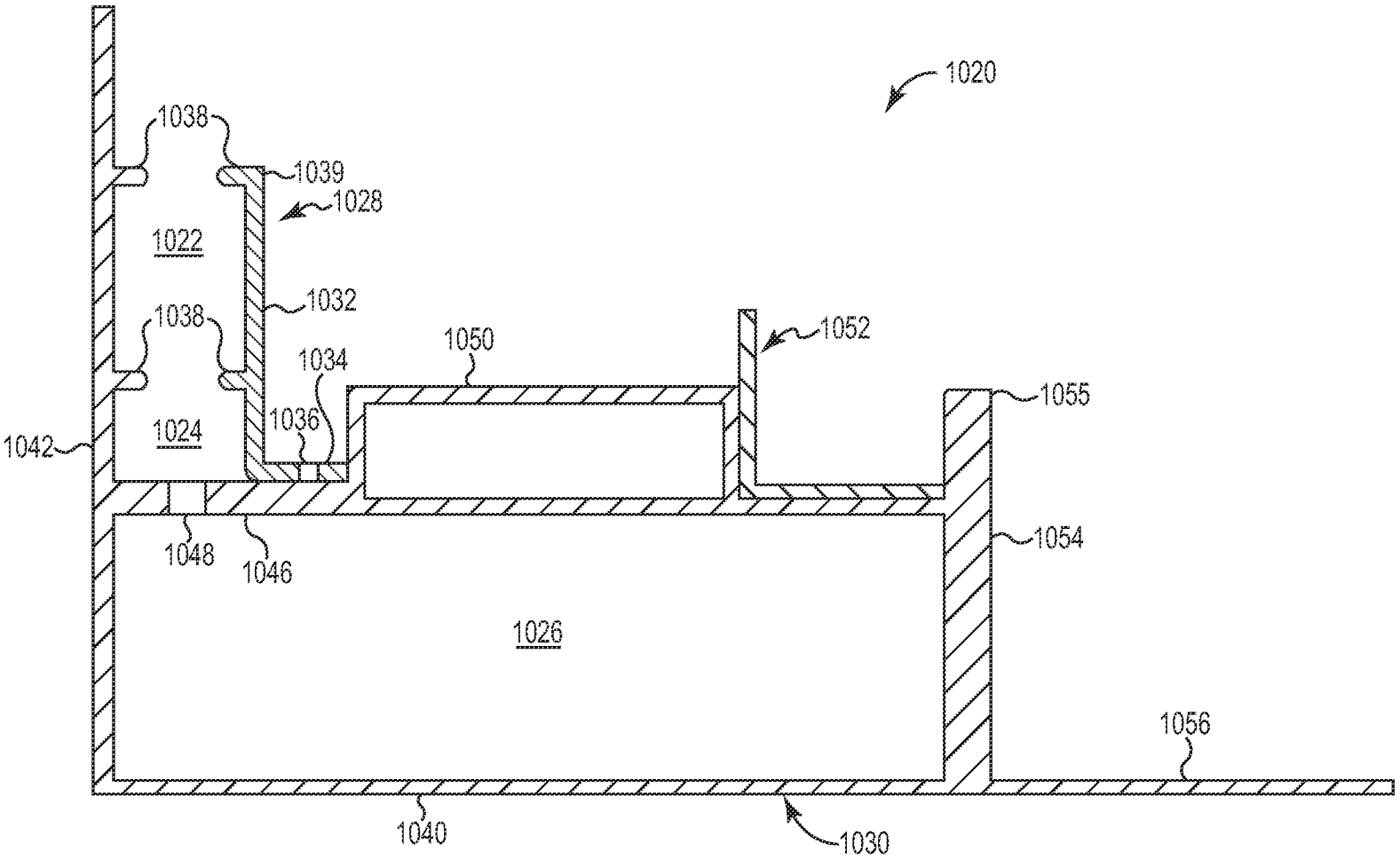
FIG. 33 is a schematic cross-sectional view of a drain assembly according to one embodiment.

FIG. 33 is a schematic cross-sectional view of drain assembly 1020 illustrated in FIG. 32 according to one embodiment. Drainage assembly 1020 includes a sealing cavity 1022, a transfer cavity 1024, and a drainage cavity 1026. Sealing cavity 1022, transfer cavity 1024, and drainage cavity 1026 all fluidly communicate with one another. The cavities of drain assembly 1020 are formed by a seal retainer clip 1028, as a first member, in combination with a base 1030, as a second member.

Seal retainer clip 1028 includes a first leg 1032 joined with a second leg 1034 at a right angle. Second leg 1034 functions as a fastening leg onto base 1030. Seal retainer clip 1028 is attached to base 1030 with a fastening mechanism such as a screw, for example, inserted through a hole 1036 in second leg 1034. First leg 1032 includes seal stops 1038 which extend in a direction opposite to that of second leg 1034. First leg 1032 includes two seal stops 1038, a first seal stop 1038 positioned at a terminal end 1039 of first leg 1032 and a second seal stop 1038 positioned along first leg 1032 between the first seal stop 1038 and second leg 1034. Seal stops 1038 are positioned along first leg 1032 and extend a distance suitable to secure seals 1010 when assembled with base 1030. In one embodiment, seal stops 1038 each extend ⅛" from first leg 1032 and are positioned with a distance of ¾" between the seal stops 1038. In one embodiment, first leg 1032 has a length of 1¼" and second leg 1034 has a length of ½".

Base 1030 includes a bottom plate 1040 and a vertical leg 1042. Vertical leg 1042 is joined with bottom plate 1040 at a right angle. Vertical leg, or face plate 1042, forms one side of sealing cavity 1022, transfer cavity 1024, and drainage cavity 1026. Sealing cavity 1022, transfer cavity 1024, and drainage cavity 1026 are configured in a serial configuration along vertical leg 1042. Vertical leg 1042 includes two seal stops 1038 which correspond and align with the seal stops 1038 of seal retainer clip 1028 when assembled together. Sealing cavity 1022 is formed between seal stops 1038 of vertical leg 1042 in combination with seal retainer clip 1028. Likewise, transfer cavity 1024 is formed between seal retainer clip 1028 and vertical leg 1042. Base 1030 also includes a horizontal member 1046 having a series of openings 1048 adjacent to vertical leg 1042. In one embodiment, openings 1048 are positioned in a series along a center space between vertical leg 1042 of base 1030 and first leg 1032 of seal retainer clip 1028. Horizontal member 1046 forms a bottom surface of transfer cavity 1024 as well as a top surface of drainage cavity 1026. Openings 1048 provide fluid communication between transfer cavity 1024 and drainage cavity 1026.

A raised platform 1050 is configured on horizontal member 1046 and is, in one embodiment, channel shaped. Raised platform 1050 may support insulation 1006 when assembled within the building envelope assembly 1000, as illustrated in FIG. 32. In one embodiment, drain assembly 1020 includes an insulation retaining clip 1052. Insulation retaining clip 1052 is formed as an angled clip. Insulation retaining clip 1052 may be coupled to horizontal member 1046 with a mechanical fastener, adhesively, or formed integrally as part of base 1030. Insulation retaining clip 1052 is positioned between raised platform 1050 and a stud stop 1054. Stud stop 1054 forms an opposing side to drainage cavity 1026 from vertical leg 1042 and extends from bottom plate to horizontal member 1046 and terminates at an end 1055. A stud flange 1056 is formed as part of bottom plate 1040 on an opposing side of stud stop 1054 from drainage cavity 1026. In one embodiment, stud flange 1056 extends such that wall frame 1004 and interior wall layer 1002 are positionable to rest on stud flange 1056.

While the dimensions of drain assembly 1020 may vary, in one embodiment, the length of bottom plate 1040 is approximately 5" and the height of vertical leg 1042 is approximately 3". In one embodiment, drain assembly 1020 is extruded from plastic material such as polyethylene or polyvinyl chloride (PVC). The material thickness of elements of drain assembly 1042 may vary depending on the structural requirements of the various elements.

Figure 34:
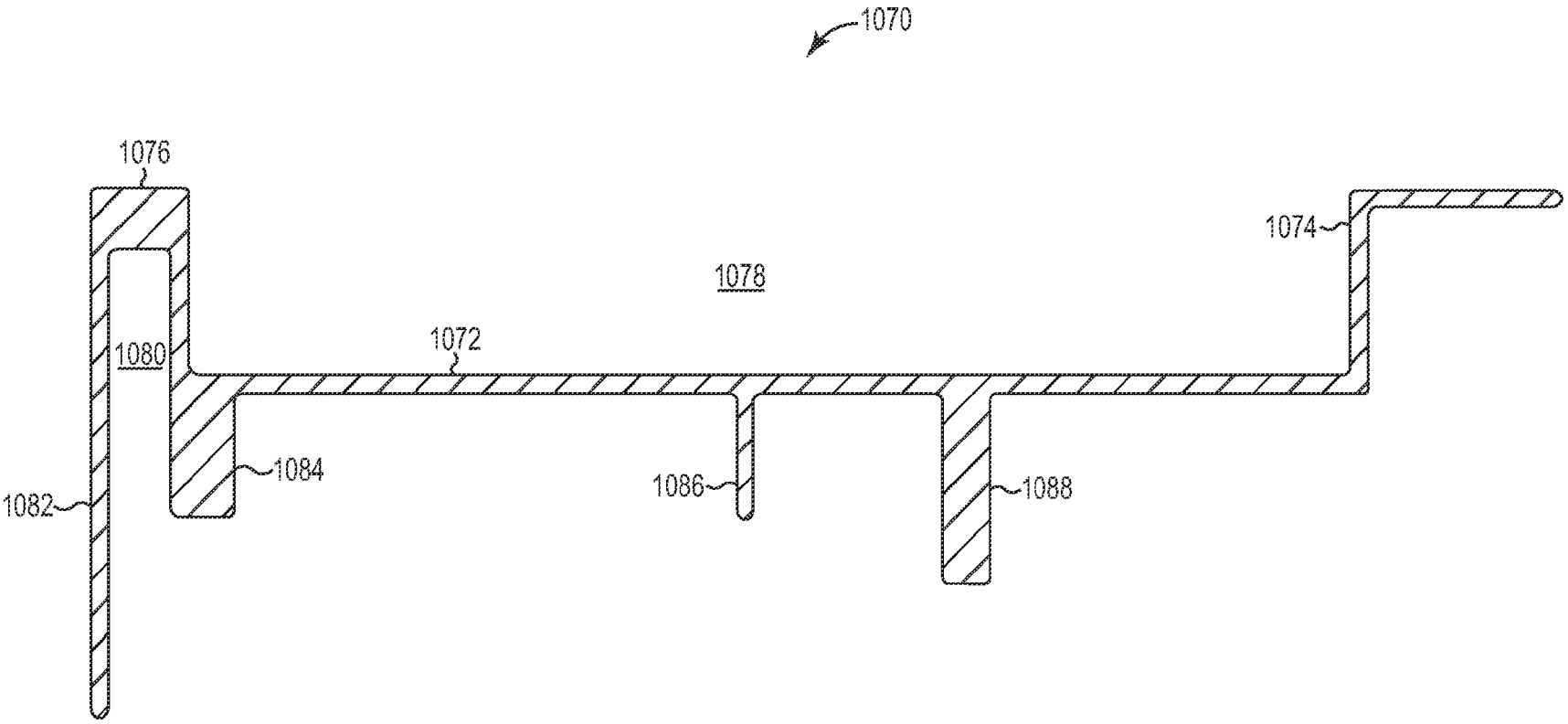
FIG. 34 is a schematic cross-sectional view of a top plate according to one embodiment.

FIG. 34 is a schematic cross-sectional view of top channel 1070 of FIG. 32 according to one embodiment. Top channel 1070 includes a plate 1072 extending between an angled receiver 1074 and a channel receiver 1076. Recessed area 1078 is formed between angled receiver 1074 and channel receiver 1076 with plate 1072 forming a lower surface of recessed area 1078. Angled receiver 1076 is suitable to receive a top edge of interior wall layer 1002, as illustrated in FIG. 32. Channel receiver 1076 includes a channel interior 1080 formed between a first extension 1082 and a second extension 1084. Channel interior 1080 is suitable to receive MTS 1124, as illustrated in FIG. 32. In one embodiment, the lower surface of plate 1072 also includes a third extension 1086 and a fourth extension 1088. Each of the extensions 1082-1088 extends perpendicularly to plate 1072 in the same direction. In one embodiment, as illustrated in FIG. 32, wall frame 1004 is secured within building assembly 1000 with fourth extension 1088 of top channel 1070 and stud stop 1054 of bottom base 1030 assembled along the same vertical plane. Third extension 1086 provides a top track for insulation 1006.

Figure 35B:
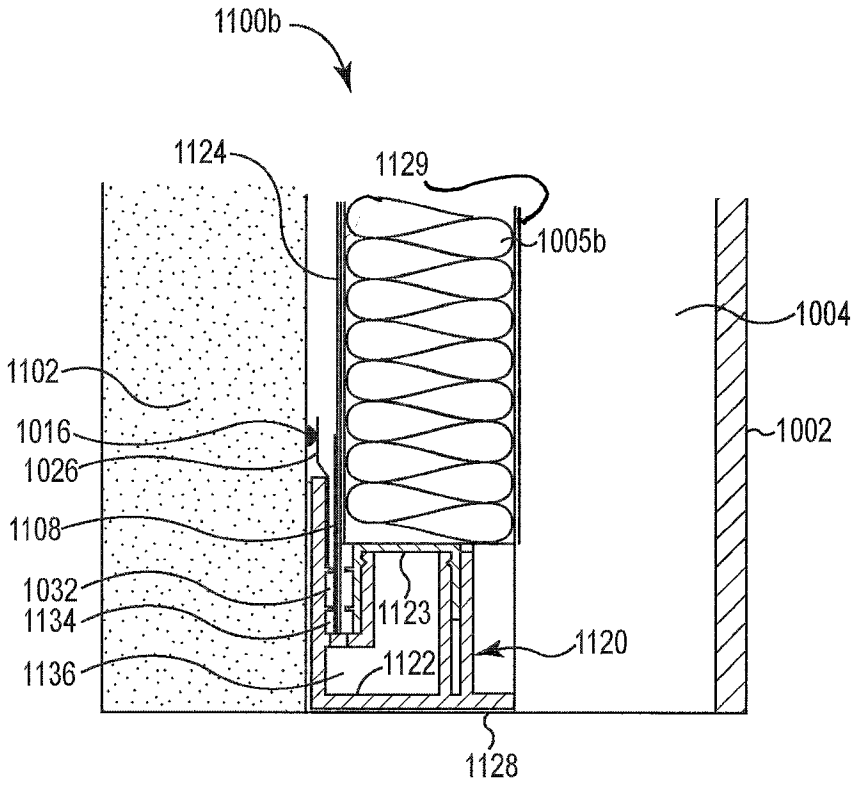
FIGS. 35A through 35B are schematic cross-sectional views of a drain assembly disposed in a building envelope assembly according to one embodiment.
Figure 35A:
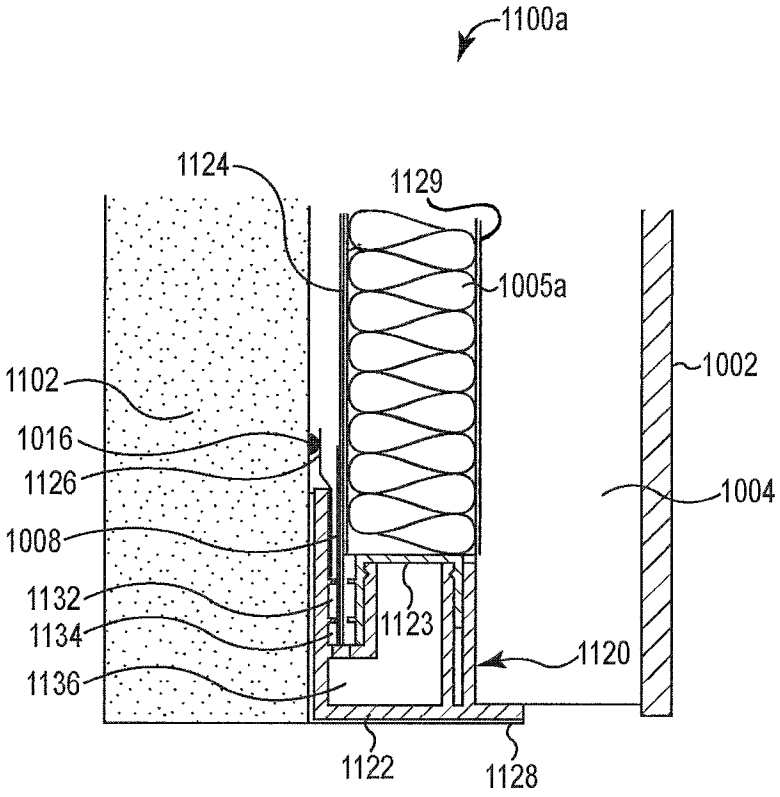

FIGS. 35A and 35B are embodiments of drain assembly 1120 disposed in building envelope assemblies 1100*a*, 1100*b*. Building envelope assemblies 1100*a*, 1100*b* include interior wall layer 1002, wall frame 1004, insulation 1005*a* or 1005*b*, MTS 1124, and an exterior wall system 1102, similar to building envelope assembly 1000 illustrated in FIG. 32. MTS 1124 extends between insulation 1005*a* or 1005*b* and exterior wall system 1102 and terminates within drain assembly 1120. Vapor retarder 1129 extends between semi-rigid board insulation 1005*a* or 1005*b* and wall frame 1004. Vapor retarder 1129 may have an ASTM E96A permeance of not greater than 0.8 perm and an ASTM E96B permeance of not less than 0.3 perm, for example. A drain assembly 1120 is disposed at a base of building envelope assembly 1100*a*, 1100*b*.

FIG. 35A illustrates building envelope assembly 1100*a* with a 2" semi-rigid board insulation 1005*a*. FIG. 35B illustrates building envelope assembly 1100*b* including a 3" semi-rigid board insulation 1005*b*. Accordingly, the position of wall frame 1004 horizontally with respect to the drain assembly 1120 is different in each embodiment. In one embodiment, wall frame 1004 includes 2"×3" studs at 24" on center. Drain assembly 1120 is formed with first member 1122 coupled to second member 1123 as further described in detail below with respect to FIG. 36. Drain assembly 1120 forms a sealing cavity 1132, a transfer cavity 1134, and a drainage cavity 1136. Seals 1010 are disposed within sealing cavity 1132 (not shown).

In one embodiment, exterior wall system 1102 is a concrete wall. A water seal 1126 is disposed along exterior wall system 1102 above drain assembly 1120 and extends into drain assembly 1120. Water seal 1126 is secured to exterior wall system 1102 and is configured to direct moisture running along the interior surface of exterior wall system 1102 to within drain assembly 1120. Sealant 1016 adheres water seal 1126 to exterior wall system 1102. A waterproofing membrane 1128 is disposed between drain assembly 1120 and exterior wall system 1102 and a floor system (not shown) to seal the joint from moisture entering from the exterior between exterior wall system 1102 and the floor system. Water seal 1126 and waterproofing membrane 1128 are ethylene propylene diene monomer rubber (EPDM) or other suitable material.

Figure 36:
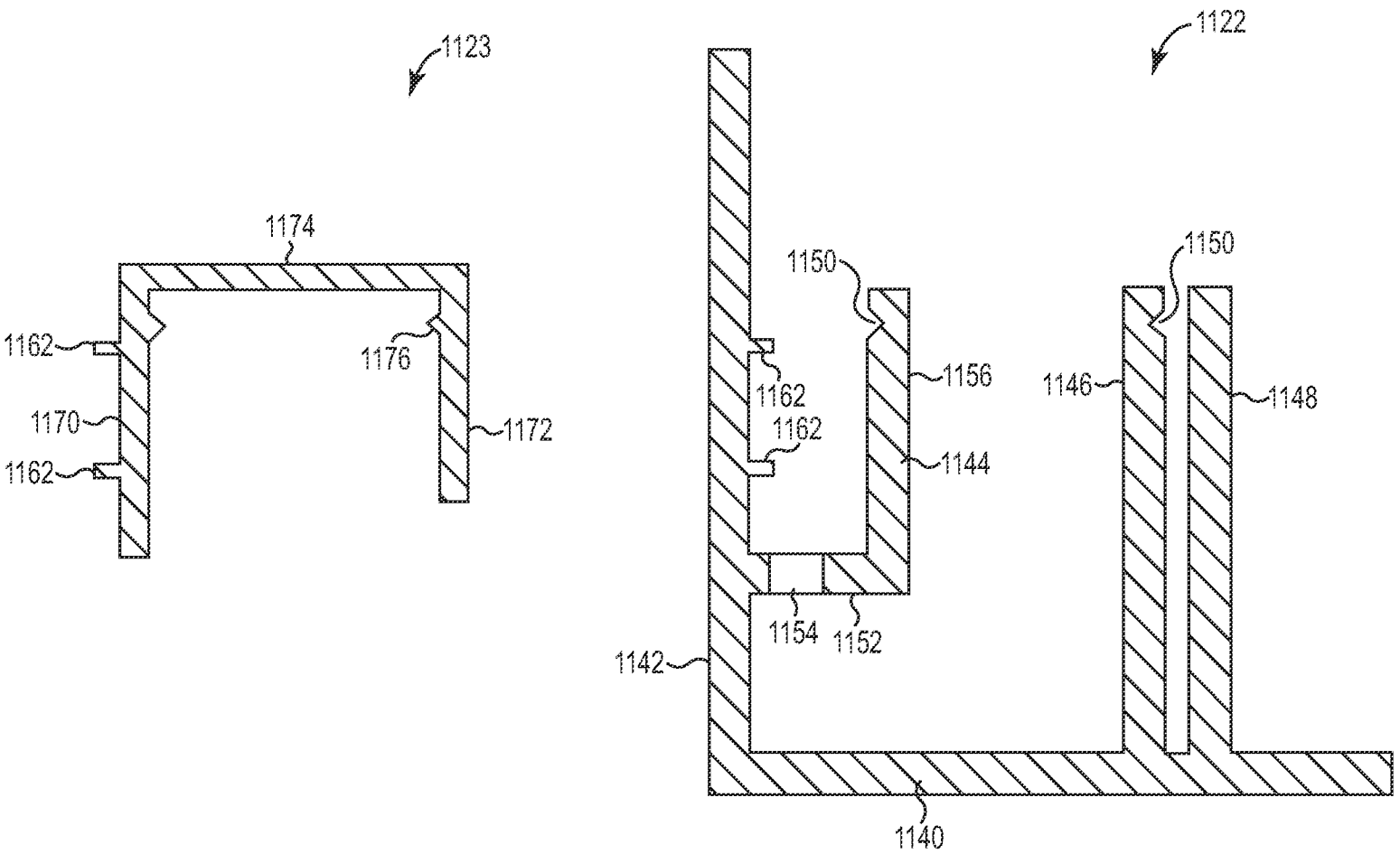
FIG. 36 is a schematic cross-sectional view of a drain assembly illustrated in FIGS. 35A and 35B according to one embodiment.

FIG. 36 is a schematic cross-sectional view of drain assembly 1120 illustrated in FIGS. 35A and 35B. First member 1122 includes a bottom plate 1140, a vertical leg 1142, an angled leg 1144 and parallel retaining flanges 1146 and 1148. Parallel retaining flanges 1146 and 1148 extend vertically from bottom plate 1140 and are spaced from vertical leg 1132 to form drainage cavity 1136. Angled leg 1144 extends as a cantilever with respect to vertical member 1142. Angled leg 1144 includes a horizontal portion 1152 and an upright portion 1156. Horizontal portion 1152 includes holes 1154. In one embodiment, upright portion 1156 includes a notch 1150 on a surface facing vertical member 1142. Upright portion 1156 of angled leg 1144 terminates a distance from bottom plate 1140 substantially equal to the distance that retaining flanges 1146 and 1148 terminate from bottom plate 1130. At least one of retaining flanges 1146 and 1148 include a notch 1150 disposed on a surface between retaining flanges 1146 and 1148. Vertical member 1142 includes seal stops 1162. Seal stops 1162 are positioned within the cavity formed between angled leg 1144 and vertical member 1142. Retaining flanges 1146 and 1148 are positioned along bottom plate 1140 such that a wall frame, in some embodiments, is positionable adjacent to the exterior retaining flange 1148 and along an end portion of bottom plate 1140, as illustrated in FIGS. 35A and 35B.

Second member 1123 is configured to be assembled with first member 1122. In one embodiment, second member 1123 is formed as a U-shaped cap. Second member 1123 includes opposing first and second legs 1170, 1172 extending from opposing ends of a top plate 1174. Second leg 1172 includes a ridge 1176 which correspondingly mates with notch 1150 of first member 1122. First leg 1170 includes two seal stops 1162 which, when assembled with first member 1122, align with the seal stops 1162 of vertical member 1142 and end of leg 1170 is positioned against upright portion 1156. Leg 1172 is coupled between the retaining flanges 1146 and 1148. In this manner, first member 1122 and second member 1123 form drainage cavity 1136 with top plate 1174 forming the upper portion of drainage cavity 1136. Also in this manner, sealing cavity 1122 and transfer cavity 1134 are formed with first leg 1170 of second member 1123 in conjunction with first member 1122, as illustrated in FIGS. 37A through 37C.

Figure 37A:
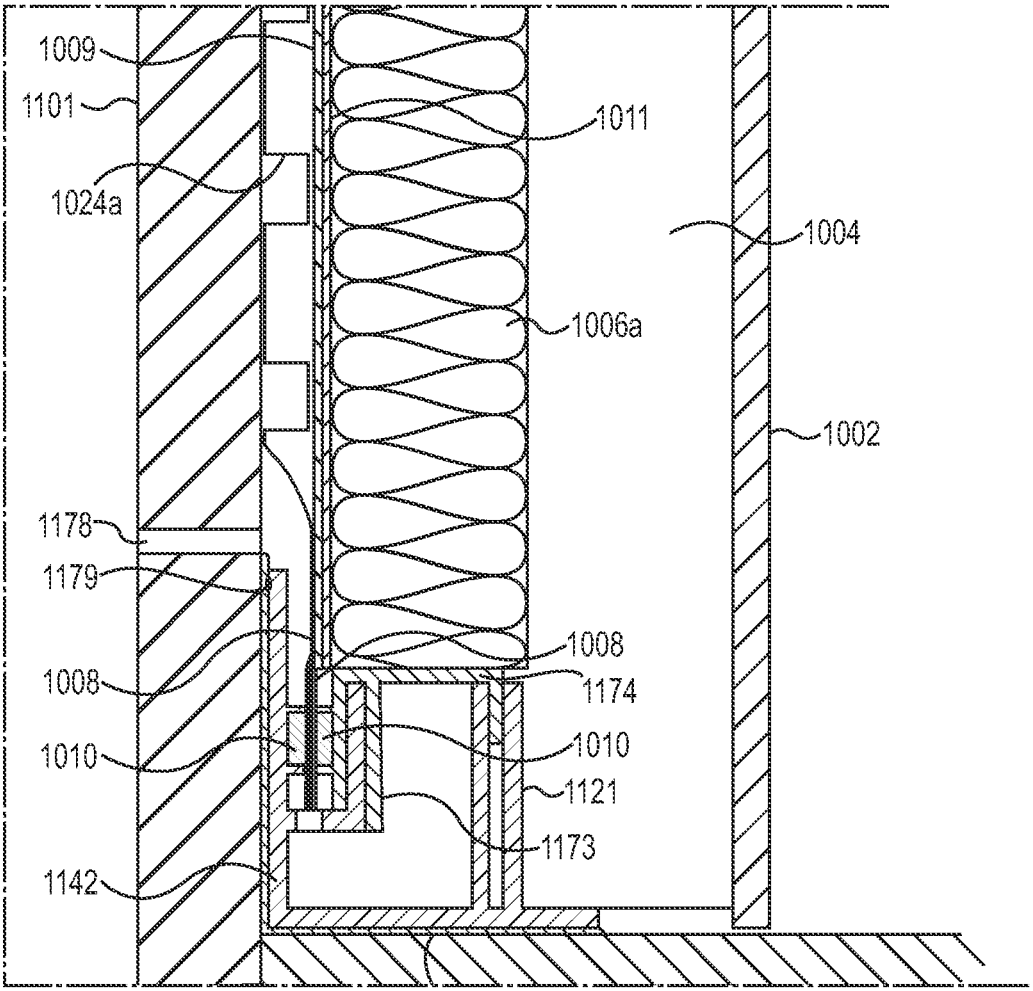
FIG. 37A through 37C are cross-sectional views of a drain assembly disposed in a building envelope assembly.
Figure 37B:
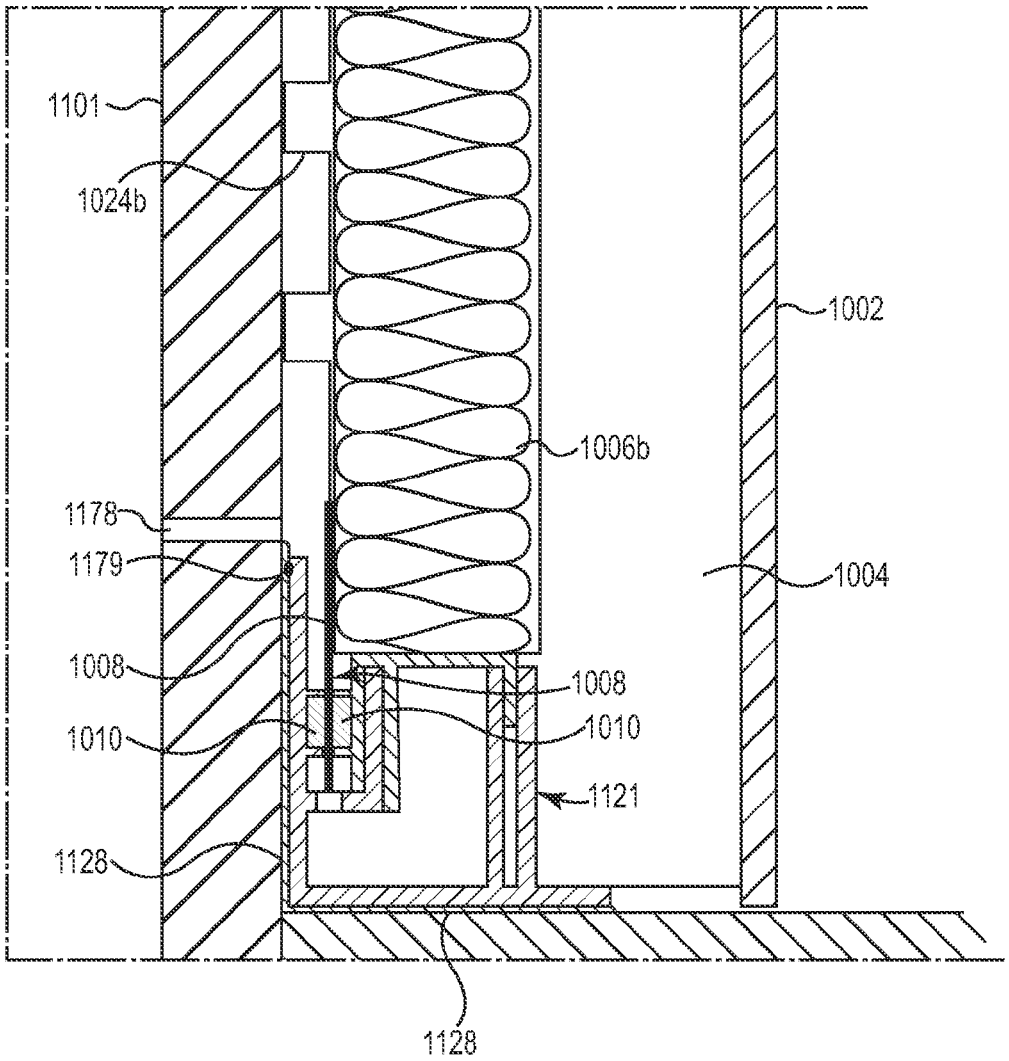
Figure 37C:
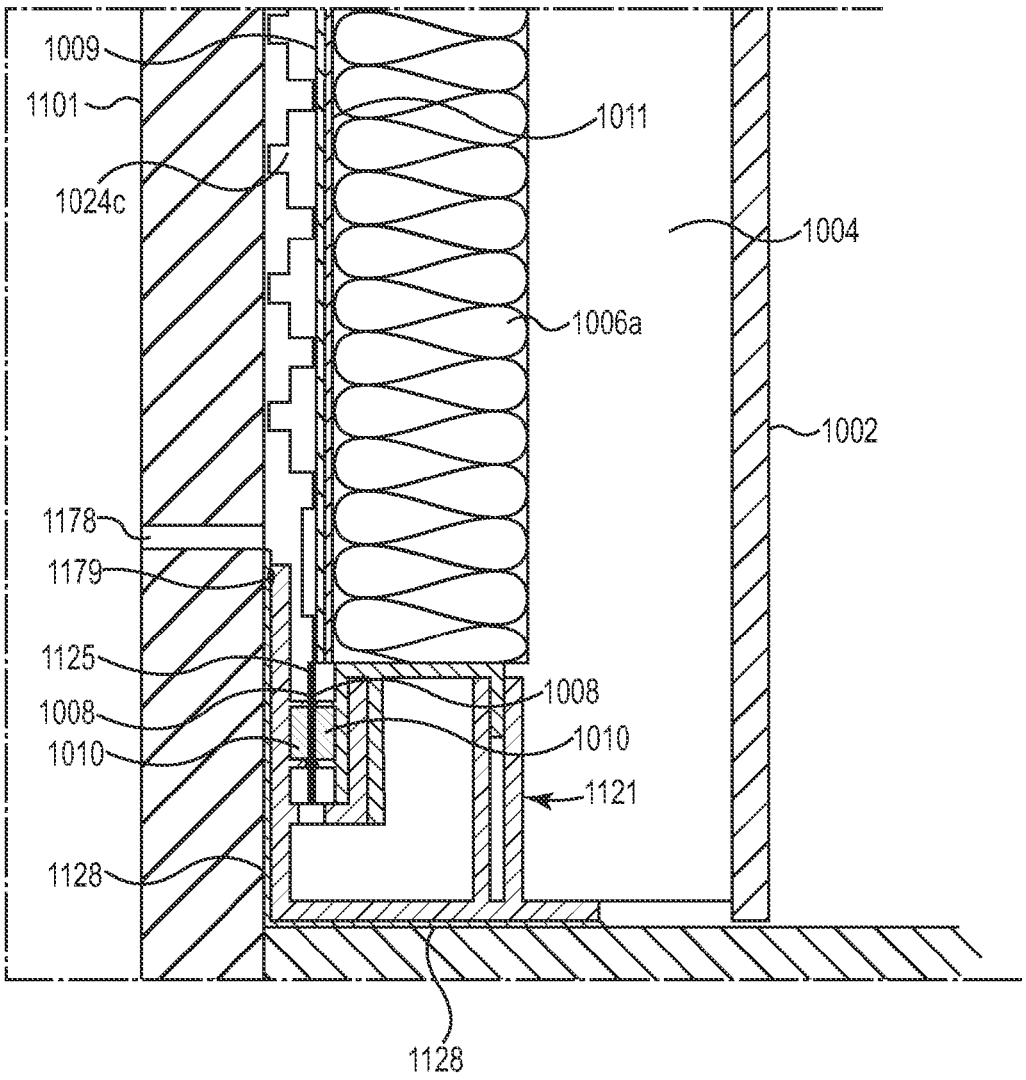

FIGS. 37A through 37C are embodiments of drain assembly 1121 disposed in a building envelope assembly. The embodiments of FIGS. 37A through 37C are particularly applicable to below grade, or subterranean, drain assembly installation although may also be above grade. Either drain assembly 1120 or drain assembly 1121 is equally suitable in these embodiments. Drain assembly 1121 is similar to drain assembly 1120 and further includes third leg 1173 extending parallel to second leg 1172 and spaced apart from second leg 1172 such that upright portion 1156 of first member 1122 is position between second leg 1172 and third leg 1173 when assembled.

FIG. 37A includes MTS 1124*a* which is formed with an interior gap (i.e., dimples or other protrusions extending towards the interior and a main surface disposed along exterior wall 1101). Exterior wall 1101 is a masonry block wall or a concrete wall. Exterior wall 1101 formed as a masonry block wall includes weep holes 1178 configured to allow liquid, such as water, accumulated within the masonry block cavities of exterior wall 1101 to drain into drain assembly 1121. Weep holes 1178 are drilled on the interior side of exterior wall 1101 above drain assembly 1121. Drain assembly 1121 is installed on top of the waterproofing membrane 1128 and mechanically fastened to the exterior wall 1101 and floor. Waterproofing membrane 1128 is adhered to exterior wall 1101 and the floor to prevent exterior water penetration from below the floor slab. Additionally, sealant 1179 is disposed between waterproofing membrane 1128 and vertical leg 1142 of drain assembly 1121. In this manner, moisture entering the building envelope assembly from weep hole 1178 is channeled into drain assembly 1121.

MTS 1124*a* includes wicking sheet 1008 disposed on bottom portion 1125 of MTS 1124*a* which extends from the transfer cavity 1134 to a suitable height. Seals 1010 are assembled on both sides of bottom portion 1125 to secure the MTS 1124*a* within drain assembly 1121. In one embodiment, the planar bottom portion 1125 is positioned to terminate at top plate 1174 of drain assembly 1121 and insulation 1006*a* extends to above top plate 1174. In one embodiment, a nylon mesh 1009 and a rayon staple 1011 are adhered to the dimples/protrusions of MTS 1124 and insulation 1006*a* is applied as a spray foam insulation. Nylon mesh 1009 and rayon staple 1011 provide a drainage plane within the wall assembly and a surface for which spray foam insulation 1006*a* can be applied.

In one embodiment, wherein exterior wall 1101 is formed as a masonry block wall, moisture is transported only along an interior side of MTS 1124 above the bottom dimple and then transported along both sides of MTS 1124 below the bottom dimple. In this manner, fluid entering the wall assembly from weep hole 1178 is transported into drain assembly 1121 as well as moisture from the interior side of MTS 1124. In one embodiment, wherein exterior wall 1101 is formed as a concrete wall, moisture is transported only along an interior side of MTS 1124.

FIG. 37B illustrates MTS 1124*b* including protrusions extending toward exterior wall 1101, (i.e., having a major face adjacent to insulation 1006*b*), thus oppositely disposed to the embodiment illustrated in FIG. 37A. Alternatively, MTS 1124*b* is generally planar sheet attached to exterior wall 1101 including bottom portion 1125 which extends away from exterior wall 1101 above weep hole 1170 to allow for drainage of fluid from within exterior wall 1101. In this embodiment, insulation 1006*b* is a non-permeable board insulation. Insulation 1006*b* abuts MTS 1124*b*. Similar to the FIG. 37A embodiment, waterproofing membrane 1128 is installed along exterior wall 1101 and floor between the exterior wall and floor and the drain assembly 1120. Waterproofing membrane 1128 is disposed below weep hole 1170 and extends approximately to the end of the bottom plate 1140 or further. In this embodiment, moisture is transported only on an exterior side of MTS 1024*b* when exterior wall 1101 formed as either a concrete or masonry block wall.

FIG. 37C illustrates embodiment of MTS 1124*c* having interior and exterior gaps (i.e. protrusions/dimples formed to extend toward both the interior and exterior of the wall system). Moisture is transported along both the interior and exterior sides of MTS 1024*c*. Exterior wall 1101 may be formed as either a concrete or masonry block wall, for example. In one embodiment, MTS 1124*c* includes dimples projecting along both faces of MTS 1124*c* and having a bottom dimple which will terminate at the bottom of the insulation 1006. In one embodiment, nylon mesh 1009 and rayon staple 1011 are adhered to the interior dimples of MTS 1124. Insulation 1006*a*, in one embodiment, is a spray foam insulation which is applied to the nylon mesh 1009 and rayon staple 1011. Wicking sheet 1008 of MTS 1124 extends from the lower portion of the last dimple on MTS 1124 along a flat bottom portion 1125. In one embodiment, MTS 1124 includes dimples only on the interior at the lower portion in order that weep hole 1178 of exterior wall 1101 is not blocked. Weep holes 1178 are drilled through the block shell to allow any buildup of liquid inside the exterior block to drain out. In this manner, liquid accumulated in the core of the masonry blocks is allowed to drain into drain assembly 1121. Wicking sheet 1008 on bottom portion 1125 adjacent to the insulation 1006*a* terminates below insulation 1006*a*. In one embodiment, wicking sheet 1008 extends further on the opposing face of bottom portion 1125.

Figure 38B:
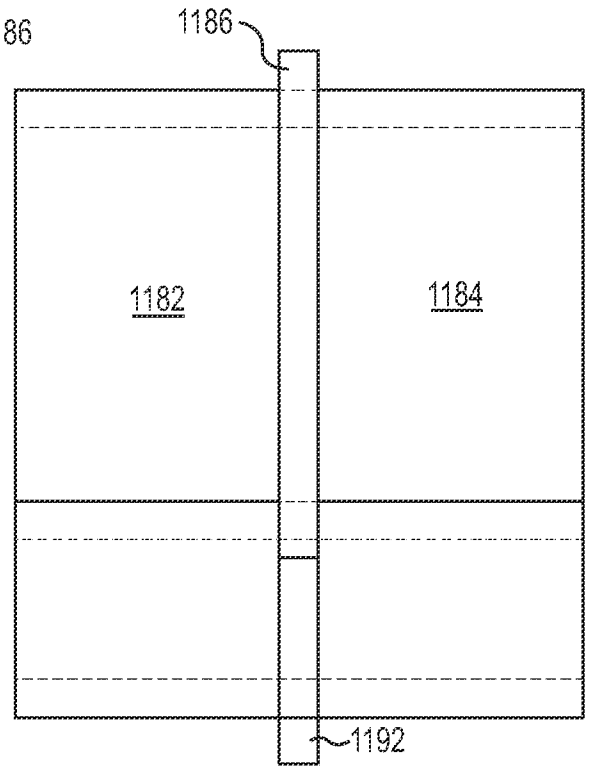
FIG. 38B is a schematic top view of the drain assembly coupler illustrated in FIG. 38A.
Figure 38A:
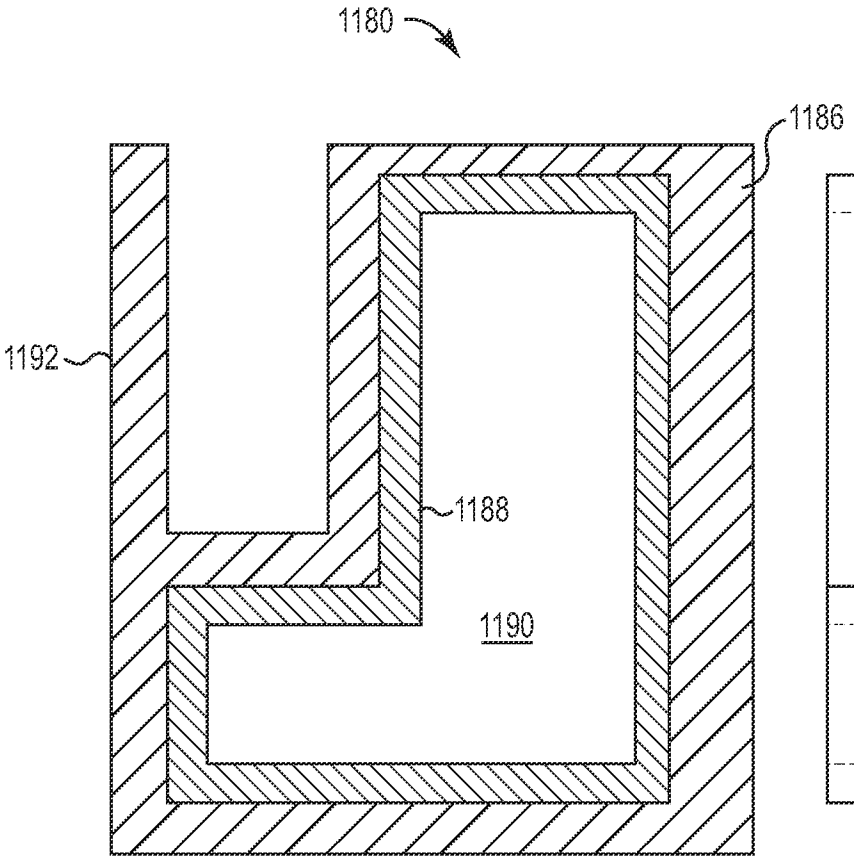
FIG. 38A is a schematic cross-sectional view of a drain assembly coupler according to one embodiment.

FIGS. 38A and 38B are schematic views of a drain assembly coupler 1180 according to one embodiment. Drain assembly coupler 1180 includes a first section 1182, a second section 1184, and a collar 1186. First section 1182 and second section 1184 extend from either side of collar 1186. The outer dimensions of the first section 1182 and second session 1184 are configured to assemble within the interior of drain assembly 1120 or drain assembly 1121. Collar 1184 is dimensioned to be flush with the exterior of drain assembly 1120, 1121. An inset sleeve 1188 is disposed within drain assembly coupler 1180 and is configured to provide a water seal when assembled with drain assembly 1120, 1121. Drain assembly coupler 1180 forms a drainage cavity 1190 which aligns with drainage cavity 1136 of drain assembly 1120, 1121. Drain assembly coupler 1180 includes a vertical leg 1192 which corresponds with the vertical leg 1142 of drain assembly 1120, 1121, thereby providing a consistent profile along the entire length of the system.

During assembly, coupler 1180 is joined with drain assembly 1120 on either side. Accordingly, first section 1182 is inserted into a first length of drain assembly 1120 and second section 1184 is inserted into a second length of drain assembly 1120. Adhesive, such as pvc cement, may be used to adhere coupler 1180 to drain assembly 1120. In one embodiment, drain assembly coupler 1180 is not fully adhered along one of either first section 1182 or second section 1184 to allow for expansion within the building. For example, drain assembly coupler 1180 may not be fully adhered at a location of a building expansion joint. First section 1182 and/or second section 1184 extend a distance within the drain assembly 1120 to provide for the expansion and appropriate sealing. In one embodiment, first section 1182 and second section 1184 extend 1" from collar 1186. Coupler 1180 may be configured as a straight coupler or configured for an angled connection such as a corner.

Figure 39A:
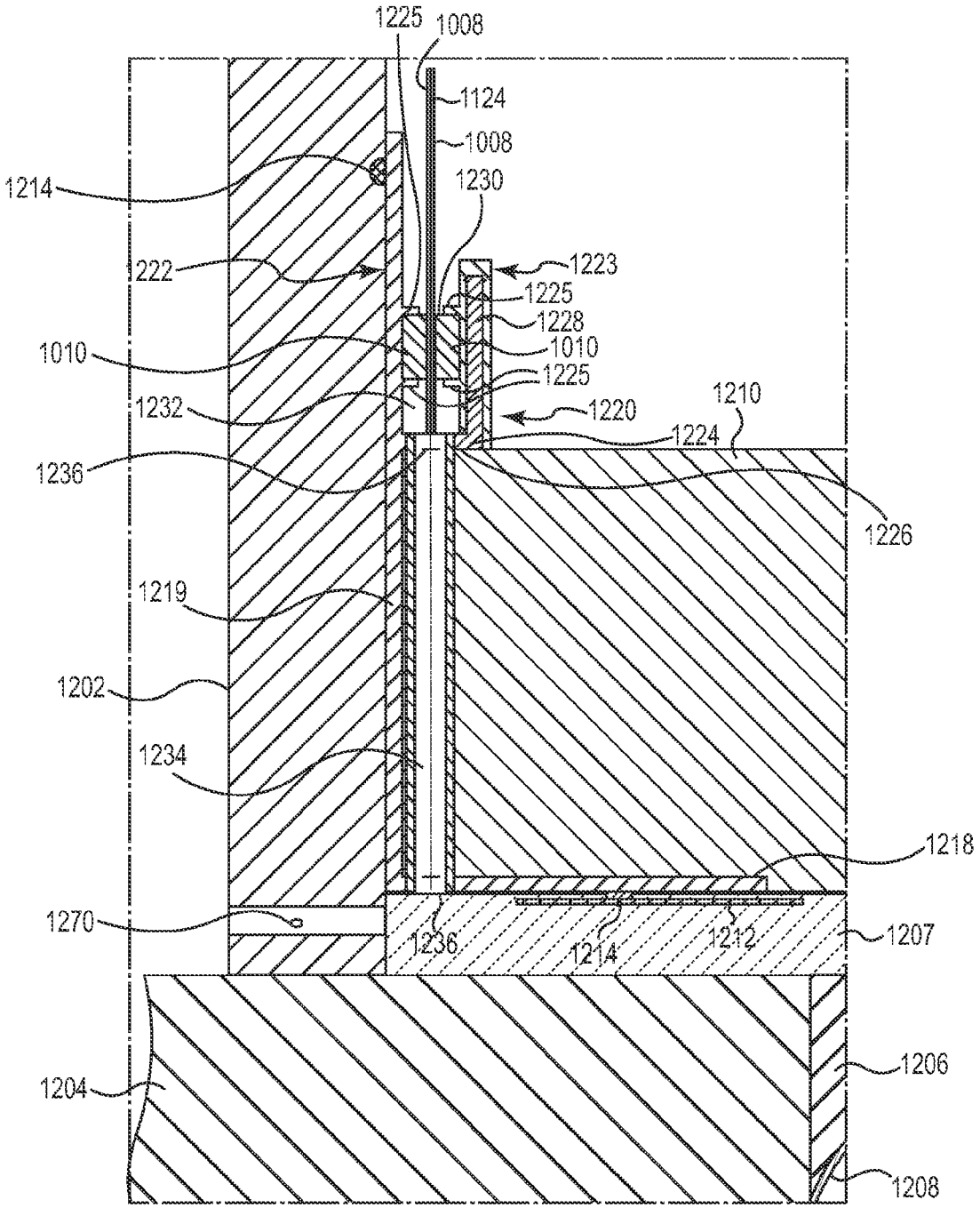
FIGS. 39A and 39B are a schematic cross-sectional views of a drain assembly disposed in a building envelope assembly according to one embodiment.
Figure 39B:
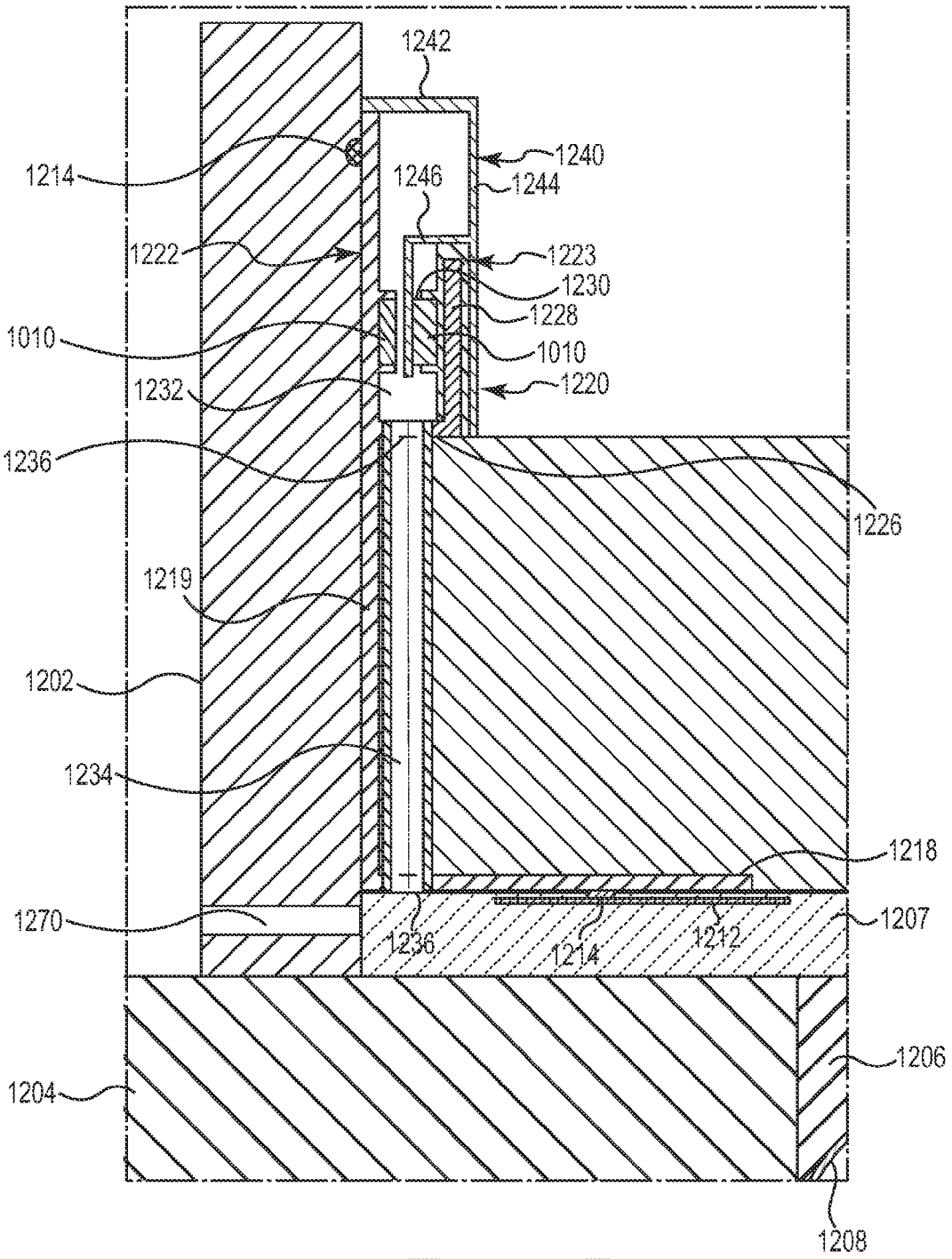

FIGS. 39A and 39B are schematic cross-sectional views of a drain assembly 1220 disposed in a building envelope assembly according to one embodiment. In one embodiment, exterior wall system 1202 is a concrete masonry wall disposed on footing 1204. A concrete slab 1210 is disposed on fill 1206, fill 1207, and footing 1204. Drain tile 1208 is positioned on an interior side of footing 1204 within fill 1206. Vapor barrier 1212 is disposed between fill 1207 and a lower surface of concrete slab 1210. In one embodiment, vapor barrier 1212 is adhered to drain assembly 1220 with sealant 1214. Drain assembly 1220 includes a first member 1222 coupled with a second member 1223. With particular reference to FIG. 39A, similar to earlier discussed embodiments, MTS 1124 extends into transfer cavity 1232 with wicking sheets 1008 adhered to bottom portion 1125 of MTS 1124. Drained condensate from drain assembly 1220 and weep hole 1270 is transported through fill 1207 by capillary flow and is disposed of in drain tile 1208 on the interior side of footing 1204.

First member 1222 includes a bottom plate 1218 and a vertical leg, or face plate, 1219 extending at a right angle from bottom plate 1218. Bottom plate 1218 is installed with a bottom face adjacent to vapor barrier 1212. Sealant 1214 is disposed between bottom plate 1218 and vapor barrier 1212 to provide a seal. Vertical leg 1219 includes an angled leg 1224 including a horizontal portion 1226 and a vertical portion 1228. Second member 1223 is slidably disposed over vertical portion 1228. Vertical leg 1219 in conjunction with angled leg 1224 and second member 1223 forms a sealing cavity 1230 and a transfer cavity 1232. Seals 1010 are disposed in sealing cavity 1230 on both side of MTS 1124 and wicking sheets 1008. In one embodiment, horizontal portion 1226 of angled leg 1224 is positioned along a top side of concrete slab 1210. A drainage cavity 1234 extends between horizontal portion 1226 and bottom plate 1220. As typical with previous embodiments, sealing cavity 1230, transfer cavity 1232, and drainage cavity 1234 fluidly communicate with one another and are configured in a serial configuration along the vertical leg 1219. This configuration allows slab 1210 to be in contact with exterior wall system 1202 and transfer necessary structural loads as required by building codes.

With further reference to FIG. 39B, drain assembly 1220 includes a cap 1240. Cap 1240 is configured to assembly over first member 1222 and second member 1223 and provides closure to drain assembly 1220 from the top. Cap 1240 includes a top 1242, a side 1244, and an extension 1246. Extension 1246 is configured to extend snuggly between seals 1010 to temporarily secure cap 1240 to first member 1222 and second member 1223. Alternatively, if seals 1010 aren't installed, extension 1246 extends snuggly between seal stops 1225. Top 1242 extends from the top of vertical leg 1219, flush with exterior wall 1202, to join side 1244 which extends down toward slab 1210 along an outer surface of vertical portion 1228 and second member 1223. In one embodiment, side 1244 extends fully to slab 1210 although this isn't necessary as long as closure to the interior of drain assembly 1220 is achieved. Cap 1240 may be installed prior to pouring slab 1210 and left in place until a user is ready to install MTS 1124. Cap 1240 must be removed prior to insertion of MTS 1124 within drain assembly 1220.

Figure 40A:
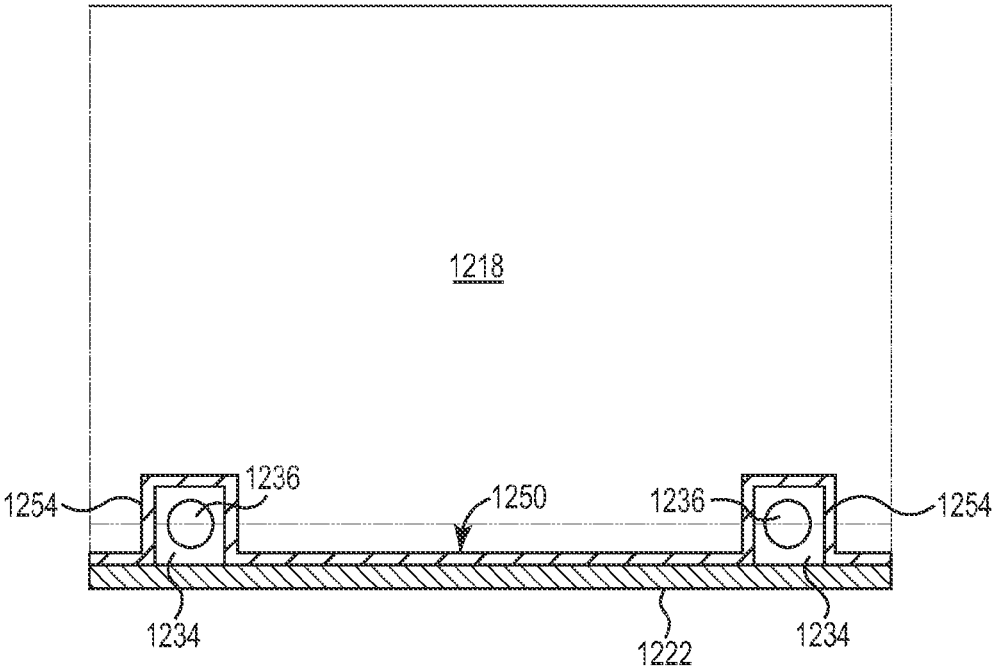
FIG. 40A is a schematic cross-sectional view of the drain assembly illustrated in FIGS. 39A and 39B according to one embodiment.
Figure 40B:
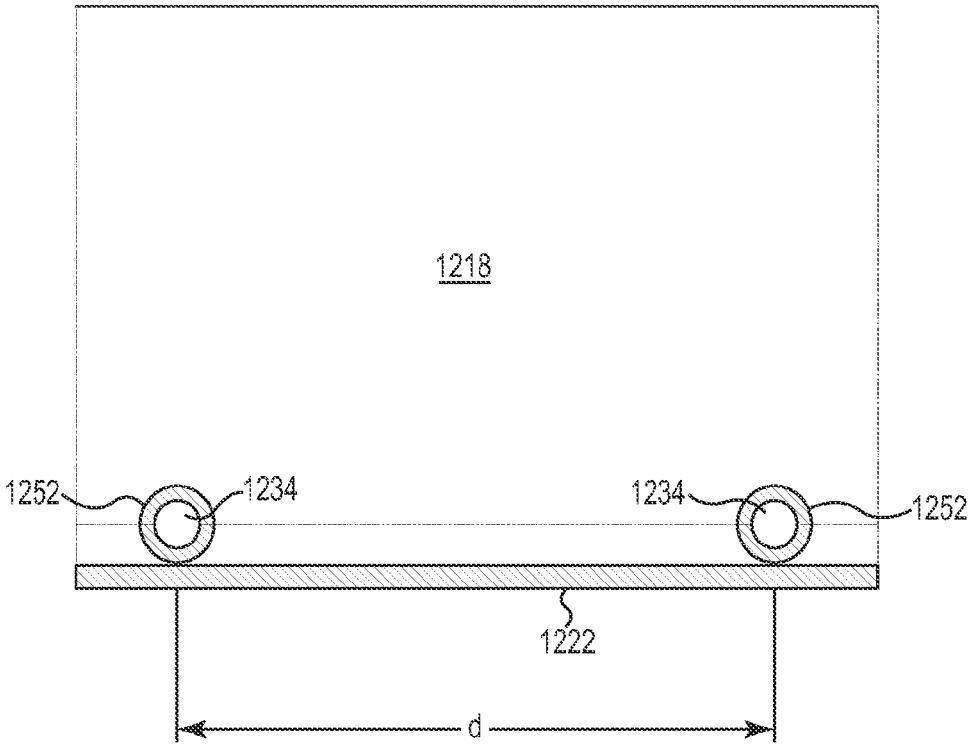
FIG. 40B is a schematic cross-sectional view of the drain assembly illustrated in FIGS. 39A and 39B according one embodiment.

As illustrated in FIGS. 40A and 40B, drainage cavity 1234 may be configured as profiled sheet 1250 or as a drainage tubes 1252 adhered to vertical leg 1222 and having drainage channels 1254 spaced at a predetermined distance, such as 12" or 16" o.c., for example. Holes 1236 are included in bottom plate 1218 and horizontal portion 1226 of angled leg 1224 to correspond with either drainage tubes 1252 or drainage channels 1254.

Figure 41:
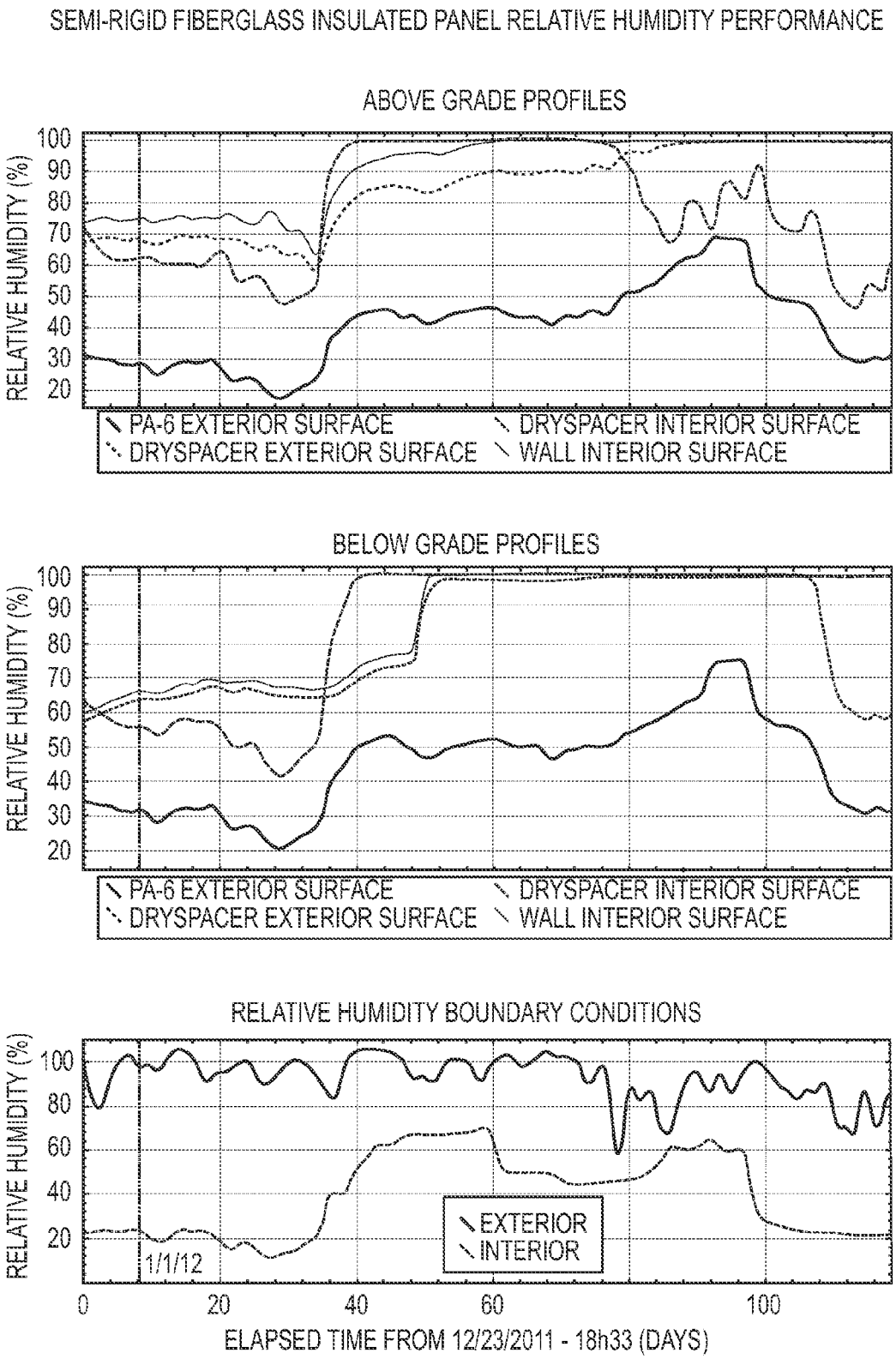
FIG. 41 is a graph of a semi-rigid fiberglass insulated panel relative humidity performance.
Figure 42:
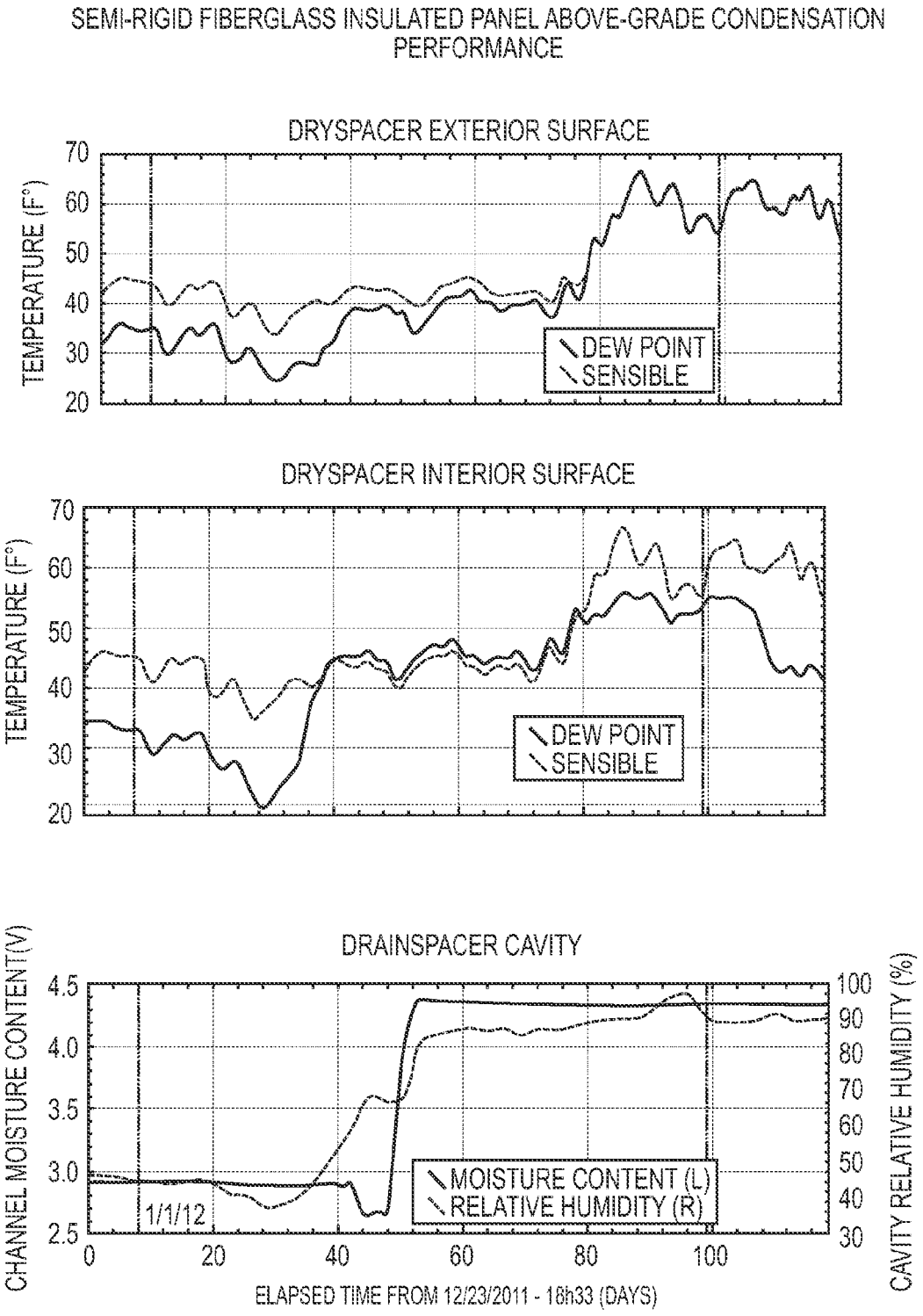
FIG. 42 is a graph of a semi-rigid fiberglass insulated panel above grade condensation performance.
Figure 43:
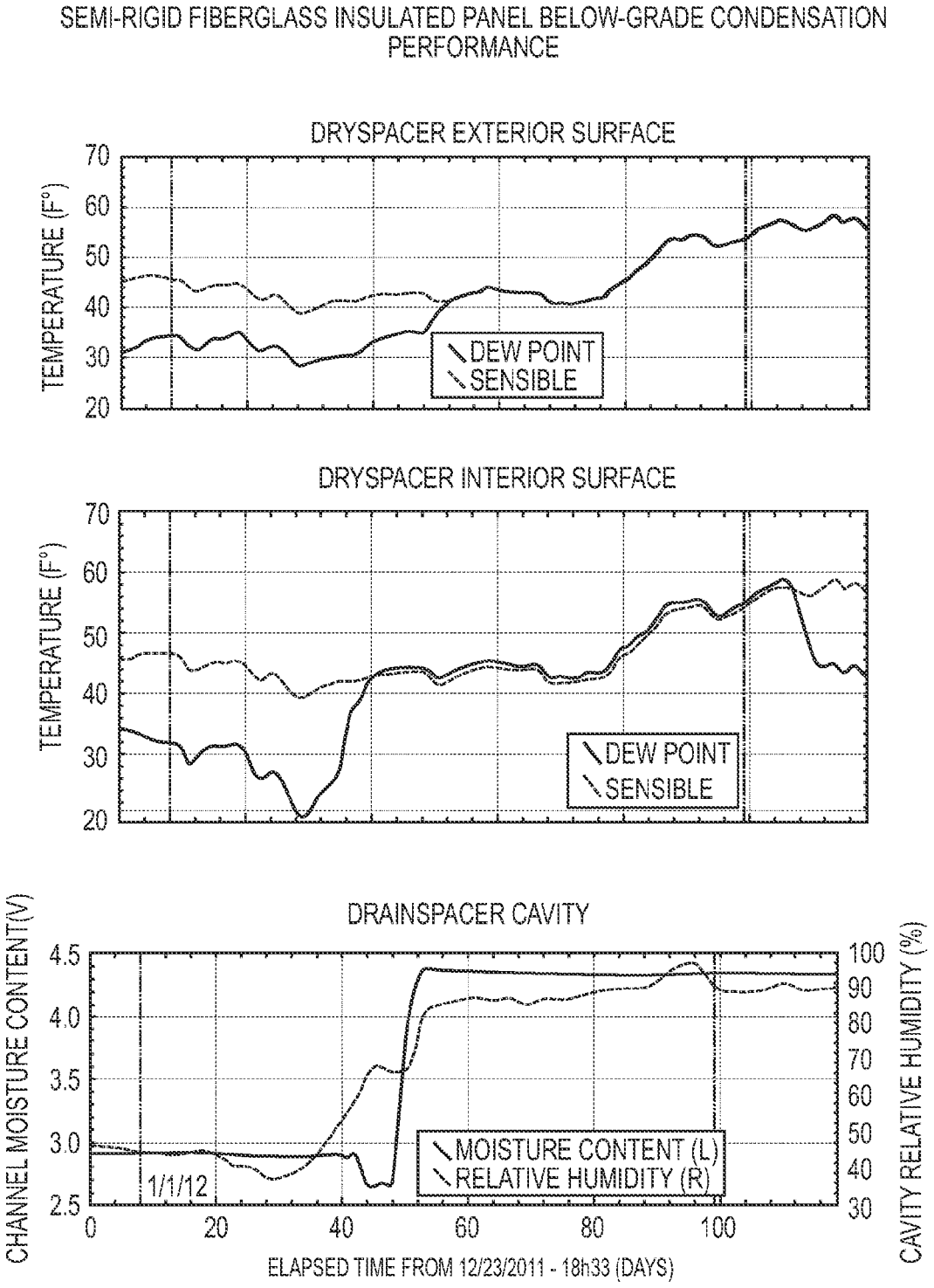
FIG. 43 is a graph of a semi-rigid fiberglass insulated panel below grade condensation performance.

FIGS. 41 through 43 are graphical illustrations of data based on wall system 1000 and drainage assembly 1020 illustrated in FIGS. 32 and 33 discussed above. In particular, FIG. 41 is a graphical illustration of a semi-rigid fiberglass insulated panel relative humidity performance. FIG. 41 illustrates a polyamide-6 (PA-6) exterior surface, a dry spacer exterior surface, dry spacer interior surface, and wall interior surface relative humidity performance above grade and below grade. In addition, the relative humidity boundary conditions are shown on the interior and exterior surfaces.

FIG. 42 is a graphical representation of a semi-rigid fiberglass insulated panel above grade condensation performance with the MTS 1124. The top graph shows the dew point and sensible temperatures on the dry spacer exterior surface. The sensible temperature is the dry bulb temperature of air while the dew point temperature shows the temperature at which condensation forms on the surface of the MTS 1124, as known in the industry. When the sensible temperature is less than or equal to the dew point temperature, condensation occurs. The middle graph illustrates the dewpoint and sensible on the dry spacer MTS 1124 interior surface. The bottom graph represents a dry spacer cavity, moisture content and relative humidity according to one embodiment. The data for these representations was taken for 118 days and 17 hours.

FIG. 43 is a graphical representation of a semi-rigid fiberglass insulated panel below grade condensation performance. As illustrated in FIG. 42 with the above grade condensation performance, the top graph illustrates the dewpoint and sensible of the exterior dry spacer MTS 1124 exterior surface and the middle graph illustrates the dry spacer MTS 1124 interior surface dewpoint and sensible. Dry spacer cavity moisture content and relative humidity are illustrated on the lower graph. Again, the elapsed time for this data was 118 days and 17 hours. The data of FIGS. 41-43 demonstrates that condensate that formed on either side of the dry spacer MTS 1124 was transported to the drainage cavity 1026 of FIGS. 32 and 33.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A building envelope assembly comprising:

a structural wall system;

a drain assembly attached to the structural wall system, the drain assembly including a bottom plate, a top plate extending parallel to the bottom plate, a face plate extending perpendicular from the bottom plate, the drain assembly defining a sealing cavity and at least one drainage cavity fluidly connected to the sealing cavity between the top plate and bottom plate;

a sealing member assembled in the sealing cavity;

a second wall system parallel to the structural wall system; and a flexible sheet disposed between the structural wall system and the second wall system and extending within the sealing cavity and at least one drainage cavity of the drain assembly, the flexible sheet configured to transport moisture from between the structural wall system and the second wall system.

2. The building envelope assembly of claim 1, wherein the second wall system includes an insulation layer disposed adjacent to the flexible sheet.

3. The building envelope assembly of claim 1, wherein the drain assembly is configured to direct fluid toward an exterior of the structural wall.

4. The building envelope assembly of claim 1, wherein the flexible sheet is configured to form a barrier to air movement.

5. The building envelope assembly of claim 1, wherein the flexible sheet terminates within one of the at least one drainage cavity.

6. The building envelope assembly of claim 1, wherein the sealing member is configured to limit air movement.

7. The building envelope assembly of claim 1, wherein the drain assembly includes a first member and a second member, wherein the first member is removably coupled to the second member.

8. A building envelope assembly, comprising:

a structural wall system;

a flexible sheet disposed along a surface of the structural wall system, the flexible sheet configured to form a barrier to air movement;

a drain assembly disposed along a bottom portion of the flexible sheet, the drain assembly configured to receive moisture from the flexible sheet; and a seal attached to the bottom portion of the flexible sheet within a drain cavity formed between a first side and a second side opposite the first side of the drain assembly, the seal configured to form a barrier to air movement through the drain assembly.

9. The building envelope assembly of claim 8, wherein the seal is configured to limit air movement.

10. The building envelope assembly of claim 8, comprising:

an insulation layer disposed adjacent to the flexible sheet.

11. The building envelope assembly of claim 10, comprising:

a flexible air barrier disposed adjacent the insulation layer opposite of the flexible sheet.

12. The building envelope assembly of claim 8, comprising:

a wicking sheet disposed adjacent the flexible sheet within the drain assembly.

13. The building envelope assembly of claim 8, wherein the drain assembly includes a sealing cavity fluidly connected to the drain cavity.

14. The building envelope assembly of claim 13, wherein the flexible sheet terminates within the drain cavity.

15. A building envelope assembly, comprising:

a first wall system including a sheathing layer;

a drain assembly attached to the sheathing layer, the drain assembly including a bottom plate, a top plate extending parallel to the bottom plate, a face plate extending perpendicular from the bottom plate, a sealing cavity, and a drainage cavity fluidly connected to the sealing cavity, the sealing cavity and drainage cavity formed between the bottom plate and the top plate;

a sealing member assembled in the sealing cavity;

a second wall system parallel to the first wall system; and a flexible sheet disposed within the second wall system and extending within the drain assembly on opposing sides of the sealing member, the flexible sheet configured to transport moisture from the first wall system and the second wall system.

16. The building envelope assembly of claim 15, comprising:

an insulation layer extending parallel to the flexible sheet, the insulation layer terminating within a first cavity of the drain assembly.

17. The building envelope assembly of claim 15, wherein the flexible sheet terminates within the drain cavity.

18. The building envelope assembly of claim 15, wherein the drain assembly includes a first portion configured to selectively couple with a second portion.

19. The building envelope assembly of claim 18, wherein the first and second portions are selectively coupled to define the sealing cavity and the drainage cavity.

20. The building envelope assembly of claim 15, wherein the flexible sheet is vapor permeable.

* * * * *